US010465516B1

(12) United States Patent
Hilgert et al.

(10) Patent No.: US 10,465,516 B1
(45) Date of Patent: Nov. 5, 2019

(54) OPPOSED PISTON ENGINE CAM SHAPE

(71) Applicant: HTS LLC, Houston, TX (US)

(72) Inventors: Carlos Marcelo Hilgert, Gonçalves (BR); Gustavo Ludwig Schneider, Rio de Janeiro (BR)

(73) Assignee: HTS LLC, Houston, TX (US)

( * ) Notice: Subject to any disclaimer, the term of this patent is extended or adjusted under 35 U.S.C. 154(b) by 0 days.

(21) Appl. No.: 16/291,680

(22) Filed: Mar. 4, 2019

Related U.S. Application Data

(60) Provisional application No. 62/756,846, filed on Nov. 7, 2018, provisional application No. 62/807,084, filed on Feb. 18, 2019.

(51) Int. Cl.
*F01B 3/00* (2006.01)
*F02B 75/26* (2006.01)

(52) U.S. Cl.
CPC ..... *F01B 3/002* (2013.01); *F01B 3/0005* (2013.01); *F01B 3/0085* (2013.01); *F02B 75/26* (2013.01); *F01B 3/0029* (2013.01)

(58) Field of Classification Search
CPC ..... F01B 3/002; F01B 3/0085; F01B 3/0005; F01B 3/0029; F01B 3/0023; F01B 3/04; F01B 3/045; F01B 7/00; F01B 7/02; F01B 7/04; F01B 9/06; F01B 2009/061; F01B 2009/065; F02B 75/26
See application file for complete search history.

(56) References Cited

U.S. PATENT DOCUMENTS

| | | | |
|---|---|---|---|
| 1,788,140 | A | 1/1931 | Woolson |
| 1,808,083 | A | 6/1931 | Tibbetts |
| 1,819,826 | A | 8/1931 | Sherman |
| 2,076,334 | A | 4/1937 | Burns |
| 2,080,846 | A | 5/1937 | Alfaro |
| 2,457,183 | A | 12/1948 | Sherman |
| 2,567,576 | A | 9/1951 | Palumbo |
| 2,770,140 | A | 11/1956 | Palumbo |
| 3,456,630 | A | 7/1969 | Karlan |
| 3,943,895 | A | 3/1976 | Howell |
| 4,996,953 | A | 3/1991 | Buck |
| 5,031,581 | A | 7/1991 | Powell |
| 5,103,778 | A | 4/1992 | Usich, Jr. |
| 5,375,567 | A | 12/1994 | Lowi, Jr. |
| 5,507,253 | A | 4/1996 | Lowi, Jr. |
| 5,749,337 | A | 5/1998 | Palatov |

(Continued)

FOREIGN PATENT DOCUMENTS

| | | | |
|---|---|---|---|
| GB | 2019487 | A | 10/1979 |
| GB | 2369859 | A | 6/2002 |

(Continued)

*Primary Examiner* — Grant Moubry

(57) ABSTRACT

An opposed piston engine has a driveshaft with a spaced apart cams mounted thereon. Each cam has a circumferential cam shoulder of a curvilinear shape selected to enhance flow through intake and exhaust ports. The curvilinear shape may be a segmented polynomial shape forming lobes which lobes are asymmetrical so that the lobe wavelength distance from a first trough to the lobe peak of an ascending shoulder portion of the lobe is greater than the lobe wavelength distance from the peak to a second trough of a descending shoulder portion of the lobe. Opposing cam shoulders may be shaped so as to always be converging or diverging from one another.

30 Claims, 31 Drawing Sheets

(56) References Cited

U.S. PATENT DOCUMENTS

| | | | | |
|---|---|---|---|---|
| 5,799,629 | A | 9/1998 | Lowi, Jr. | |
| 6,089,195 | A | 7/2000 | Lowi, Jr. | |
| 6,202,605 | B1 | 3/2001 | Henriksen | |
| 6,250,264 | B1 | 6/2001 | Henriksen | |
| 6,305,335 | B1 | 10/2001 | O'Toole | |
| 6,779,494 | B1 | 8/2004 | Aswani | |
| 6,834,636 | B2 | 12/2004 | Thomas et al. | |
| 8,245,673 | B2 * | 8/2012 | Howell-Smith | F01B 1/0624 123/197.1 |
| 8,534,241 | B2 | 9/2013 | Gaiser | |
| 8,820,275 | B2 * | 9/2014 | McAlister | F01B 1/062 123/47 R |
| 8,863,643 | B2 | 10/2014 | Powell | |
| 9,528,373 | B2 * | 12/2016 | Van Den Brink | F01B 3/0085 |
| 2003/0188701 | A1 | 10/2003 | Daniel | |
| 2006/0037567 | A1 | 2/2006 | Thomas | |
| 2008/0105117 | A1 | 5/2008 | Kubes et al. | |
| 2008/0105222 | A1 * | 5/2008 | Kubes | F01B 3/0005 123/52.1 |
| 2008/0105224 | A1 * | 5/2008 | Kubes | F01B 3/0005 123/56.1 |
| 2009/0188471 | A1 * | 7/2009 | Jaquet | F01B 3/0005 123/48 B |
| 2015/0114148 | A1 * | 4/2015 | Van Den Brink | F16H 53/06 74/56 |
| 2016/0025002 | A1 * | 1/2016 | Ellis | F01L 17/00 123/51 B |

FOREIGN PATENT DOCUMENTS

| | | | |
|---|---|---|---|
| GB | 2453131 | A | 4/2009 |
| GB | 2476078 | A | 6/2011 |
| GB | 2482565 | A | 2/2012 |
| GB | 2558648 | A | 7/2018 |
| WO | WO-0223025 | A1 | 3/2002 |
| WO | WO-2013124604 | A1 | 8/2013 |

* cited by examiner

OPPOSED PISTON ENGINE CAM SHAPE

PRIORITY

The present application claims priority to U.S. Provisional Application No. 62/756,846, filed on Nov. 7, 2018, and U.S. Provisional Application No. 62/807,084, filed Feb. 18, 2019, the benefit of which is claimed and the disclosures of which are incorporated herein by reference in their entirety.

TECHNICAL FIELD OF THE INVENTION

The present disclosure relates to internal combustion barrel engines, and more particularly to opposed piston engines. More particularly still, the present disclosure relates to the shape and relative orientation of cam surfaces, piston design and piston rod assembly for opposed piston engines.

BACKGROUND OF THE INVENTION

Axial piston engines, also called barrel type engines, are crankless, reciprocating internal combustion engines having one or more cylinders, each of which houses two opposed pistons arranged to reciprocate in opposite directions along the longitudinal axis of the cylinder. Crankless engines do not rely on the crankshaft for piston motion, but instead utilize the interaction of forces from the combustion chamber gases, and a rebound device (e.g., a piston in a closed cylinder). A main shaft is disposed parallel to, and spaced from, the longitudinal axis of each cylinder. The main shaft and pistons are interconnected via a swashplate such that reciprocation of the pistons imparts rotary motion to the main shaft. The swashplate has a generally sinusoidal cam surface or track that is engaged by each piston arm to impart axial motion to the piston. The shape of the track can be utilized to control the relative position of the piston head.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
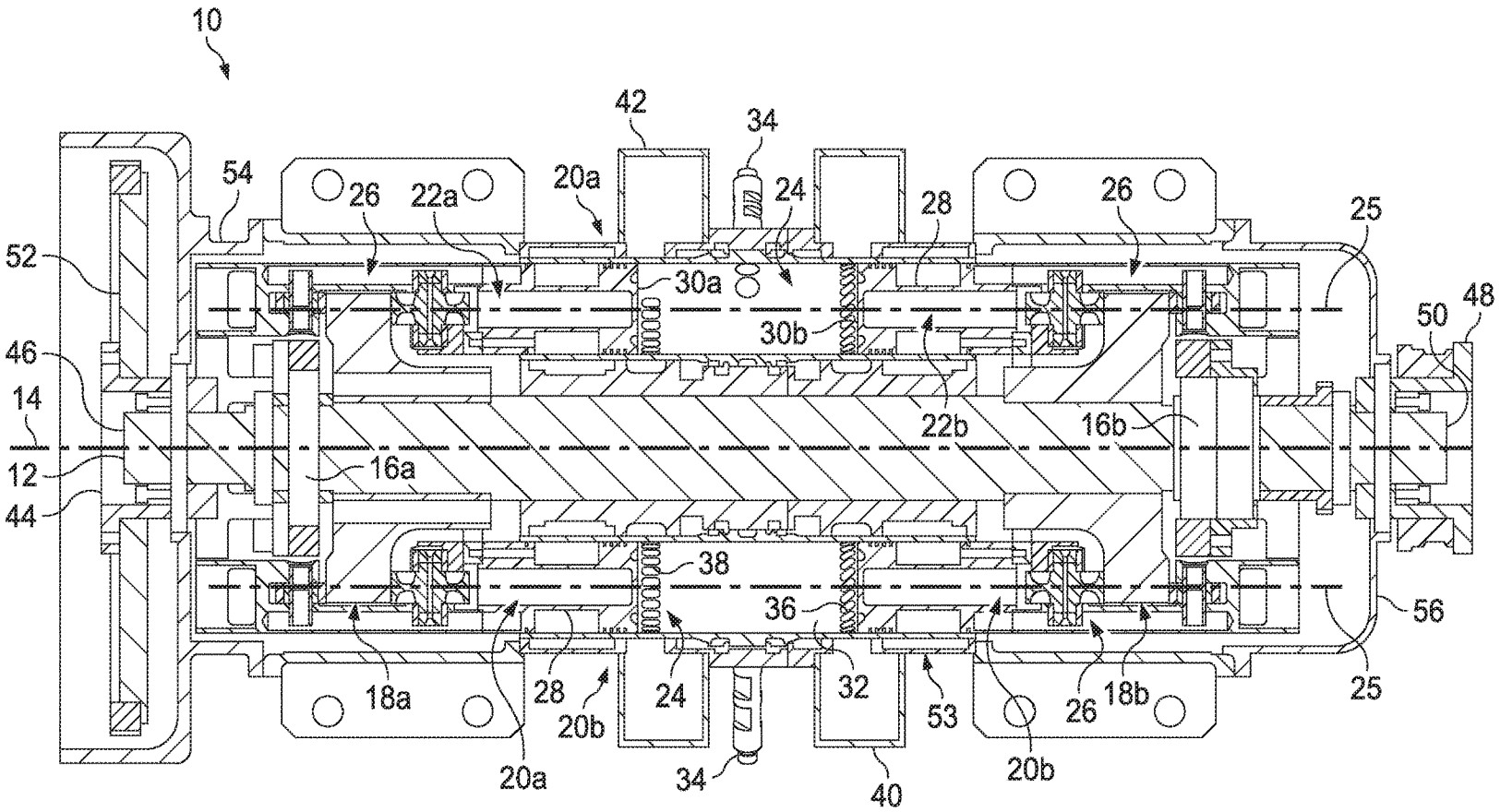
FIG. 1 is a longitudinal section and cutaway view of an engine assembly constructed according to the present invention showing the axial-cylinder, opposed-piston layout utilizing twin, double-harmonic cams.
Figure 2:
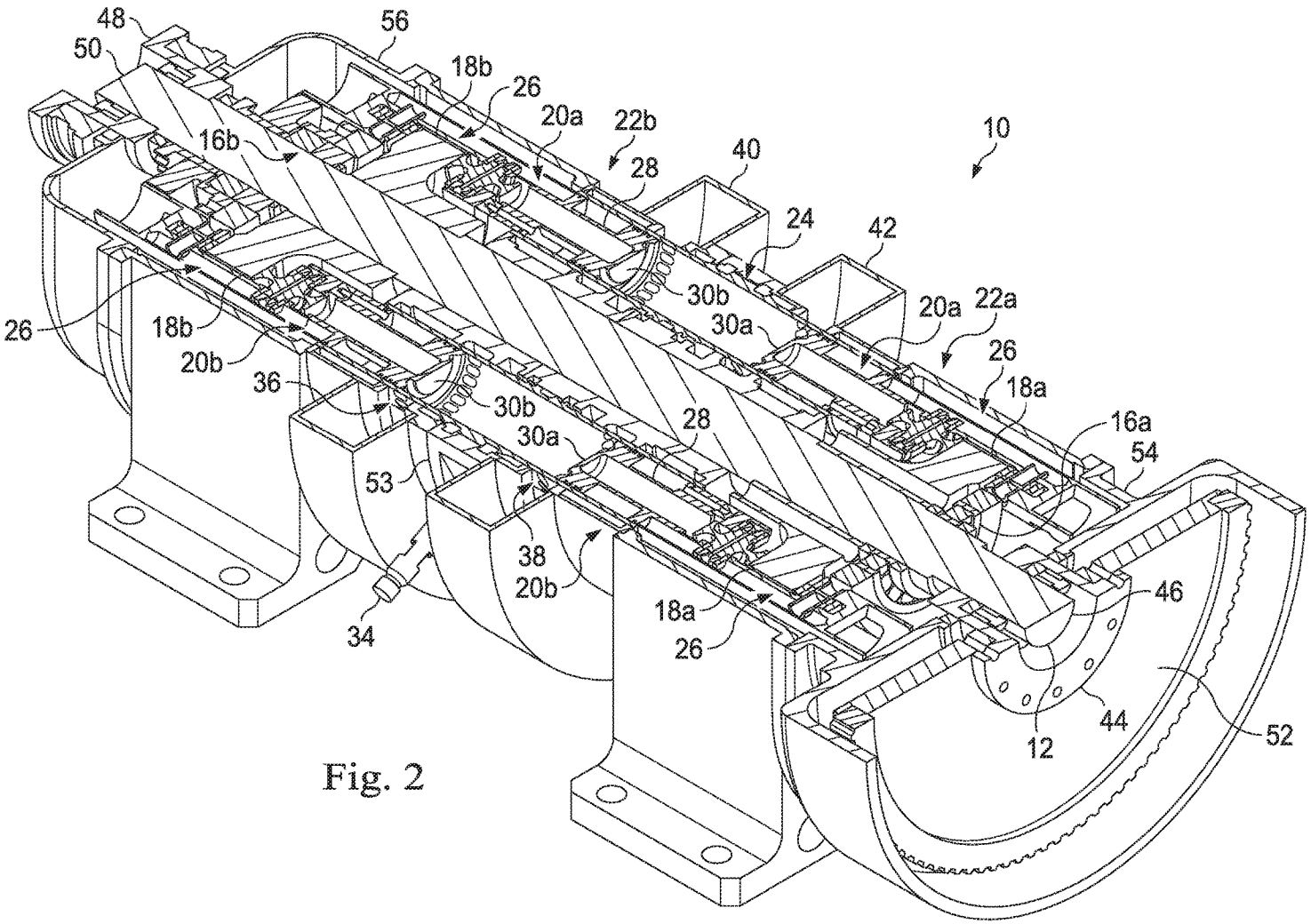
FIG. 2 is a perspective view of the engine assembly of FIG. 1.

FIG. 1 shows a simplified longitudinal section and cutaway view of a 2-stroke engine assembly 10 of the present invention, while FIG. 2 shows a perspective view of engine assembly 10. Driveshaft 12 extends along a driveshaft axis 14 and passes axially through the center of the assembly 10. Driveshaft 12 is supported by a pair of bearings 16*a*, 16*b* in a fixed axial position. Positioned along driveshaft 12 in spaced apart relationship to one another are harmonic barrel cams 18*a*, 18*b*. Positioned radially outward from driveshaft 12 are two or more piston pairs 20, each piston pair 20 having a first piston assembly 22*a* and a second piston assembly 22*b* which piston assemblies 22*a*, 22*b* are axially aligned with one another within a combustion cylinder assembly 24 disposed along a cylinder axis 25. In the illustrated embodiment, two piston pairs 20*a*, 20*b* are illustrated, with each piston pair 20 having first and second piston assemblies 22*a*, 22*b*. Cylinder axis 25 is spaced apart from but generally parallel with driveshaft axis 14 of driveshaft 12. Each piston assembly 22 generally includes a cam follower assembly 26 attached to a piston arm 28 to which is mounted a piston 30. The opposed pistons 30*a*, 30*b* of a piston pair 20 are adapted to reciprocate in opposite directions along cylinder axis 25. Each cam follower assembly 26 straddles a corresponding cam 18 and acts on a piston 30 through its associated piston arm 28. Opposed pistons 30*a*, 30*b* within cylinder assembly 24 generally define a combustion chamber 32 therebetween into which fuel may be injected by a fuel injector 34. Upon combustion of fuel within combustion chamber 32, opposed pistons 30*a*, 30*b* are driven away from one another along cylinder axis 25.

Engine assembly 10 includes at least two piston pairs 20 symmetrically spaced about driveshaft axis 14. In the illustrated embodiment, a first piston pair 20*a* and a second piston pair 20*b* are shown, each engaging a combustion cylinder assembly 24. In other embodiments, three or more piston pairs 20 each with a corresponding combustion cylinder assembly 24 may be symmetrically spaced about driveshaft axis 14.

As will be explained in more detail below, as opposing pistons 28 are displaced in equal and opposite directions as a result of combustion. Their respective cam follower assemblies 26 are likewise linearly displaced, which forces cams 18 engaged by the cam follower assemblies 26 to rotated axially about driveshaft axis 14, Since cams 18 are fixedly mounted on driveshaft 12, driveshaft 12 is rotated through an angle by cam 18. The shape of cam 18, being engaged by cam follower assembly 26, therefore determines the stroke of each piston assembly 22.

Air is supplied to combustion chamber 32 via air intake ports 36 formed in combustion cylinder assembly 24, while exhaust is removed from combustion chamber 32 via exhaust ports 38 formed in combustion cylinder assembly 24. An air intake manifold 40 is in fluid communication with intake ports 36, while an exhaust manifold 42 is in fluid communication with exhaust ports 38. In one or more embodiments, one or both of manifolds 40, 42 may be annular, extending at least partially around the perimeter of engine assembly 10. In some embodiments, manifolds 40, 42 are toroidal in shape, extending fully around the perimeter of engine assembly 10.

In one or more embodiments, a first flange 44 is attached to a first end 46 of driveshaft 12 and a second flange 48 is attached to a second end 50 of driveshaft 12. As shown, a flywheel 52 is mounted on first flange 44.

The piston assemblies 22 and combustion cylinder assembly 24 are mounted in an engine block 53. A sump casing 54 is attached to the engine block 53 adjacent the first end 46 of driveshaft 12 and a sump casing 56 is attached to engine block 53 adjacent the second end 50 of driveshaft 12.

Figure 3:
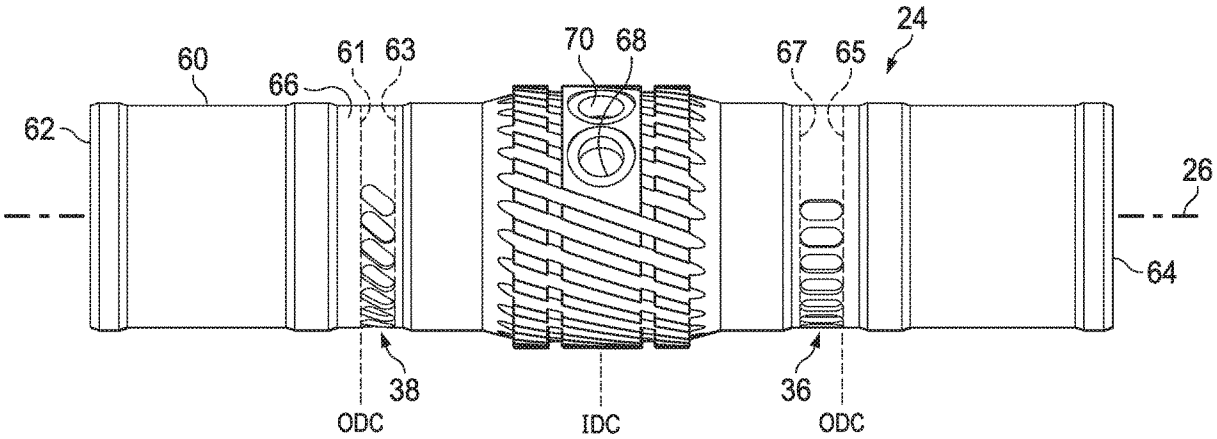
FIG. 3 is an elevation view of a piston cylinder assembly.

FIG. 3 illustrates the combustion cylinder assembly 24 disposed along a cylinder axis 25 in more detail. Specifically, combustion cylinder assembly 24 is formed of a combustion cylinder 60 extending between a first end 62 and a second end 64 and generally formed of a cylinder wall 66. A first combustion port 68 may be provided in cylinder wall 66, in some embodiments, at approximately the midpoint between first and second ends 62, 64. First combustion port 68 may be a fuel injection port, a sparkplug port or other port. In one or more embodiments, a second combustion port 70 may likewise be provided adjacent first combustion port 68. Second port 70 may be an additional fuel injection port or alternatively, a sparkplug port, it being appreciated that in some embodiments, compression of a combustible fuel is sufficient to ignite the fuel, while in other embodiments, a spark may be necessary to ignite the fuel. In yet other embodiments, additional combustion ports may be provided adjacent port 68, where each fuel injection port may be utilized for a different type of fuel, it being an advantage of the engine assembly 10 that it may utilize a variety of fuel types without the need to adapt the general components of the engine for a particular fuel type. Fuels on which engine assembly 10 may run include for example liquid fuels such as diesel, ethanol, gasoline, kerosene and gaseous fuels such as SymGas, hydrogen and natural gas.

An exhaust port 36 is formed in wall 66 between fuel injection port 68 and the second end 64 of cylinder 60, and an intake port 38 is formed in wall 66 between injection port 68 and the first end 62 of cylinder 60. In one or more embodiments, intake port 38 has an outer port edge 61 closest to the first end 62 and an inner port edge 63 closest to second end 64. Similarly, exhaust port 36 has an outer port edge 65 closest to the second end 64 and an inner port edge 67 closest to first end 62. Inner dead center (IDC) of the combustion cylinder 60 is defined approximately equidistance between the outer edge 61 of the intake port 38 and the outer edge 65 of the exhaust port 36. In one or more embodiments, the inner port edge 67 of the exhaust port 36 is closer to inner dead center than the inner port edge 63 of the intake port 38, while the outer port edge 65 of exhaust port 36 is approximately the same distance from IDC as the outer port edge 61 of intake port 38, it being appreciated that as such, exhaust port 36 is longer along axis 26 than intake port 38. Moreover, outer dead center (ODC) of the combustion cylinder 60 is defined approximately equidistance from ODC at the outer edges 61, 65 of the respective intake port 38 and exhaust port 36. In one or more embodiments, ports 38 are a plurality of slots. In one or more embodiments, ports 36 are a plurality of slots. In one or more embodiments, ports 36 are a plurality of slots each formed along a longitudinal axis that is generally parallel with cylinder axis 25. In one or more embodiments, ports 38 are a plurality of slots each formed along a longitudinal axis that is generally acute with cylinder axis 25. Ports 38 may be a plurality of slots formed at an angle relative to the cylinder axis 25 so as to promote swirl in the incoming air passing into cylinder 60, thereby enhancing mixture with fuel and combustion. In one or more embodiments, the plurality of slots are formed in cylinder wall 66 so as to have an angle of between 30-45 degrees with cylinder axis 25.

In one or more embodiments, one or both sets of ports 36, 38 extend only around a portion of the perimeter of wall 66. For example, ports 36 and/or 38 may extend only around 180 degrees of the perimeter of wall 66 or ports 36 and/or 38 may extend only around 90 degrees of the perimeter of wall 66. With respect to intake ports 38, intake ports 38 are provided only around that portion of the cylinder wall 66 that is not adjacent piston head notch (see FIG. 4) as described below. With respect to the exhaust ports 36, exhaust ports 36 are provided only around that portion of the cylinder wall 66 that is not adjacent piston head notch (see FIG. 4) as described below. In addition, to minimize exhaust heat transfer to the engine block 53 and other components of engine assembly 10, exhaust ports 36 are provided only around that portion of the cylinder wall 66. It will be appreciated that this arrangement alone, but particularly in combination with the exhaust arrangement described with respect to FIGS. 8 and 9, minimizes transfer of exhaust heat to other components of the engine. As such, during operation, the overall engine remains much cooler than prior art engines. Moreover, by controlling heat transfer in this manner, certain engine components may be manufactured of materials that need not be selected to withstand the high temperatures associated with prior art engines. For example, certain engine components may be manufactured of plastics, ceramics, glass, composites or lighter metals, thus reducing the overall weight of the engine of the disclosure.

Figure 4A:
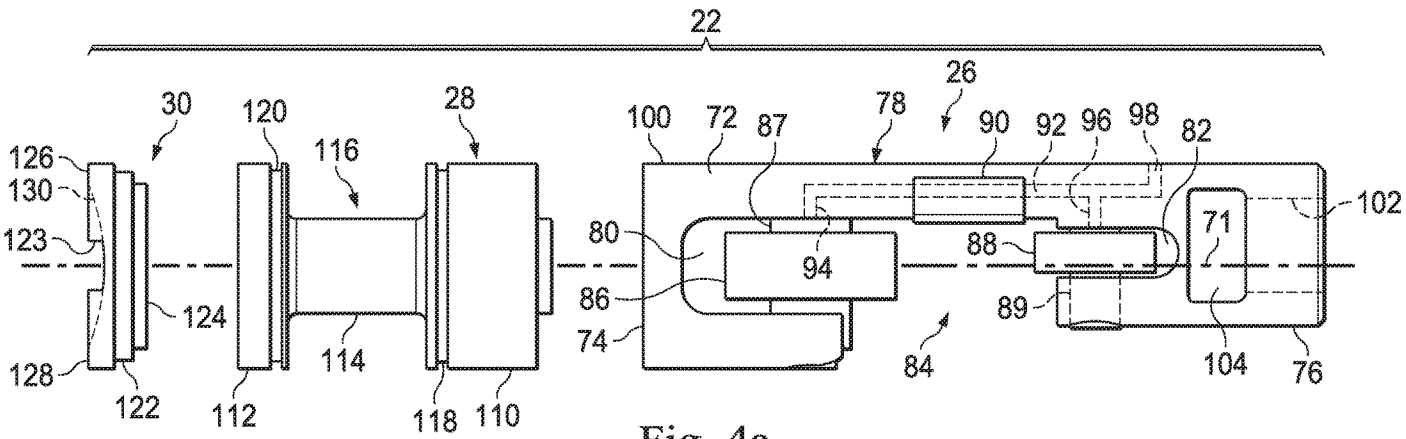
FIG. 4*a* is an exploded elevation view of a piston assembly.

Turning to FIG. 4A, an exploded side view of a piston assembly 22 is illustrated. Piston assembly 22 generally includes a cam follower assembly 26 attached to a piston arm 28 to which is mounted a piston 30, all generally aligned along axis 71. As used herein, a "hot" piston assembly 22 will be the piston assembly 22 adjacent exhaust ports 36 while "cool" piston assembly 22 will be the piston assembly 22 adjacent the intake ports 38 of a cylinder assembly 24.

Cam follower assembly 26 includes an elongated body 72 having a first end 74 and a second end 76. Body 72 may generally be cylindrical in shape at each of the ends 74, 76 which ends 74, 76 may be interconnected by an arm 78. In some embodiments, cylindrical end 74 may be of a larger diameter than cylindrical end 76. An axially extending slot 80 is formed in body 72 adjacent first end 74. An additional axially extending slot 82 is formed in body 72 in spaced apart relationship to slot 80. Slots 80, 82 are formed to extend along planes that are generally parallel to one another. An opening 84 in body 72 is formed between slots 80, 82. A first roller 86 is mounted in first slot 80, and a second roller 88 is mounted in second slot 82. Preferably, each roller has a rotational axis that is generally parallel with the rotational axis of the other roller and which axii are generally perpendicular to the planes along which the slots 80, 82 are formed. In one embodiment, roller 86 is of a larger diameter than roller 88 because roller 86 is utilized primarily to transfer the load from piston 30 to the adjacent cam 18. An adjustable spacer pad 90 may be mounted on arm 78 between rollers 86, 88 and opening 84. Spacer pad 90 is adjustable to move radially relative to axis 71, towards or away from opening 84 in order to align cam follower assembly 26 with a cam 18. An internal lubrication passage 92 is defined and extends within arm 78. Lubrication passage 92 is in fluid communication with a port 94 opening adjacent roller 86 so as to lubricate the bearings 87 of roller 86; a port 96 opening adjacent roller 88 so as to lubricate the bearings 89 of roller 88; and a port 98 disposed along the outer surface 100 of arm 78. Cylindrically shaped second end 76 of body 72 may have a bore 102 formed therein, and may have one or more windows 104 opening into bore 102.

Piston arm 28 is attached to cam follower assembly 26 at the first end 74 of body 72. Piston arm 28 may be formed of a first annular body 110 spaced apart from a second annular body 112 of similar diameters and interconnected by a smaller diameter neck 114. Neck 114 may be solid or have a bore formed therein, but is of a smaller diameter so as to form an annulus 116 between spaced apart bodies 110, 112. At least one, and preferably two or more, annular grooves 118 are formed around first annular body 110 for receipt of a seal ring (not shown). Likewise, at least one, and preferably two or more, annular grooves 120 are formed around second annular body 112 for receipt of a seal ring (not shown). Piston arm 28 utilizes two annular bodies 110, 112 spaced apart from one another along neck 114 to minimize migration of combustion gases, unburned fuel and particulate matter into sump casings 54 and 56, often referred to as the blowby effect.

Figure 4B:
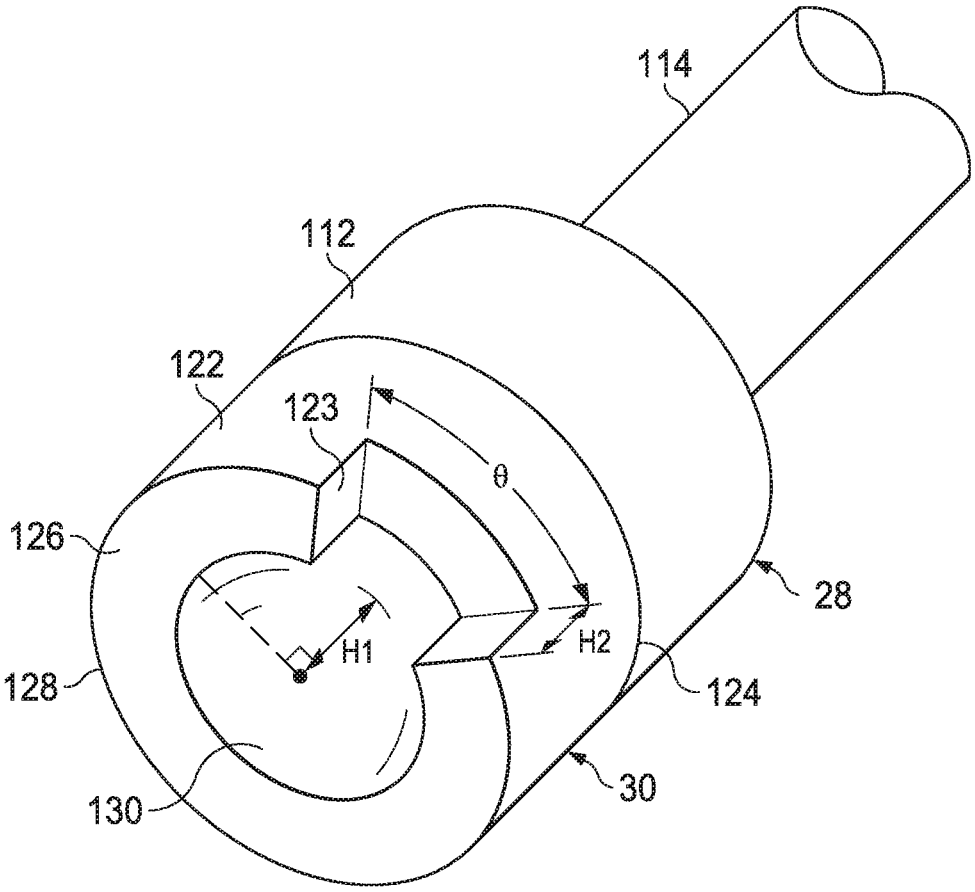
FIG. 4*b* is a perspective view of a piston crown.

With reference to FIG. 4B and ongoing reference to FIG. 4A, piston 30 is generally formed of an annular body 122 having a first end 124 attached to piston arm 28. A crown 126 is formed at the second end 128 of annular body 122. An indention 130 may be formed in crown 126 and have a depth H1. Indention 130 may be conically shaped in some embodiments. Likewise, in some embodiments, a notch 123 is formed at the periphery of annular body 122 and extends inward to intersect indention 130. In some embodiments, notch 123 preferably has a depth H2 no deeper than depth H1 of indention 130 formed in crown 126. Likewise, in some embodiments, notch 123 extends no more than approximately 90 degrees θ around the periphery of annular body 122, while in other embodiments, notch 123 extends no more than approximately 60 degrees θ around the periphery of annular body 122, while in other embodiments, notch 123 extends between 5 and 30 degrees θ around the periphery of annular body 122.

Figure 5A:
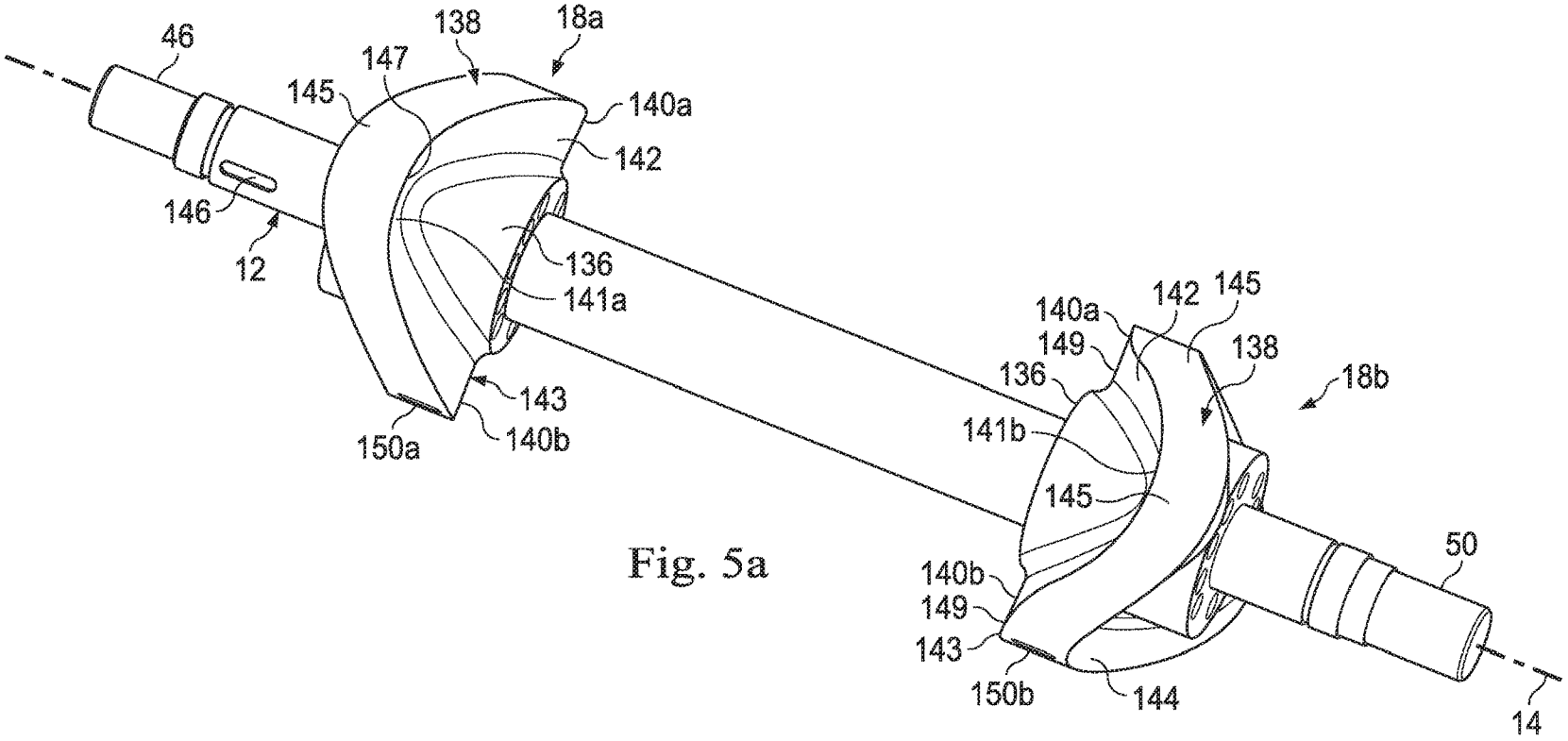
FIG. 5*a* is an elevation view of a driveshaft with harmonic barrel cams mounted thereon.

With reference to FIG. 5*a*, harmonic barrel cams 18*a*, 18*b* are shown in more detail mounted on driveshaft 12. As described above, driveshaft 12 extends along a driveshaft axis 14 between a driveshaft first end 46 and a driveshaft second end 50. Barrel cams 18*a*, 18*b* are mounted along driveshaft 12 in spaced apart relation to one another. Each cam 18 includes a cam hub 136 formed about a hub axis which cam hub 136 is mounted on driveshaft 12 to be coaxial therewith. Each cam 18 further includes a circumferential cam shoulder 138 extending around the periphery of cam hub 136. Cam shoulder 138 is generally of a curvilinear shape and can be characterized as having a certain frequency, where frequency may generally refer to the number of occurrences of peaks and troughs about the 360 degree circumference of shoulder 138, a peak and abutting troughs together forming a lobe.

In one or more embodiments, the amplitude of the peaks of each cam shoulder 138 of each cam 18*a*, 18*b* are the same, with the depth of the troughs and the height of the peaks being substantially equal, while in other embodiments, the depth of the troughs may differ from height of the peaks.

In the embodiment of FIG. 5*a*, each curvilinear shaped cam shoulder 138 extending around cam hub 136 is illustrated with two peaks, namely a first peak 140*a* and a second peak 140*b*, with a corresponding number of troughs 141 formed therebetween, such as a first trough 141*a* and a second trough 141*b*. As such, the illustrated shoulder 138 creates two complete cycles about the 360 degree circumference of cam hub 136 and thus represents double harmonics. In other embodiments, shoulder 138 may have a different number of peaks 140 and troughs 141. In other words, the frequency of the curvilinear shape forming shoulder 138 may be selected to exhibit the desired number of peaks 140 and troughs 141.

Shoulder 38 is further characterized as having an inwardly facing track or surface 142 and an outwardly facing track or surface 144 and an outer circumferential surface 145. Each cam 18*a*, 18*b* may be mounted on driveshaft 12 so as to be aligned with a driveshaft index reference 146. In particular, each cam 18 may include a cam index 150, such as the first cam index 150*a* and second cam index 150*b* of cams 18*a*, 18*b*, respectively.

In one or more embodiments, cams 18*a*, 18*b* are generally mounted on driveshaft 12 so that the indexes 150*a*, 150*b* are generally aligned with one another relative to a specific reference point 146 on driveshaft 12. When the indices 150*a*, 150*b* are aligned with one another, the opposing cams 18*a*, 18*b* mirror one another and the respective peaks 140 of the two cams 18*a*, 18*b* align with one another, meaning that the respective peaks and troughs occur at the same angular position about driveshaft 12 relative to reference point 146. As such, the peaks 140 of each cam 18*a*, 18*b* face one another and the troughs 141 of each cam 18*a*, 18*b* face one another. For the avoidance of doubt, references to cams 18 "mirroring" one another herein simply mean that the respective troughs or peaks occur at the same angular position about driveshaft 12, but not necessarily that the curvilinear shape of the shoulders 138*a*, 138*b* are the same.

Finally, the top of each peak 140 corresponds with inner dead center (IDC) of combustion cylinder assembly 24 (see FIG. 3), while the bottom of each trough 141 corresponds with outer dead center (ODC) of combustion cylinder assembly 24. In other words, when a cam follower 26 (see FIG. 4A) engages a shoulder 138 at a lobe peak 140, the piston 30 (see FIG. 4A) driven by the cam follower 26 is at IDC of combustion cylinder 60 (see FIG. 3). Likewise, when a cam follower 26 (see FIG. 4A) engages a shoulder 138 at a trough 141, the piston 30 (see FIG. 4A) driven by the cam follower 26 is at ODC of combustion cylinder 60 (see FIG. 3).

Figure 5B:
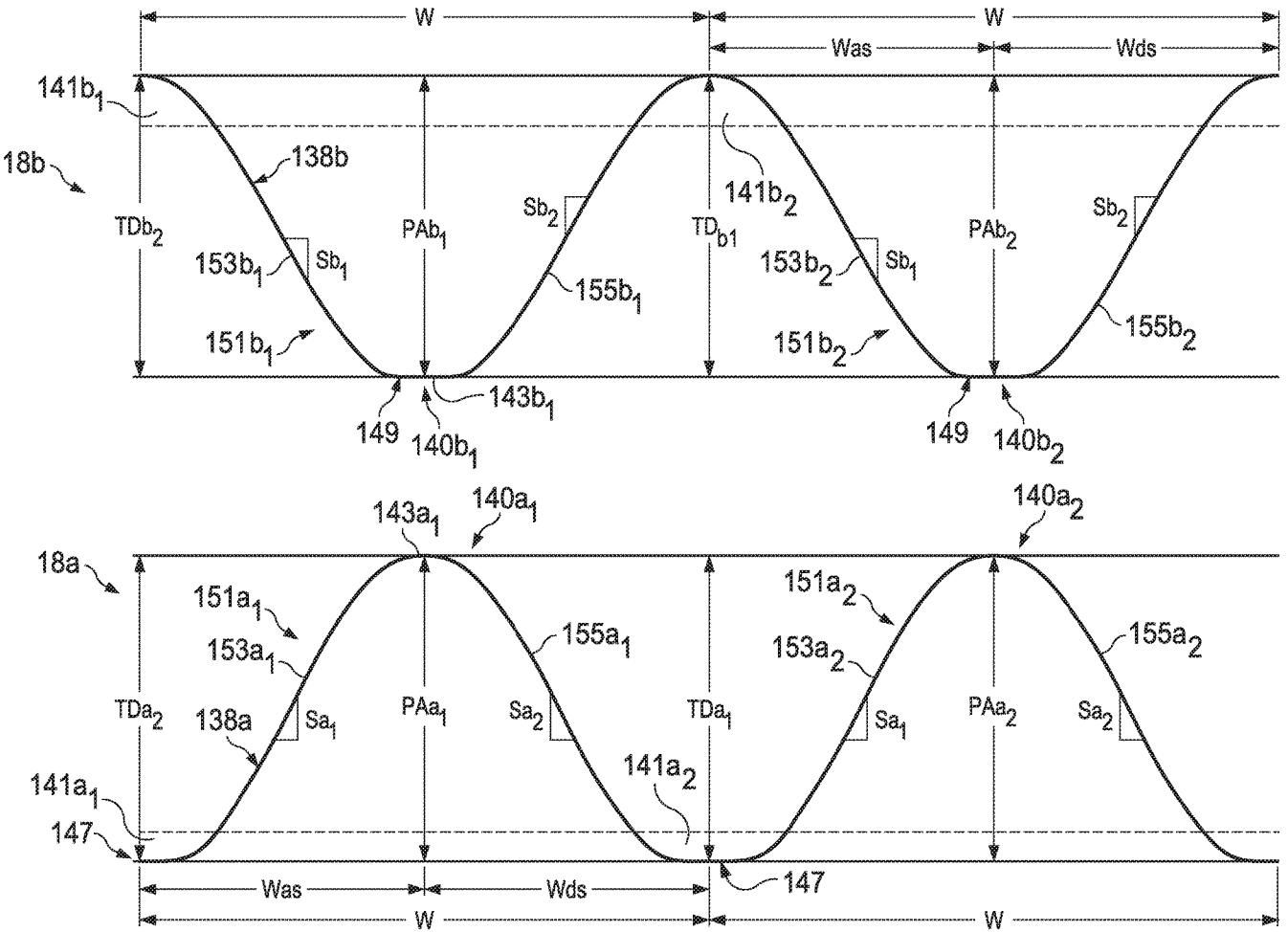
FIG. 5*b* is a cam shoulder profile having a substantially sinusoidal shape.
Figure 5C:
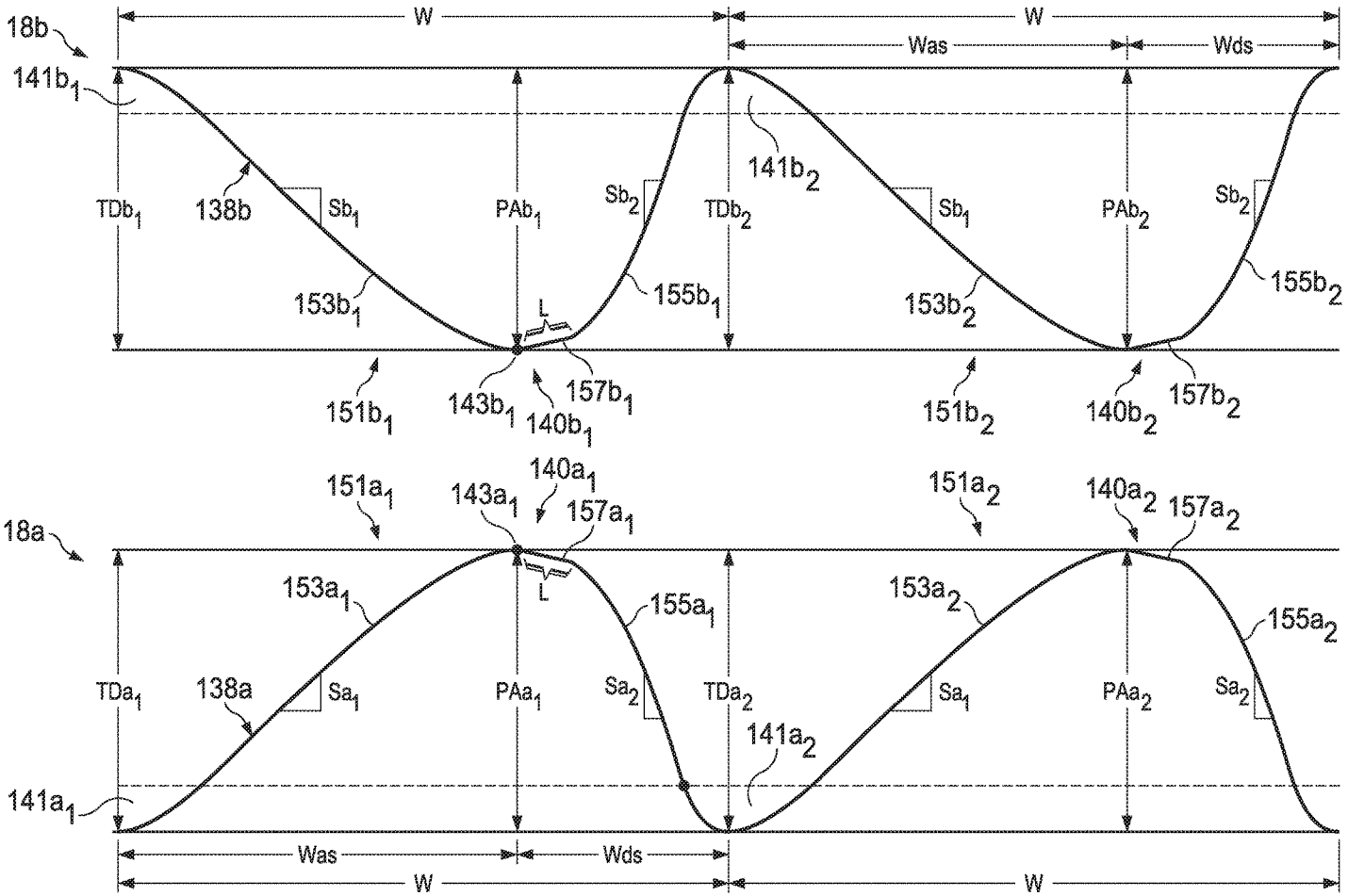
FIG. 5*c* is a cam shoulder profile having a segmented polynomial shape.

FIGS. 5*b* and 5*c* are cam profiles of cam shoulders 138*a*, 138*b* to better illustrated various embodiments of the curvilinear shape of cam shoulders 138*a*, 138*b*. In one or more embodiments as illustrated in FIG. 5*b*, the curvilinear shape may be a sinusoidal shape, with a peak occurring equidistance between successive troughs, while in other embodiments as illustrated in FIG. 5*c*, the curvilinear shape may be a segmented polynomial shape, with the peak occurring between two successive troughs and skewed or shifted closer to one trough. In any event, cam shoulder 138*a* may be associated with the intake cam 18*a* and cam shoulder 138*b* may be associated with the exhaust cam 18*b*. Each shoulder 138 forms a guide or track along which a cam follower (see FIG. 4A) moves. As such, the shape of the shoulder 138 governs movement of a corresponding piston within a combustion cylinder, such as combustion cylinder 60 described above. The shoulder shape, as represented by the profiles of FIGS. 5*a*, 5*b* is therefore an important part of the operation of some embodiments of engine 10.

It will be appreciated that cam shoulders 138*a*, 138*b* are illustrated in FIGS. 5*b* and 5*c* as they would oppose one another on driveshaft 12 when radially indexed to substantially mirror one another. As such, peaks 140 oppose one another and troughs 141 oppose one another so that the opposing features have approximately the same radial position on driveshaft 12 relative to the driveshaft index 146 (see FIG. 5). Generally, each cam 18 has at least one lobe 151 formed of a peak 140 bounded by a trough 141. In the illustrated embodiment, each cam 18 is shown with a first lobe and a second lobe. Each peak 140 has a maximum peak amplitude PA. Each lobe 151 has an overall wavelength distance W, defined as the distance between successive troughs 141 across a peak 140. Each trough has a maximum trough depth TD. Moving clockwise along the circumference of a cam shoulder 138 (or left to right as shown in FIGS. 5*b* and fc), each lobe 151 has an ascending side or shoulder portion 153 and a descending side or shoulder portion 155.

Additionally, to ensure that the opposing pistons driven by cams 18*a*, 18*b* are continuously moving, no portion of the curvilinear shaped shoulder of cam 18*a* is parallel with any portion of curvilinear shaped shoulder of cam 18*b*. As such, opposing curvilinear shaped shoulders 138*a*, 138*b*, whether of a sinusoidal shape or a segmented polynomial shape, are constantly diverging or converging from one another. In other words, no portion of shoulders 138*a*, 138*b* are parallel since this would result in a loss of momentum of movement of the opposing pistons within the combustion chamber in which they are disposed, which in turn would result in a loss of engine torque.

With specific reference to FIG. 5*b*, cam 18*a* is shown as having a sinusoidal shaped cam shoulder 138*a*. As such, first lobe 151*a*1 is located approximately equidistance between a first trough 141*a*1 and a second trough 141*a*2. In particular, the maximum peak amplitude PAa1 occurs at approximately ½ the overall wavelength distance W for lobe 151*a*1. As such, first lobe 151*a*1 is symmetrical in shape, illustrated by wavelength distance Was of an ascending shoulder portion 153*a*1 from the first trough 141*a*1 to the peak or apex 143*a*1 of lobe 151*a*1 being equal to the wavelength distance Wds of descending shoulder portion 155*a*1 from the peak or apex 143*a*1 of lobe 151*a*1 to second trough 141*a*2. First trough 141*a*1 has a trough depth TDa1 that is substantially the same as trough depth TDa1 of second trough 141*a*2. Similarly, second lobe 151*a*2 is of substantially the same shape as first lobe 151*a*1. In this regard, lobe 151*a*1 has an ascending shoulder portion 153*a*1 that is of substantially the same shape as descending shoulder portion 155*a*1. As such, the absolute value of the average slope Sa1 of ascending shoulder portion 153*a*1 between trough 141*a*1 and peak 140*a*1 is approximately the same as the absolute value of the average slope Sa2 of descending shoulder portion 155*a*1 between peak 140*a*1 and trough 141*a*2 moving clockwise along shoulder 138*a*.

As with cam 18*a*, cam 18*b* is shown as having a symmetrical sinusoidal shaped cam shoulder 138*b*. As such, first lobe 151*b*1 is located approximately equidistance between a first trough 141*b*1 and a second trough 141*b*2. In particular, the maximum peak amplitude PAb1 occurs at approximately ½ the overall wavelength distance W for lobe 151*b*1. First trough 141*b*1 has a trough depth TDb1 that is substantially the same as trough depth TDb1 of second trough 141*b*2. Similarly, second lobe 151*b*2 is of substantially the same shape as first lobe 151*b*1. In this regard, lobe 151*b*1 has an ascending shoulder portion 153*b*1 that is of substantially the same shape as descending shoulder portion 155*b*1. As such, the absolute value of the average slope Sb1 of ascending shoulder portion 153*b*1 between trough 141*b*1 and peak 140*b*1 is approximately the same as the absolute value of the average slope Sb2 of descending shoulder portion 155*b*1 between peak 140*b*1 and trough 141*b*2 moving clockwise along shoulder 138*b*.

In any event, cams 18*a*, 18*b* are angularly mounted on driveshaft 12 (see FIG. 5*a*) to mirror one another so that the lobes 151 of the respective cams opposed one another with corresponding peaks 140 in general alignment and the number of lobes 151*a* of cam 18*a* corresponds with the number of lobes 151*b* of cam 18*b*. In this regard, the opposing features may be angularly aligned with one another so that opposing peaks 140 and opposing troughs 141 generally occur at the same angular position about driveshaft 12 relative to index 146.

Although in some embodiments, the opposing shoulders 138*a*, 138*b* of spaced apart cams 18*a*, 18*b* are generally disposed to have substantially the same sinusoidal shape, adjustments to portions of the shape of a particular shoulder, including the width of circumferential surface 145 and/or the shape of inwardly facing track 142 of a shoulder 138 may be utilized to adjust relative movements of opposing first and second piston assemblies 22*a*, 22*b*, respectively, for a desired purpose. Thus, in some embodiments, the trough 141*a*1 of one cam 18*a* may be shaped to include a flat portion 147 that lies in a plane perpendicular to axis 14 and the axis of cam hub 136 or otherwise be deeper than the corresponding opposing trough 141*b*1 of cam 18*b*, which is illustrated as generally curved through the entire trough 141*b*1. In other words, the trough depth TDb1 of trough 141*b*1 is greater than opposing trough depth TDa1 of corresponding trough 141*a*1. Similarly, peak 140*a*1 of cam 18*a* may have a rounded shape at its apex 143, while the shape of opposing peak 140*b*1 of cam 18*b* may have a flat portion 149 that lies in a plane perpendicular to axis 14 and the axis of cam hub 136 at its corresponding apex 143. In the illustrated embodiments, because each flat portion 147, 149 of the corresponding cams 18*a*, 18*b* lies in a plane perpendicular to axis 14 and the axis of cam hub 136, it will be appreciated that flat portions 147, 149 are in parallel planes.

With specific reference to FIG. 5*c*, cam 18*a* is shown as having a segmented polynomial shaped cam shoulder 138*a*. As such, first lobe 151*a*1 is asymmetrical in shape, with the maximum peak amplitude PAa1 occurring closer to second trough 141*a*2 as opposed to first trough 141*a*1, illustrated by wavelength distance Was from the first trough 141*a*1 to the apex 143 of lobe 151*a*1 as being greater than the wavelength distance Wds from the apex 143*a*1 of lobe 151*a*1 to second trough 141*a*2. In other words, wavelength distance Was from the first trough 141*a*1 to peak 143*a*1 of an ascending shoulder portion 153*a*1 of lobe 151*a*1 is greater than the wavelength distance Wds from the peak 143*a*1 to the second trough 141*a*2 of a descending shoulder portion 155*a*1 of the lobe 151*a*1. In these embodiments, first trough 141*a*1 has a trough depth TDa1 that is substantially the same as trough depth TDa2 of second trough 141*a*2, which is substantially the same as maximum peak amplitudes PAa1 and PAa2 of lobes 151*a*1 and 151*a*2, respectively. Similarly, second lobe 151*a*2 is of substantially the same shape as first lobe 151*a*1. However, because lobes 151*a*1 and 151*a*2 are asymmetrical, lobe 151*a*1 has an ascending shoulder portion 153*a*1 that is shallower in shape than the steeper shape of descending shoulder portion 155*a*1. As such, the absolute value of the average slope Sa1 of ascending shoulder portion 153*a*1 between trough 141*a*1 and peak 140*a*1 is less than the absolute value of the average slope Sa2 of descending shoulder portion 155*a*1 between peak 140*a*1 and trough 141*a*2 moving clockwise along shoulder 138*a*. It will be appreciated that the steeper shape (or greater slope) of descending shoulder portion 155*a*1 results in faster movement of a corresponding piston during the exhaust stroke of engine 10 as compared to the intake stroke.

Cam 18*b* is shown in FIG. 5*c* as having a segmented polynomial shaped cam shoulder 138*b*. As such, first lobe 151*b*1 is asymmetrical in shape, with the maximum peak amplitude PAb1 occurring closer to second trough 141*b*2 as opposed to first trough 141*b*1, illustrated by wavelength distance Was from the first trough 141*b*1 to the apex 143*b*1 of lobe 151*b*1 as being greater than the wavelength distance Wds from the apex 143*b*1 of lobe 151*b*1 to second trough 141*b*2. In these embodiments, first trough 141*b*1 has a trough depth TDb1 that is substantially the same as trough depth TDb2 of second trough 141*b*2, which is substantially the same as maximum peak amplitudes PAb1 and PAb2 of lobes 151*b*1 and 151*b*2, respectively. Similarly, second lobe 151*b*2 is of substantially the same shape as first lobe 151*b*1. However, because lobes 151*b*1 and 151*b*2 are asymmetrical, lobe 151*b*1 has an ascending shoulder portion 153*b*1 that is shallower in shape than the steeper shape of descending shoulder portion 155*b*1. As such, the absolute value of the average slope Sb1 of ascending shoulder portion 153*b*1 between trough 141*b*1 and peak 140*b*1 is less than the absolute value of the average slope Sb2 of descending shoulder portion 155*b*1 between peak 140*b*1 and trough 141*b*2 moving clockwise along shoulder 138*b*.

In any event, cams 18*a*, 18*b* are angularly mounted on driveshaft 12 relative to index 146 (see FIG. 5*a*) to mirror one another so that the lobes 151 of the respective cams opposed one another with corresponding peaks 140 in general alignment and the number of lobes 151*a* of cam 18*a* corresponds with the number of lobes 151*b* of cam 18*b*. In this regard, the opposing features may be angularly aligned with one another so that opposing peaks 140 and opposing troughs 141 generally occur at the same angular position about driveshaft 12 relative to index 146.

In one or more embodiments, each descending shoulder portion 155 of a segmented polynomial shaped cam shoulder 138 further includes a substantially linear portion 157 extending from each lobe apex 143 toward the second trough 141. While portion 157 may be linear or flat, it will be appreciated that it is not perpendicular to axis 14 or the axis of cam hub 136 (and thus, a piston continues to move as its associated cam follower moves across linear portion 157 during operation of engine 10.) In other words, linear portion 157 has a slope greater than zero. In preferred embodiments, linear portion 157 has a slope of greater than zero and less than approximately 20 degrees. Thus, descending shoulder portion 155*a*1 of lobe 151*a*1 of cam 18*a* includes a linear portion 157*a*1 extending from apex 143*a*1. Similarly, opposing cam 18*b* has a descending shoulder portion 155*b*1 of lobe 151*b*1 with a linear portion 157*b*1 extending from apex 143*b*1. The other lobes 151*a*2, 151*b*2 likewise include linear portions 157 as described. In one or more embodiments, opposing linear portions 157 have the same slope. In one or more embodiments, at least one, or both ascending shoulder portion 153 of a segmented polynomial shaped cam shoulder 138 may likewise include a substantially linear portion (not shown) similar to linear portion 157, extending from each lobe trough 141 extending towards an apex 143. Again, while such portion may be linear or flat, it will be appreciated that it is not perpendicular to axis 14 or the axis of cam hub 136, and thus, a piston continues to move as its associated cam follower moves across such linear portion and the slope of such portion would be greater than zero.

The shoulders 138*a*, 138*b* of spaced apart cams 18*a*, 18*b* illustrated in FIG. 5*c* are generally disposed to have substantially the same segmented polynomial shape at least along the opposing descending shoulder portions 155*a*1, 155*a*1. However, because the shape of the segmented polynomial shoulder governs opening and closing of the intake and exhaust ports, and in particular, how fast a piston moves within its combustion cylinder to open or close a port, then the opposing ascending shoulder portion 153 of cams 18*a*, 18*b* may differ. As such, the in one or more embodiments, the discreet slope Sa1 at any given point along the ascending shoulder portion 153*a*1 of cam 18*a* may differ from the discreet slope Sb1 at any given point along the ascending shoulder portion 153*b*1 of cam 18*b*. For example, the initial shape of ascending shoulder portion 153*b*1 adjacent trough 141*b*1 may be steeper than the initial shape of ascending shoulder portion 153*a*1 adjacent trough 141*a*1, resulting in faster movement of the exhaust piston back towards IDC and thus faster closing of the exhaust port as compared to the intake port associated with the intake piston movement governed by ascending shoulder portion 153*a*1. Regardless, it will be appreciated that for the overall segmented polynomial shape of opposing shoulders 138*a*, 138*b*, the trough depth TDa1 of trough 141*a*1 is substantially the same as the opposing trough depth TDb1 of corresponding trough 141*b*1. Similarly, peak 140*a*1 of cam 18*a* has substantially the same peak amplitude PAa1 as the peak amplitude PAb1 of opposing peak 140*b*1.

The length L of linear portion 157 may be selected to correspond with a particular type of fuel. It will be appreciated that while opposing shoulders 138*a*, 138*b* are constantly diverging or converging without any parallel portions of their respective segmented polynomial shapes, the opposing linear portions 157 of a shallow slope result in slower movement apart of opposing cams in a combustion cylinder, thereby permitting a substantially constant combustion chamber volume for a period of time without having the pistons stop in the combustion cylinder. In one or more embodiments, opposing linear portions 157 have the same length L. However, it will be appreciated that in this embodiment, while the peak 140*a* of each lobe 151*a* of cam 18*a* is substantially aligned with the corresponding peak 140*b* of each lobe 151*b* of cam 18*b*, no portion of segmented polynomial shaped shoulder 138*a* is parallel with any portion of segmented polynomial shaped shoulder 138*b*.

Likewise, the angular alignment of cams 18*a*, 18*b* relative to the driveshaft index reference 146, and also to one another may be adjusted to achieve a particular purpose. Cam 18*a* may be angularly rotated a desired number of degrees relative to driveshaft index reference 146 (and cam 18*b*) in order to adjust the movement of the piston 30 associated with cam 18*a* relative to the piston 30 associated with cam 18*b*. In some embodiments, one cam 18, such as cam 18*b*, may be rotated approximately 0.5 to 11 degrees relative to the other cam 18, such as cam 18*a*.

In any event, in one or more embodiments, cam shoulders 138*a*, 138*b* are shaped and positioned on driveshaft so that the engine 10 has the following configurations of an intake piston and opposing exhaust piston, an intake port and an exhaust port at different stages of the combustion and expansion strokes relative to the point of engagement of a cam follower with a cam shoulder:

(1) at the apex 143 of cam shoulder 138, opposing intake and exhaust pistons are at inner dead center (IDC) within a combustion cylinder and both exhaust port and intake port are closed;

(2) along the linear portion 157 of a descending shoulder portion 155, the intake and exhaust ports remained closed and intake and exhaust pistons retract slowly away from one another (and from IDC) in the combustion cylinder, the shallowly sloped linear portions 157 allowing an almost constant volume within the combustion cylinder to be maintained during combustion but without stopping movement of the pistons;

(3) further along descending shoulder portion 155, due to the steep slope, opposed intake and exhaust pistons retract more quickly from one another, the retraction of the exhaust piston opening an exhaust port to allow scavenging of exhaust gases while intake port remains closed (because the inner edge 67 of the exhaust port 36 is closer to IDC than the inner edge 63 of intake port 38) (see FIG. 3);

(4) further along descending shoulder portion 155, approaching the bottom of the second trough 141, as opposed intake and exhaust pistons continue to retract from one another, the intake port is opened by virtue of movement of the intake piston;

(5) at the base of the second trough, the intake and exhaust piston reach outer dead center (ODC) within the combustion cylinder, with both intake and exhaust ports open;

(6) in one or more embodiments, the exhaust piston initially moves from ODC to IDC more quickly than the intake piston because the ascending shoulder portion 153$b_1$ of the cam shoulder 138*b* driving the exhaust piston is steeper adjacent the trough 141$b_1$ than the corresponding ascending shoulder portion 153$a_1$ of the cam shoulder 138*a* adjacent the trough 141$a_1$ associated with the intake piston, the result being that the exhaust port adjacent the exhaust piston closes earlier than the intake port adjacent the intake piston (which closes more slowly since the ascending portion 153$a_1$ adjacent trough 141$a_1$ that drives the intake piston is shallower);

(7) as the respective cam followers continue to move along the respective ascending portions 153 of the cam shoulders 138, the intake piston (which was lagging behind the exhaust piston in their respective movement towards each other and IDC) catches up with the exhaust piston so that the pistons reach the apex 143 of their respective cam shoulders 138 at the same time, the intake piston, having remained at least partially open while the exhaust piston was fully closed, also is closed by the intake piston.

Figure 6:
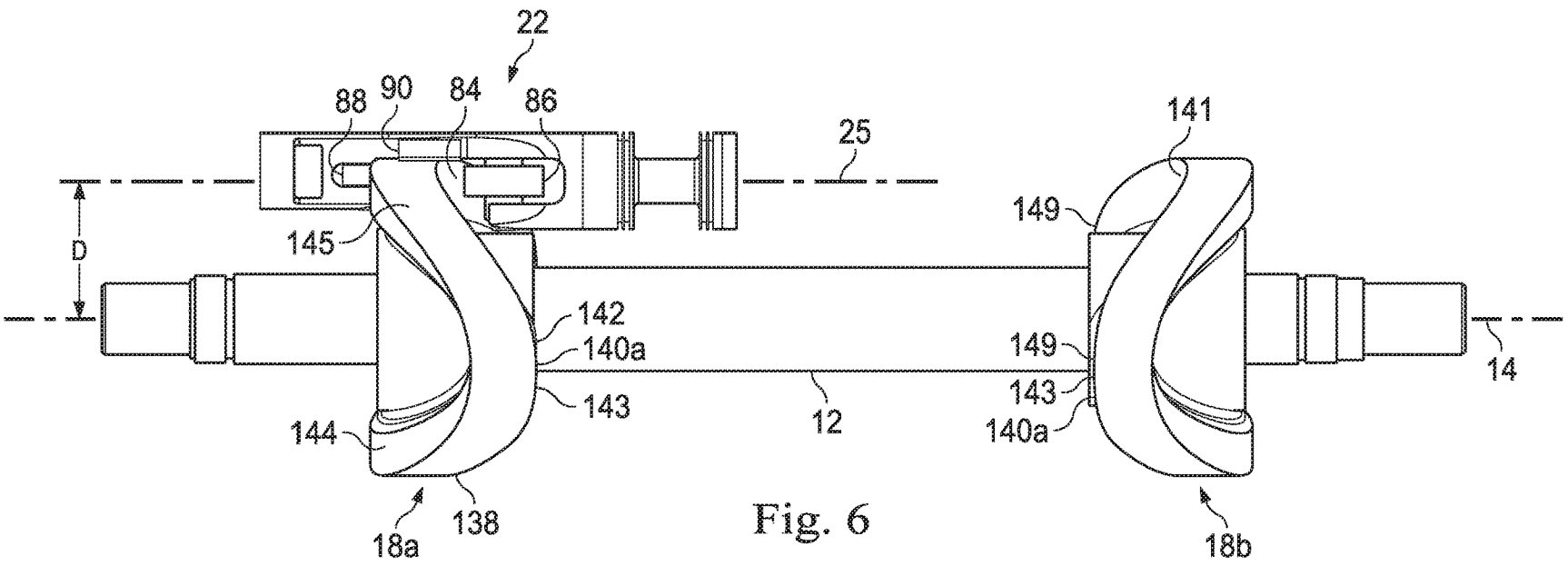
FIG. 6 is an elevation view of a piston assembly engaging a harmonic barrel cam.

FIG. 6 illustrates a piston assembly 22 engaged with cam 18*a*. Specifically, body 72 of cam follower assembly 26 engages cam 18*a* so that the shoulder 138 of cam 18*a* extends into opening 84 of cam follower assembly 26, allowing first roller 86 to engage inwardly facing track 142 of cam 18*a* and second roller 88 to engage outwardly facing track 144 of cam 18*a*. Adjustable spacer 90 bears against outer surface 145 of shoulder 138. Spacer 90 can be radially adjusted to correspondingly adjust the position and alignment of rollers 86, 88 on tracks 142, 144, respectively. Piston assembly 22 is constrained to reciprocate along axis 71 which is spaced apart from driveshaft axis 14 a distance D. Axial movement of piston assembly 22 along axis 71 is translated into rotational movement of driveshaft 12 about axis 14 by virtue of cams 18*a* and 18*b*. In the illustrated embodiment, it will be appreciated that the shape of shoulder 138 is generally sinusoidal and peak 140*a* of cam 18*a* has a rounded shape at its apex 143, while the corresponding surface of peak 140*a* of cam 18*b* has a linear or flat portion 149 (as described above) at its apex 143. In other embodiments, the shoulder 138 may have a segmented polynomial shape, in which case, opposing peaks 140 would be rounded at apex 143 of both cams 18 and opposing troughs 141 would likewise be similarly rounded at their bottom.

Figure 7A:
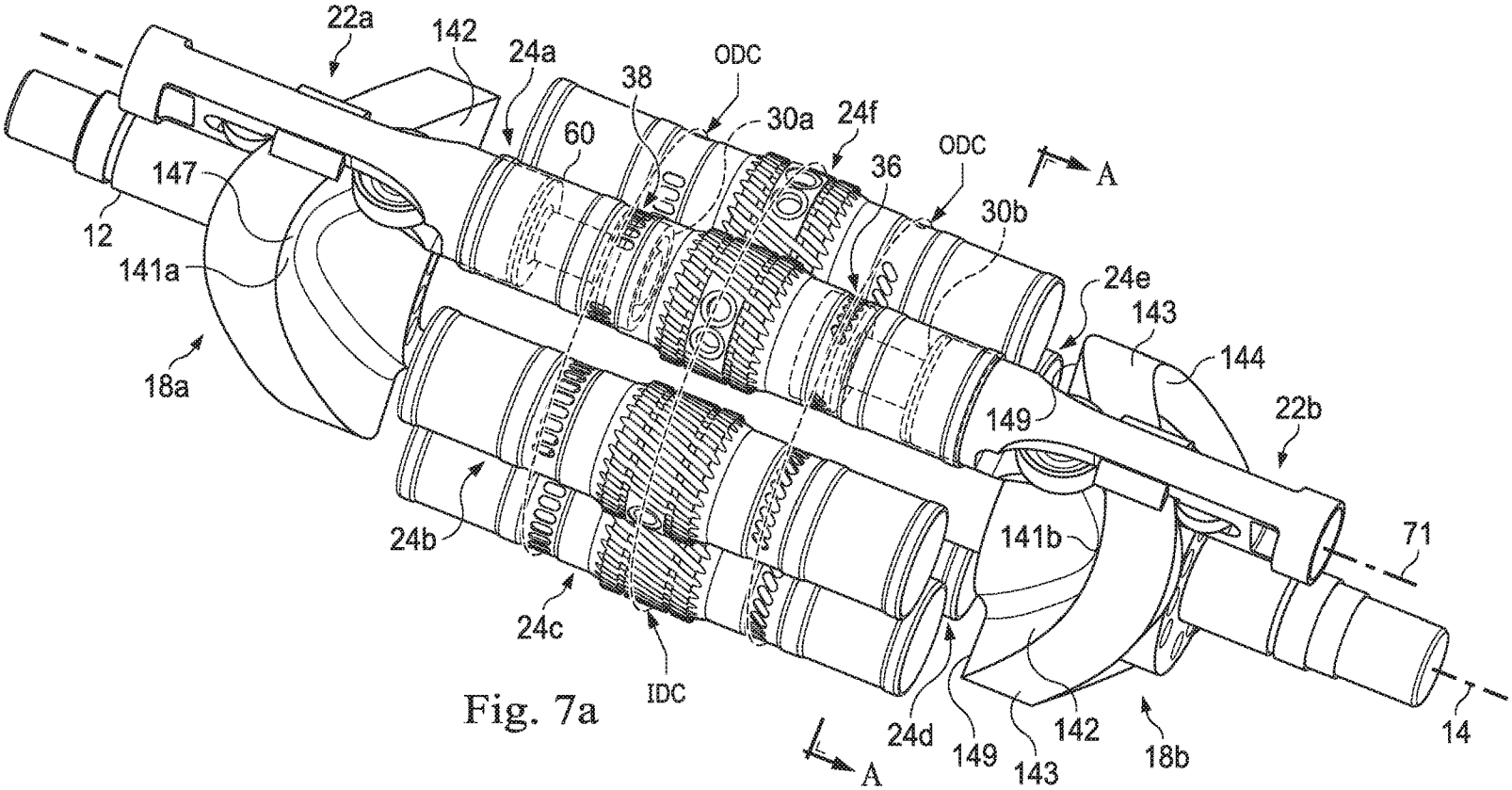
FIG. 7*a* is a perspective view of six-cylinder assemblies deployed about a driveshaft.
Figure 7B:
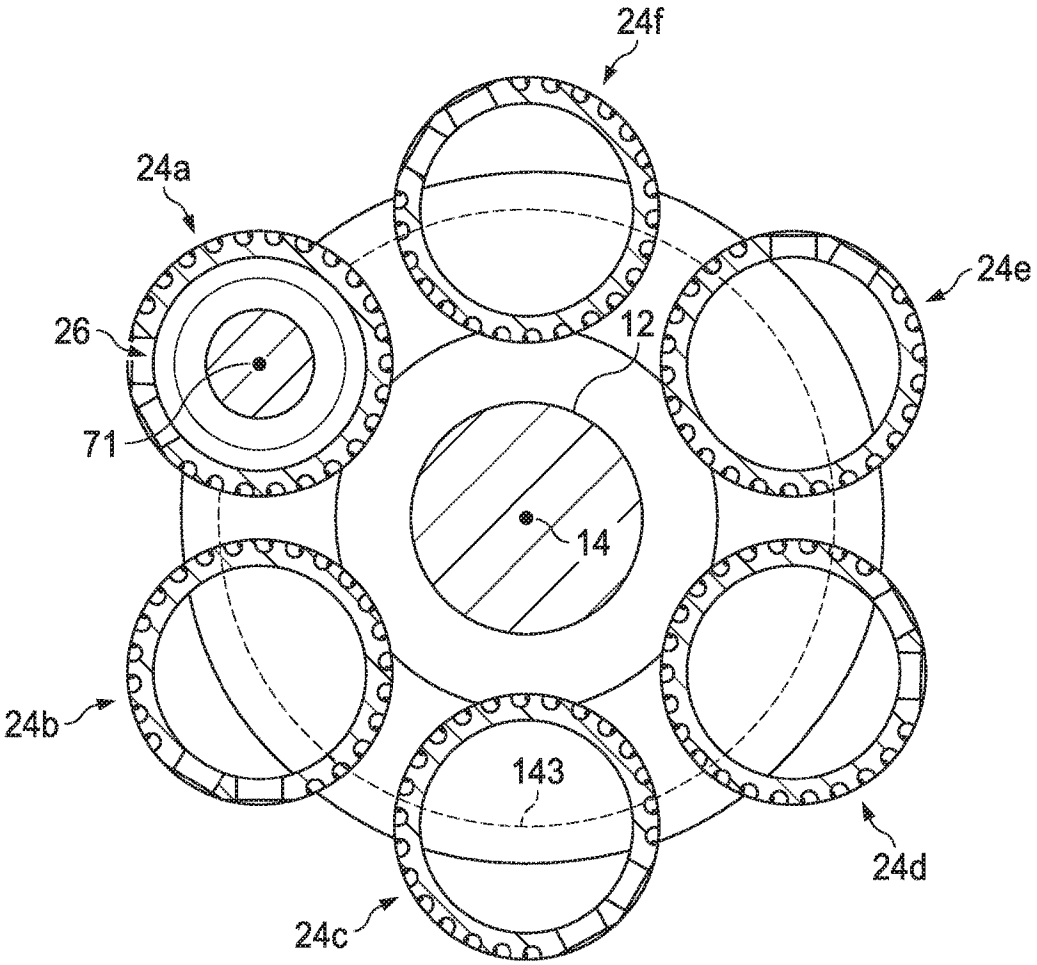
FIG. 7*b* is a cut away axial view of six-cylinder assemblies deployed about a driveshaft.

FIGS. 7*a* and 7*b* illustrate cylinder assemblies 24 symmetrically positioned around driveshaft 12. While cylinder assemblies 24 are generally supported by engine block 53 (see FIG. 1), for ease of depiction, the engine block 53 is not shown in FIGS. 7*a* and 7*b*. In one embodiment, six cylinder assemblies 24*a*, 24*b*, 24*c*, 24*d*, 24*e* and 24*f* are utilized, although fewer or more cylinder assemblies 24 could be incorporated as desired. In any event, the cylinder assemblies 24*a*-24*f* are positioned around driveshaft 12 between cams 18*a*, 18*b*. It will be understood that while a piston pair 20 is only illustrated as being engaged with cylinder assembly 24*a* for ease of description, each cylinder assembly 24 includes a piston pair 20. In any event, a first piston assembly 22*a* and a second piston assembly 22*b* which piston assemblies 22*a*, 22*b* are axially aligned with one another within a cylinder assembly 24*a*. Cams 18*a*, 18*b* are mounted on driveshaft 12 so that the cams 18*a*, 18*b* are aligned to generally mirror one another. Each piston assembly 22 within combustion cylinder 60 moves between ODC (where each piston is adjacent a respective port outer edge 61, 65 as shown in FIG. 3) to a position adjacent IDC where combustion occurs. Combustion within cylinder 60 of cylinder assembly 24*a* drives first piston assembly 22*a* and second piston assembly 22*b* away from one another along the axis 71 of cylinder assembly 24*a* towards ODC. Cylinder 60 constrains each piston assembly 22*a*, 22*b* to axial reciprocation along axis 71. This axial movement of piston assemblies 22*a*, 22*b* along axis 71 is translated by cams 18*a* and 18*b* into rotational movement of driveshaft 12 about axis 14 as the rollers 86, 88 of respective cam follower assemblies 22*a*, 22*b* moves along the tracks 142, 144 of their respective cams 18*a*, 18*b*.

While cams 18*a*, 18*b* generally mirror one another, as explained above, in some embodiments where shoulder 143 has a sinusoidal shape, the trough 141*a* of cam 18*a* may be shaped to include a flat portion 147 (a portion that lies in a plane perpendicular to axis 14) relative to corresponding opposing trough 141*b* of cam 18*b*, which is illustrated as generally curved through the entire trough 141*b*, causing piston 30*a* to have a different momentary displacement in cylinder 60 relative to piston 30*b*. In particular, as shown, as cam follower 22*a* reaches flat portion 147 of track 142 of cam 18*a*, piston 30*a* will remain retracted at outer dead center ("ODC") momentarily even as piston 30*b* continues to translate as its cam follower 22*b* moves along track 142 of cam 18*b*. In the illustrated embodiment, it will be appreciated that this allows intake ports 38 to remain open while exhaust ports 36 are closed by the proximity of piston 30*b* to exhaust ports 36. A similar phenomenon occurs when cam followers 22*a*, 22*b* reach an apex 143 of their respective cams 18*a*, 18*b*. As described, the apex 143*b* of cam 18*b* includes a flat portion 149 (a portion that lies in a plane perpendicular to axis 14) relative to corresponding opposing apex 143*a* of cam 18*a*, which is illustrated as generally curved through the entire apex 143*a*, causing piston 30*b* to have a different displacement in cylinder 60 relative to piston 30*a*. In particular, as cam follower 22*b* reaches flat portion 149 of track 142 of cam 18*b*, piston 30*b* will remain fully extended at inner dead center ("IDC") momentarily even as piston 30*a* continues to translate as its cam follower 22*a* moves along track 142 of cam 18*a*. It will be appreciated in other embodiments, it may be desirable to ensure that each piston 30 is continuously moving within combustion cylinder 60, in which case, the shape of shoulder 143 does not include a portion that lies in a plane perpendicular to axis 14. Thus, by utilizing the shape of shoulders 138 of opposing cams 18*a*, 18*b*, the relative translation of pistons 30*a*, 30*b* can be adjusted to achieve a desired goal, such as controlling the timing of opening or closing of ports 36, 38. In other words, the cams 18*a*, 18*b* control the timing for opening and closing of the ports 36, 38 utilizing the curvilinear shape of shoulder 138 to provide desired timing for each opening and closing operation as the pistons translate across their respective ports.

In addition or alternatively to using the shape of shoulders 138 to adjust relative axial movement of pistons 30*a*, 30*b*, it will be appreciated that cam 18*a* can be radially displaced on driveshaft 12 relative to cam 18*b*, thereby achieving the same objective described above. Cams 18 may be located on driveshaft 12 with a small angular displacement with respect to each other in order to cause one of pistons 30 to be displaced in the cylinder 60 slightly ahead or behind its opposing piston 30. This asymmetric piston phasing feature can be used to enhance scavenging operations, particularly as may be desirable when different fuel types are utilized within engine 10.

It will be appreciated particularly with reference to FIG. 7*b* that additional cylinder assemblies 24 may be symmetrically deployed about driveshaft 12 by simply increasing the diameter of cam shoulder 143. In some embodiments, where high torque is required, cam shoulder 143 may be large, with a corresponding large plurality of cylinder assemblies 24, but where each cylinder assembly has a much shorter stroke.

Figure 8:
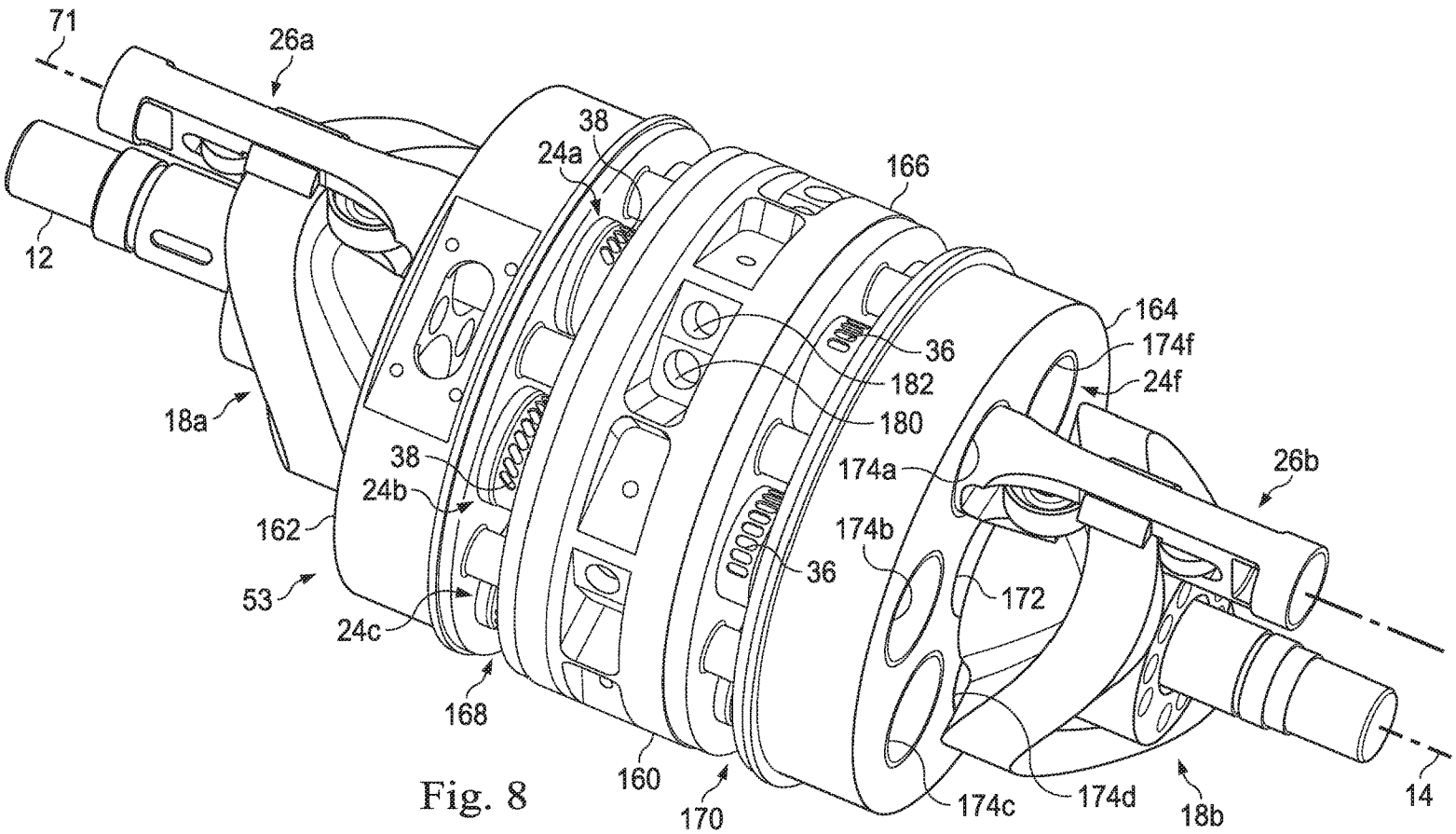
FIG. 8 is a perspective view of an engine block for a six-cylinder engine of FIG. 7*a;*

FIG. 8 illustrates the cylinder assemblies 24*a*-24*f* and driveshaft 12 of FIG. 7*a* in relation to engine block 53. Thus, as shown, engine block 53 is positioned about driveshaft 12 between cam 18*a* and cam 18*b*. Engine block 53 is generally extends between a first end 162 and a second end 164 and includes an annular body portion 160 therebetween, which annular body portion 160 is characterized by an exterior surface 166. Formed in body 160 is a first annular channel 168 and a second annular channel 170 spaced apart from one another. Although annular channels 168, 170 may be formed internally of the exterior surface 166, in the illustrated embodiment annular channels 168, 170 extend from exterior surface 166 inwardly. Similarly, while the illustrated embodiment shows annular channels 168, 170 extending around the entire circumference of cylindrical body 160, in other embodiments, one or both annular channels 168, 170 may extend only partially around the circumference of cylindrical body 160. A central driveshaft bore 172 extends between ends 162, 164. Likewise, two or more symmetrically positioned cylinder bores 174 extend between ends 162, 164 and are radially spaced outward of central driveshaft bore 172. In the illustrated embodiment, engine block 53 has six cylinder bores 174 symmetrically spaced about driveshaft bore 172, of which cylinder bores 174*a*, 174*b* 174*c* and 174*f* are visible. Disposed in each cylinder bore 174 is a cylinder assembly 24, and thus, illustrated are cylinder assemblies 24*a*, 24*b*, 24*c* and 24*f*. As such, block 53 supports the cylinder assemblies 24. Each cylinder assembly 24 is positioned in block 53 so that its intake ports 38 are in fluid communication with the first annular channel 168 and that its exhaust ports 36 are in fluid communication with the second annular channel 170. When so positioned, each first port 68 and each second port 70 of cylinder assembly 24 align with a first port 180 and a second port 182 provided in the exterior surface 166 of engine block 53. Opposing cam follower assemblies 26*a*, 26*b* are illustrated as engaging their respective cams 18*a*, 18*b* and extending along axis 71 into the cylinder assembly 24*a* supported in cylinder bore 174*a* of engine block 53.

One benefit of the engine of the disclosure, particularly with respect to engine block 53, but also with respect to other engine components, is that it maintains a closed circuit of forces/reaction throughout an engine stroke, keeping all the stress, compression, pressures, moments and forces contained within the circuit, from the cylinder combustion chamber, to pistons, to rollers, cams and finally driveshaft. There is no lateral or unbalanced forces acting during operation, as always occur on crankshaft systems with its geometry naturally unbalanced and misaligned. The closed circuit of forces refers to the sequence of forces applied during each power stroke. This eliminates the need for heavy reinforced engine blocks, housings, bearing, driveshafts and other components. The sequence commences upon combustion, followed by burnt gases expansion creating a power stroke in opposed directions, applying aligned compressive forces on the pistons, transmitted to the cam follower assemblies engaging the cams, through the cams, where the reciprocating linear motion from the pistons became rotational motion on the cams that then returns as opposed, aligned compressive forces in the driveshaft. In other words, the expansion forces passing through the pistons are always aligned, as are the compressive forces applied to the driveshaft. This also significantly reduces the presence of engine vibrations during operation. In contrast, asymmetric forces are applied on conventional driveshafts during operation, which creates a variety of deflections and reactions that must be contained by the engine block, driveshaft and bearings through the use of heavier, stronger materials. By eliminating the need for such reinforced engine components, the engine block, driveshaft and other components of the engine of the disclosure may be formed of other materials that need only be utilized to support the engine components as opposed to withstand unbalanced forces. Such materials may include plastics, ceramics, glass, composites or lighter metals.

Figure 9:
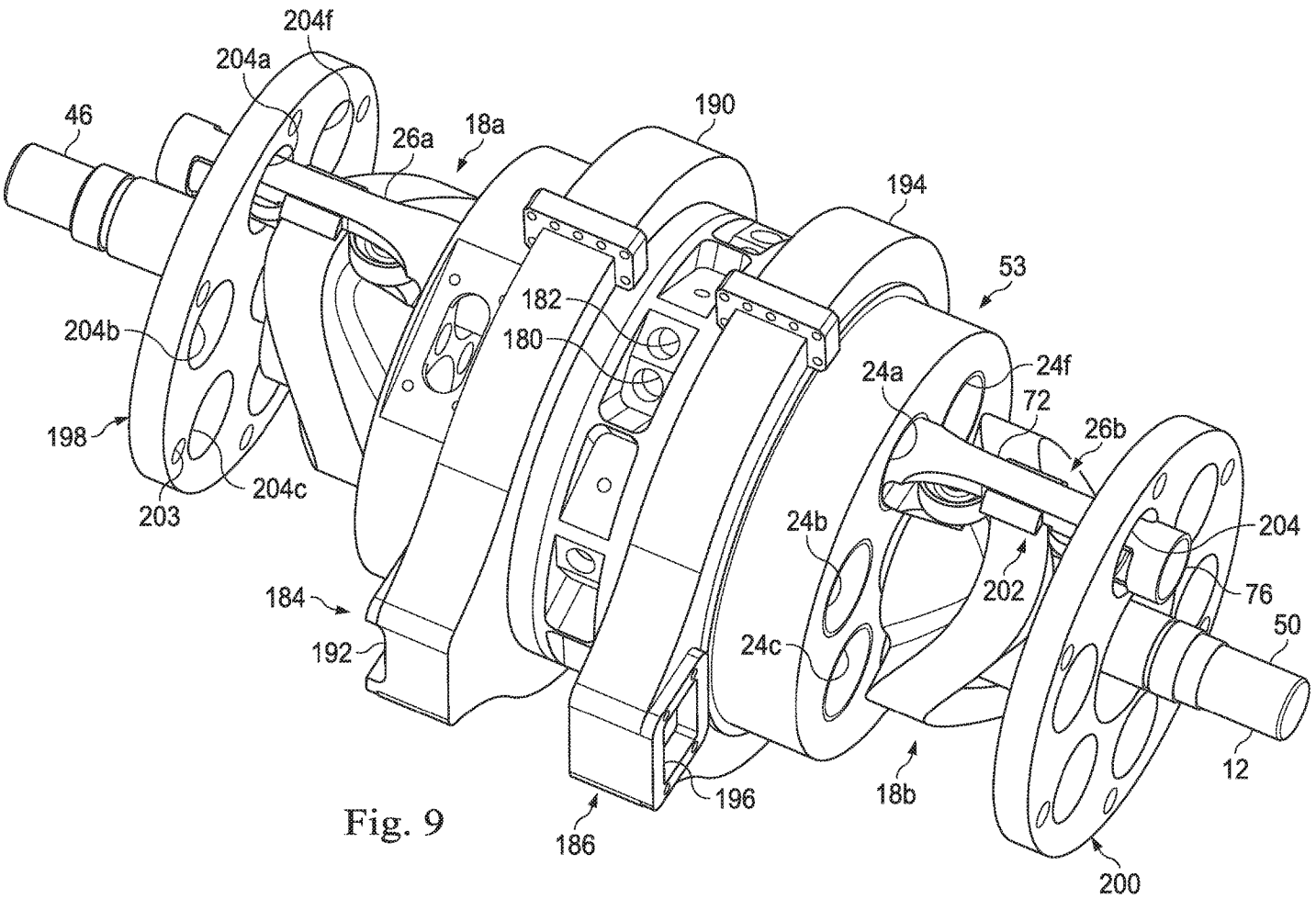
FIG. 9 is a perspective view of an engine illustrating annular air intake and exhaust manifolds.

FIG. 9 illustrates the cylinder assemblies 24*a*-24*f*, driveshaft 12, cam follower assemblies 26*a*, 26*b*, cams 18*a*, 18*b* and engine block 53 of FIG. 8, but with annular flow manifolds installed. In particular, a first annular manifold 184 is illustrated installed over and around first annular channel 168. First annular manifold 184 may be an air intake manifold for supplying air to first annular channel 168 and intake ports 38 of the cylinder assemblies 24. Also illustrated is a second annular manifold 186 installed over and around second annular channel 170. Second annular manifold 186 may be an exhaust manifold for removing exhaust from cylinder assemblies 24 via exhaust ports 36 in fluid communication with second annular channel 170.

Manifold 184 is generally formed of a toroidal shaped wall 190 in which a port 192 is formed. Likewise, manifold 186 is generally formed of a toroidal shaped wall 194 in which a port 196 is formed.

Also shown in FIG. 9 is a first guidance cap 198 deployed around driveshaft 12 between its first end 46 and cam 18*a*, and a second guidance cap 200 deployed around driveshaft 12 between its second end 50 and cam 18*b*. Each guidance cap 198, 200 generally includes a central bore 202 through which driveshaft 12 extends and two or more symmetrically positioned bores 204 radially spaced outward of central bore 202 with each bore 204 corresponding with and axially aligned with an adjacent cylinder assembly 24 supported by block 53. In the illustrated embodiment, each guidance cap 198, 200 has six bores 204, namely 204*a*, 204*b*, 204*c*, 204*d*, 204*e* and 204*f*, symmetrically spaced about central bore 202. Each bore 204 is disposed to receive a cam follower assembly 26 to provide support to the cam follower assembly 26 as it reciprocates into and out of its respective cylinder assembly 24. In particular, as shown, the bore 204 is sized to correspond with the smaller diameter cylindrical end 76 of body 72 forming cam follower assembly 26, allowing the smaller diameter cylindrical end 76 to slide within bore 204 as piston 30 reciprocates in cylinder assembly 24. In addition, one or both guidance caps 198, 200 may be utilized to inject lubricating and cooling oil into to port 98 of the cam follower assembly 26. In particular, the guidance caps may be used to transfer the oil coming from an oil pump (not shown) to bearings 87, 89 of cam follower assembly 26. Each guidance cap 198, 200 may include one or more ports 203 for connecting hole 203 that transfer the oil to port 98 of the cam follower assembly 26.

Figure 10:
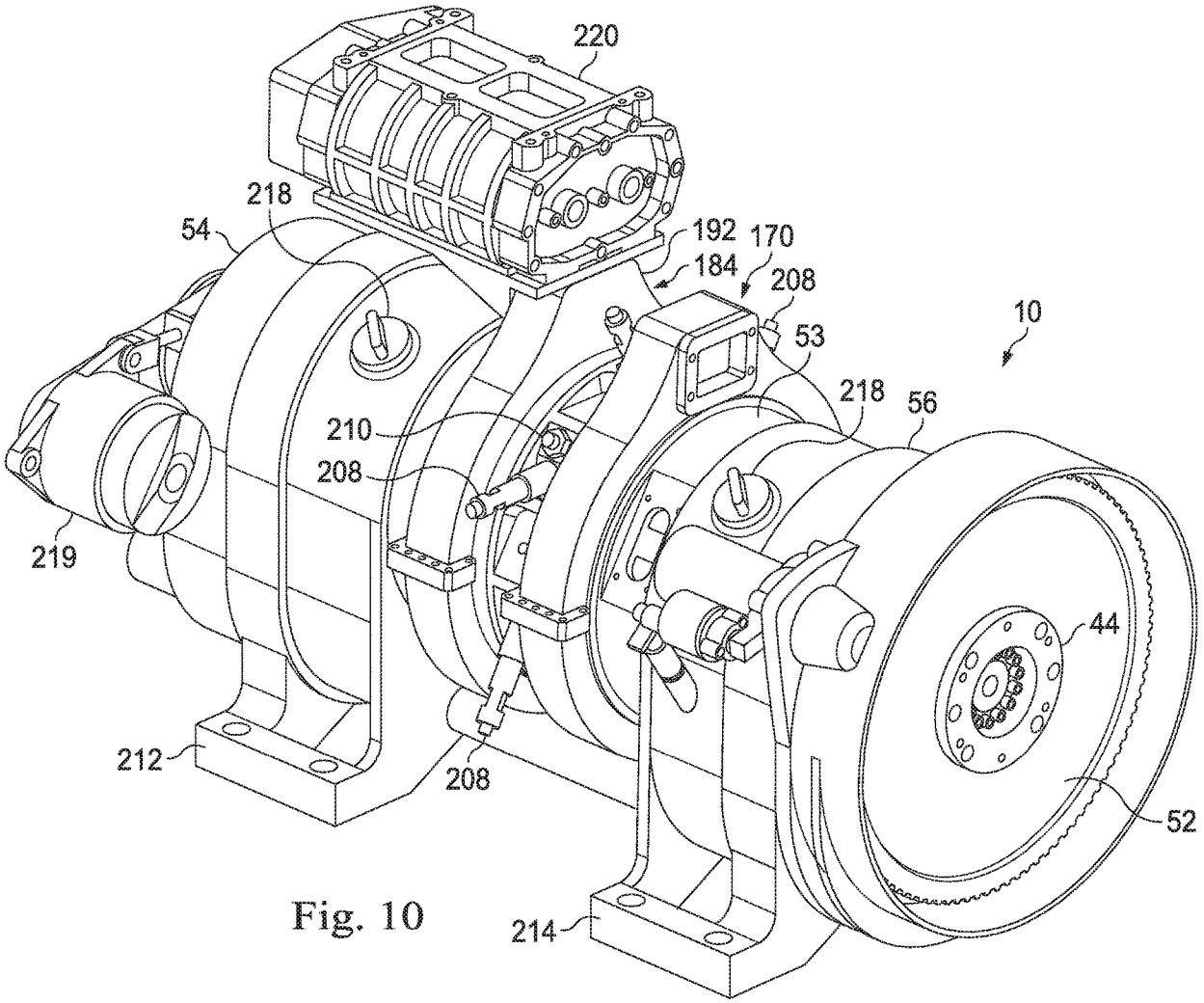
FIG. 10 is a perspective view of an assembled engine of the disclosure.

FIG. 10 is a perspective view of engine assembly 10. In the illustrated embodiment, engine block 53 is shown with annular air intake manifold 184 and annular exhaust manifold 186.

A fuel injector assembly 208 is shown mounted in one of ports 180, 182 of the engine block 53, while a sparkplug 210 is shown as mounted in the other of the ports 180, 182 of engine block 53. Engine block 53 is supported by and partially encased by a first engine block support 212 at one end of the engine assembly 10 and engine block 53 is supported by and partially encased by a second engine block support 214 at the opposite end of the engine assembly 10. In this regard, sump casing 54 cooperates with first engine block support 212 to enclose engine block 53 around the first end 46 of driveshaft 12 forming an oil lubrication and cooling chamber for providing oil to cam 18*a* and its associated cam follower assemblies 26, while sump casing 56 cooperates with second engine block support 214 to enclose engine block 53 around the second end 50 of driveshaft 12 forming an oil lubrication and cooling chamber for providing oil to cam 18*b* and its associated cam follower assemblies 26. An oil port 218 may be provided in each of engine block support 212, 214 or sump casing 54, 56.

A first flange 44 is attached to a driveshaft 12 with a flywheel 52 mounted on first flange 44.

An electric starter 219 may be provided to initiate rotation of driveshaft 12 (not shown).

In some embodiments, an air supply device 220, may be used to introduce air into first annular manifold 184 via port 192 in wall 190. Air supply device 220, while not limited to a certain type, may be a turbocharger or blower in some embodiments to maintain positive air pressure in order to provide continuous new charges of air in each engine cycle.

In other embodiments, air supply device 220 may be eliminated and pulse jet effect, also known as the Kadenacy effect, may be utilized to draw combustion air into cylinder assembly 24 (as opposed to air supply device 220 or retraction movement of a hot piston assembly 22). More specifically, if the period of opening and closing of the exhaust ports 36 is less than a 300th of a second, the speed of the exhaust gas exchange from the cylinder assembly 24 to atmosphere is extremely rapid. This rapid opening and closing of the exhaust ports 36 of a cylinder assembly 24, just before the air intake port 38 is opened, added by a specific exhaust port area to piston bore ration, will produce the pulse jet effect. This effect can be mechanically achieved by the engine of the disclosure using the phasing of cams 18 as described above, in conjunction with the timing of the exhaust port cam to speed up the hot piston when traveling through open/closing the exhaust port, and holding the cold piston in a opened air intake port just after closing exhaust port. This can be achieved by using curvilinear shaped cam shoulders to control cam phasing.

Turning to FIGS. 11*a*-11K, the operation of engine assembly 10 will be described with reference to a system of four cylinder assemblies 24, of which cylinder assembly 24*a* will be the primary focal point, with references to cylinder assemblies 24*b* and 24*d*. Generally depicted is driveshaft 12 on which is mounted cams 18*a* and 18*b*, each having a curvilinear shaped shoulder 138. In the illustrated embodiment, each of cams 18*a*, 18*b* has two lobes 151 formed by two peaks 140 and two troughs 141 and are disposed on driveshaft so as to be radially aligned, i.e., without a radial offset of one cam 18 relative to the other cam. A cam follower assembly 26*a* engaged cam 18*a* and a cam follower assembly 26*b* engages cam 12*b* so that roller 86 of the respective cam follower assemblies 26*a*, 26*b* engage the inwardly facing track 142 of the shoulder 38 of each cam 18*a*, 18*b*. Cam follower assembly 26*a* reciprocates a piston arm 28*a* and piston 30*a* within cylinder 60 of cylinder assembly 24*a*, while cam follower assembly 26*b* reciprocates a piston arm 28*b* and piston 30*b* within cylinder 60. First guidance cap 198 supports cam follower assembly 26*a* while second guidance cap 200 supports cam follower assembly 26*b*. Movement of piston 30*a* within cylinder 60 will be described relative to intake ports 38 formed in cylinder 60. Movement of piston 30*b* within cylinder 60 will be described relative to exhaust ports 36 formed in cylinder 60. The area between opposing pistons 30*a*, 30*b* within cylinder 60 forms combustion chamber 32. Inner dead center (IDC) and outer dead center (ODC) relative to the piston 30 for cylinder assembly 24*a* are indicated.

Figure 11A:
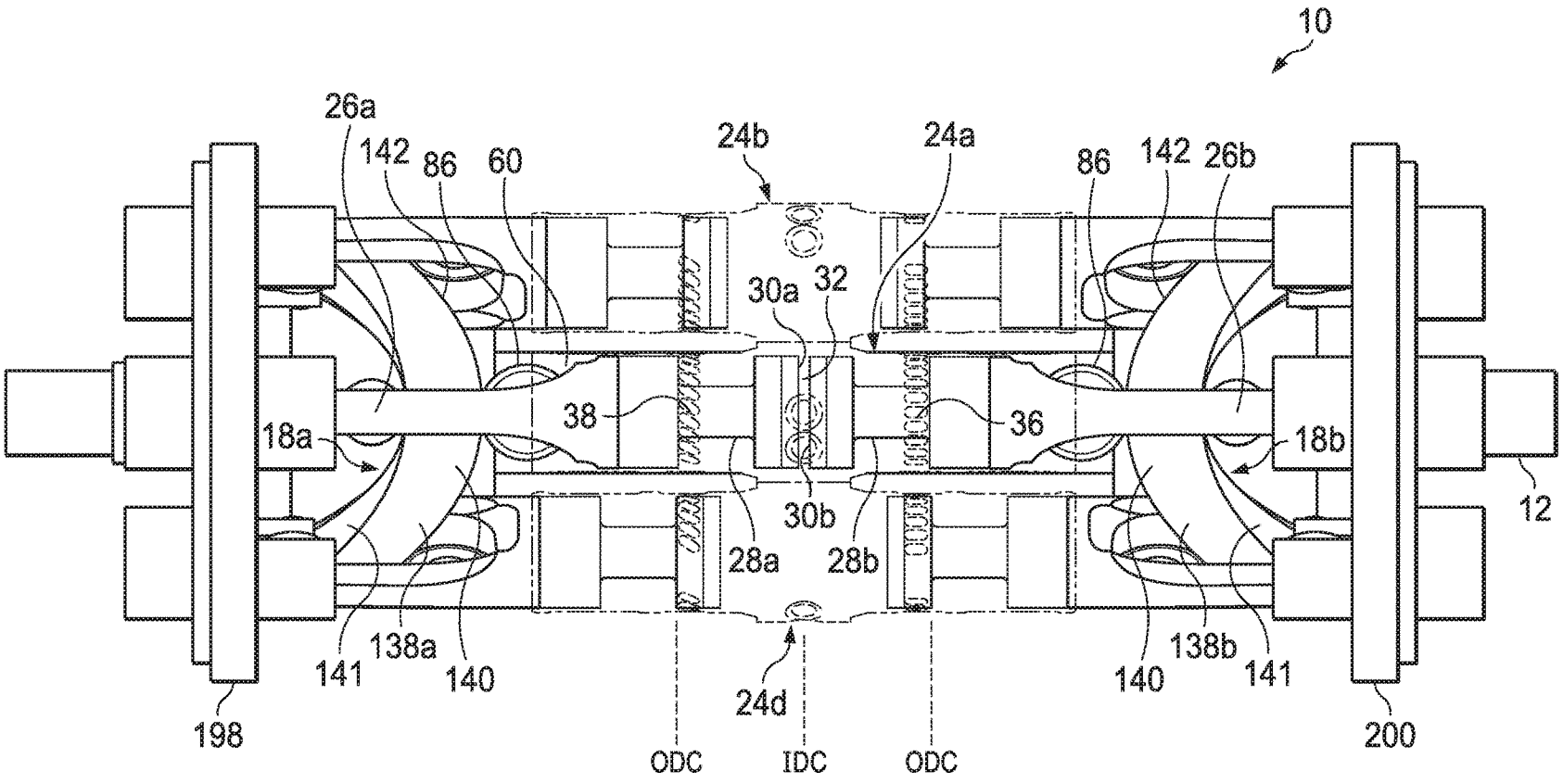
FIGS. 11*a*-11*k* illustrate the movement of pistons of a piston pair through an engine stroke.

FIG. 11*a* illustrates the pistons 30*a*, 30*b* at IDC, wherein each piston 30*a*, 30*b* is at its innermost axial position within cylinder 60. In this position, each cam follower 26*a*, 26*b* engages its respective cam 12*a*, 12*b* at a peak 140. In this position, intake ports 38 are in a "closed" configuration, whereby the piston head 30*a* is positioned between IDC of cylinder assembly 24*a* and intake ports 38, thereby blocking flow of combustion air combustion chamber 32. Likewise, exhaust port 36 is in a "closed" configuration, in that piston head 30*b* is positioned between IDC of cylinder assembly 24*a* and exhaust port 36, thereby blocking fluid communication between combustion chamber 32 and exhaust port 36. In this position, driveshaft 12 is illustrated as being at a reference angle of 0°. Intake port 38 and exhaust port 36 (as highlighted by the boxes) are closed, with the piston 30 between the ports 38, 36 and the center of the cylinder 60.

Figure 11B:
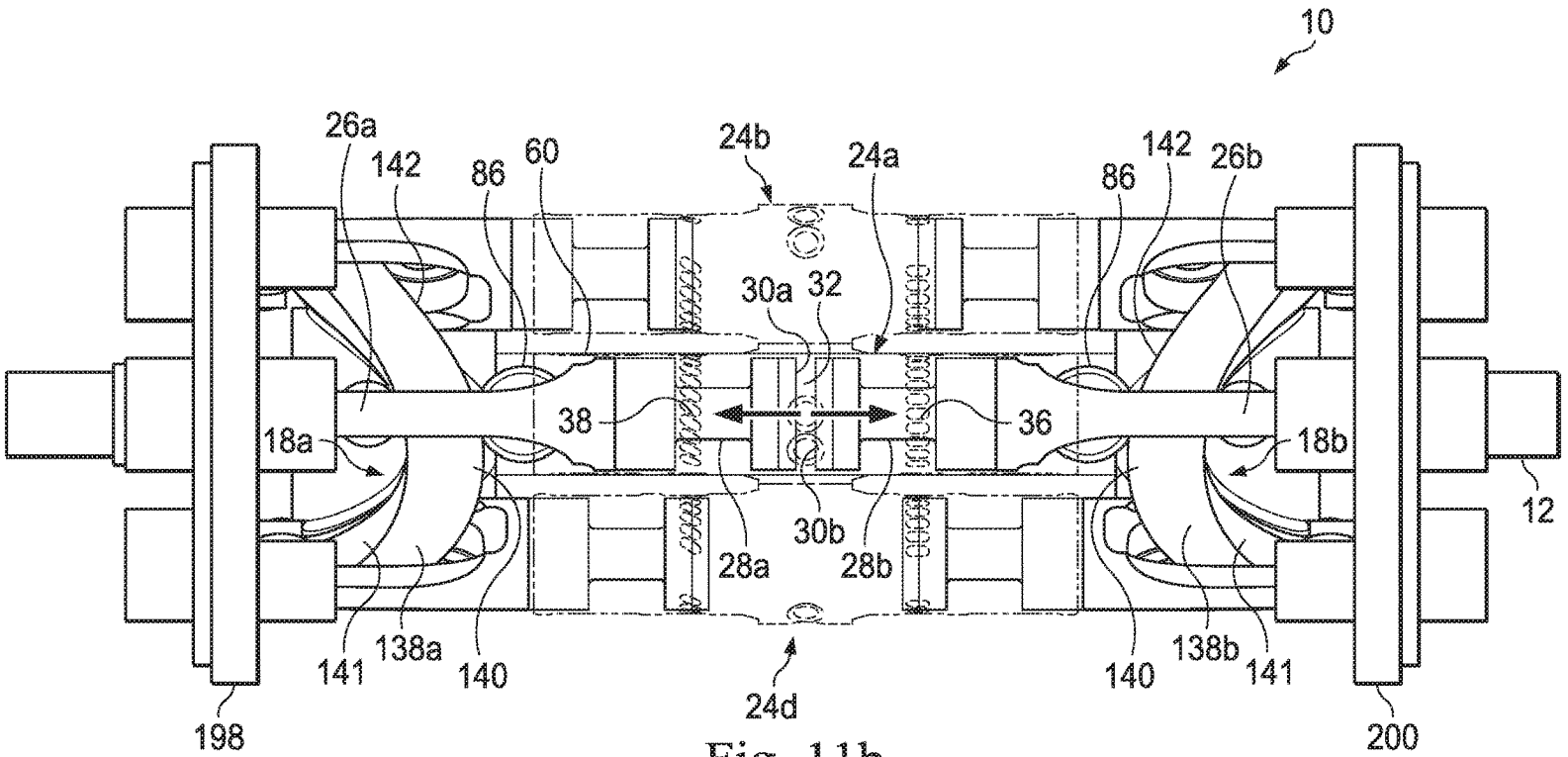

In FIG. 11*b*, combustion occurs within combustion chamber 32, initiating the expansion stroke and applying an axial force (as indicated by the arrows) to each of pistons 30*a*, 30*b*. At the point of the expansion stroke, intake port 38 and exhaust port 36 (as highlighted by the boxes) are still closed, with the piston 30 between the ports 38, 36 and the center of the cylinder 60.

Figure 11C:
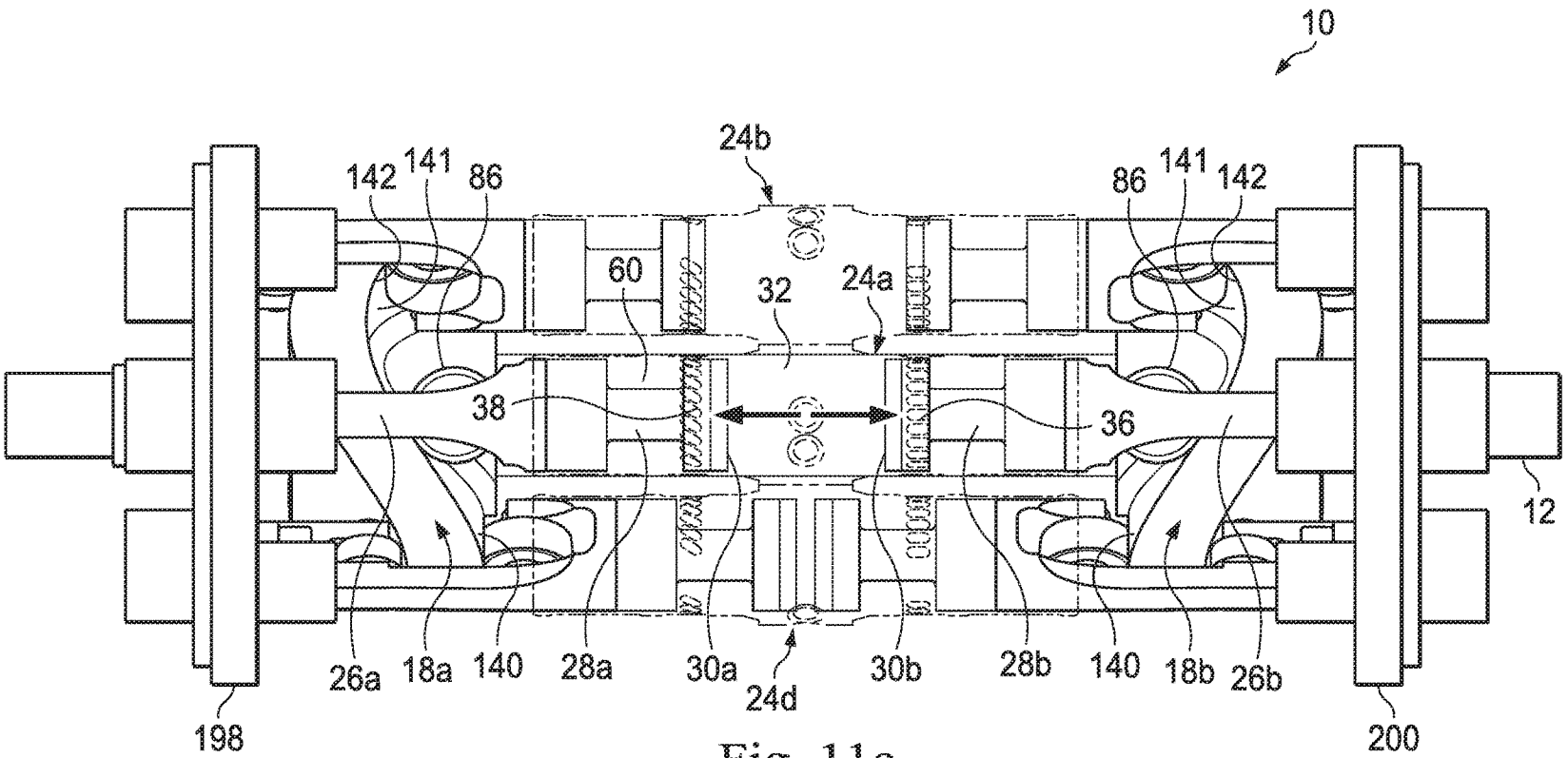
Figure 11D:
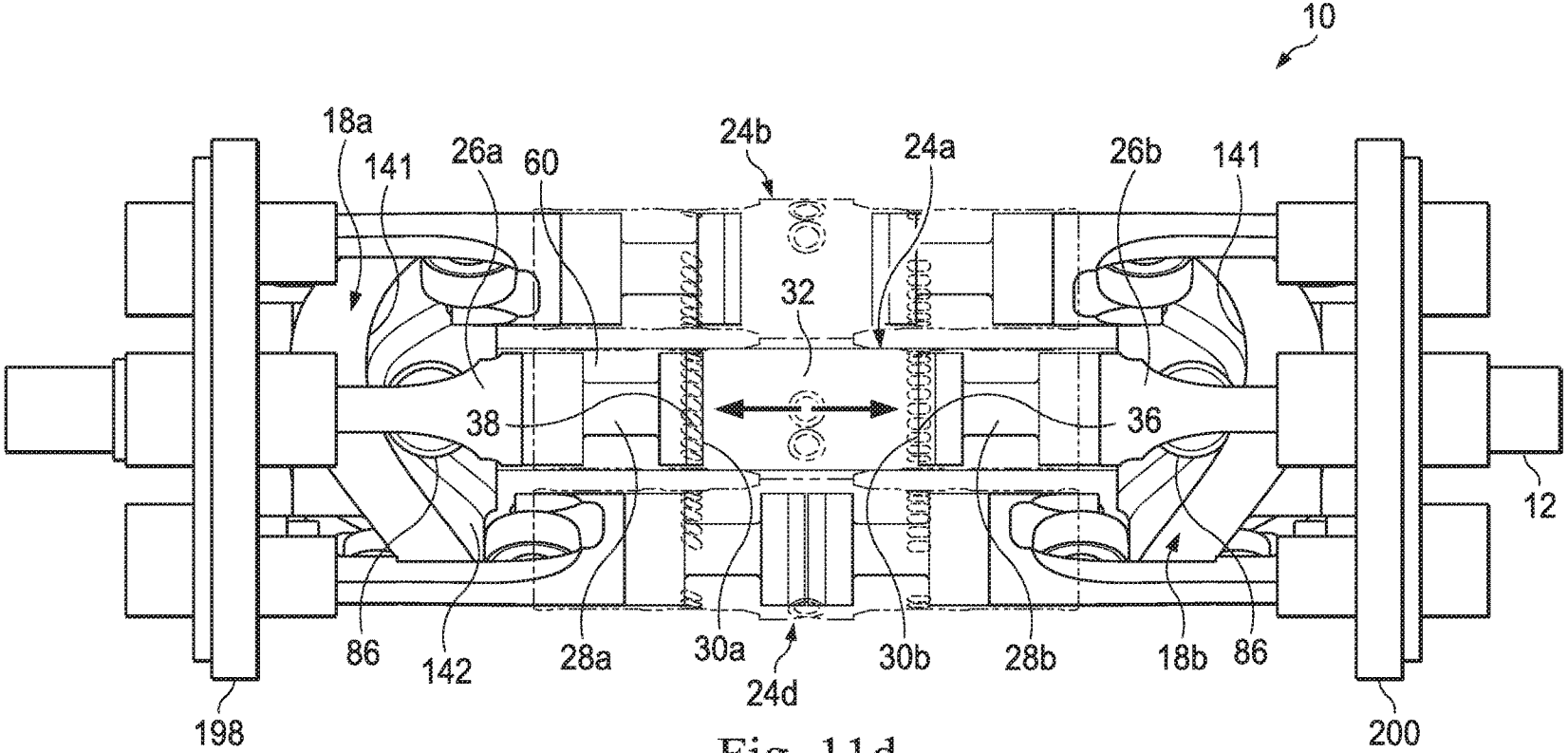

In FIG. 11*c*, with the expansion of the combustion gases within cylinder 60, pistons 30*a*, 30*b* begin to move axially away from one another (as shown by the arrows). This in turn forces each cam follower assembly 26*a*, 26*b* to begin to move along a descending portion of the shoulder track of their respective cams 18*a*, 18*b*. In doing so, the axial motion of the cam follower assembly 26 is converted to rotational motion of driveshaft 12. At this point in the expansion stroke, both ports 36, 38 remain closed by virtue of the proximity of the piston heads 30*a*, 30*b* to the respective ports. Although pistons 30*a*, 30*b* have begun to move, at the point of the expansion stroke, intake port 38 and exhaust port 36 are still closed by virtue of the proximity of piston 30*a*, 30*b* to ports 38, 36, respectively. As described above, the speed of movement of the respective pistons can be adjusted by adjusting the slope of the descending portion In FIG. 11*d*, as the expansion stroke continues, piston 30*b* has translated a sufficient distance towards cam 18*b* that exhaust port 36 begins to open, releasing exhaust air through port 36 (although port 36 is not fully open). Because exhaust port 36 has an inner port edge 67 (see FIG. 3) that is closer to IDC than the inner port edge 63 (see FIG. 3) of the intake port 38, intake port 38 remains closed by virtue of the position of the port 38 relative to piston head 30*a*. As can be seen, roller 86 of cam follower assembly 26*b* has begun to move toward a trough 141 of cam 18*b* along a descending portion of cam shoulder 138.

Figure 11E:
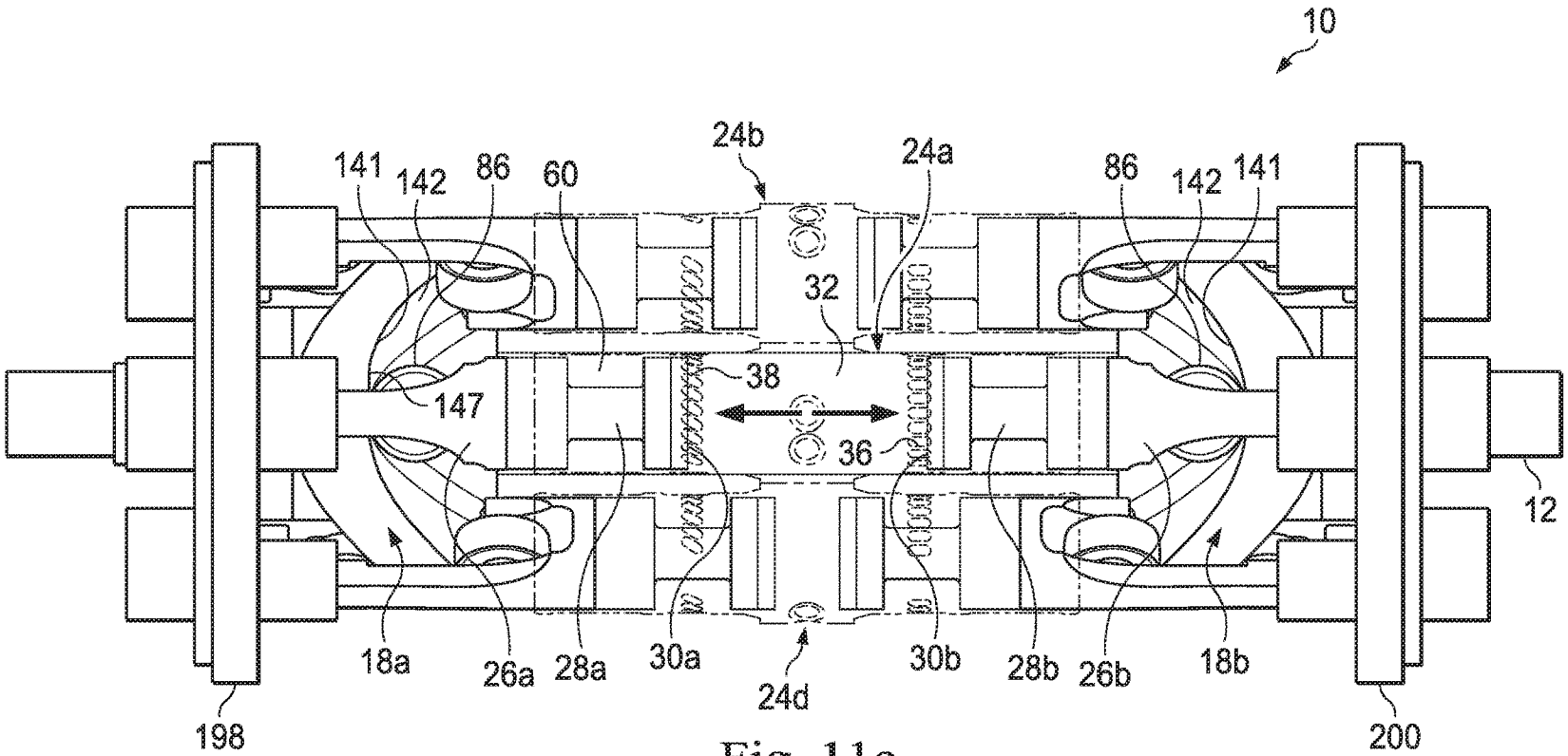

In FIG. 11*e*, piston 30*b* has translated a sufficient distance towards cam 18*b* that exhaust port 36 is fully open, releasing exhaust through exhaust port 36. In addition, piston 30*a* has translated a sufficient distance towards cam 18*a* that intake port 38 begins to open, allowing air to flow into combustion chamber 32 via port 38 (although port 38 is not fully open). In some embodiments where port 38 comprises a plurality of angled slots, the angled nature of the slots and the length of the slots themselves causes air to begin to swirl as it enters combustion chamber 32, thereby enhancing mixing of the air with fuel injected by a fuel injector (not shown). As noted above, in some embodiments, exhaust port 36 is comprised of a plurality of slots that extend only around a portion of the perimeter of cylinder 60 so as to minimize heat transfer to internal portions of engine assembly 10. For example, such slots may extend only around that portion of the perimeter that is not adjacent or facing another cylinder 60.

Figure 11F:
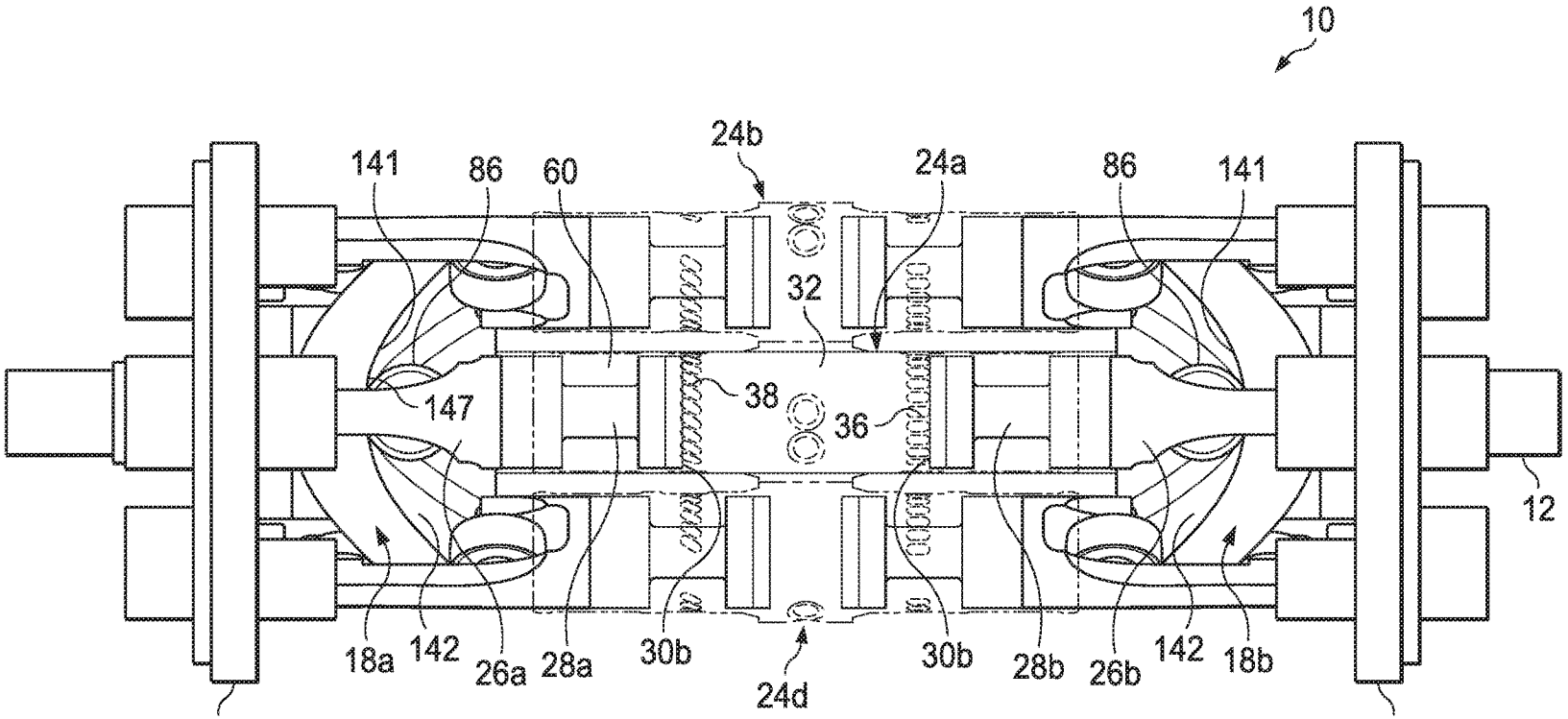

In FIG. 11*f*, each piston 30*a*, 30*b* reaches ODC adjacent the outer port edges 61, 65 of their respective ports 38, 36 by virtue of cam follower assemblies 26*a*, 26*b* reaching the bottom of the troughs 141 of their respective cams 18*a*, 18*b*. When pistons 30*a*, 30*b* are at ODC, exhaust port 36 and intake port 38 are fully open, allowing exhaust to exist combustion chamber 32 and combustion air to enter combustion chamber 32. The illustrated embodiment depicts cams 18*a*, 18*b* with substantially sinusoidal shaped shoulders 138*a*, 138*b*, and as such, as described above, it will be observed that on the intake side of the engine assembly 10, a portion 147 of trough 141 of cam 18*a* is flattened (as compared to opposing trough 141 of cam 18*b* which is rounded).

Figure 11G:
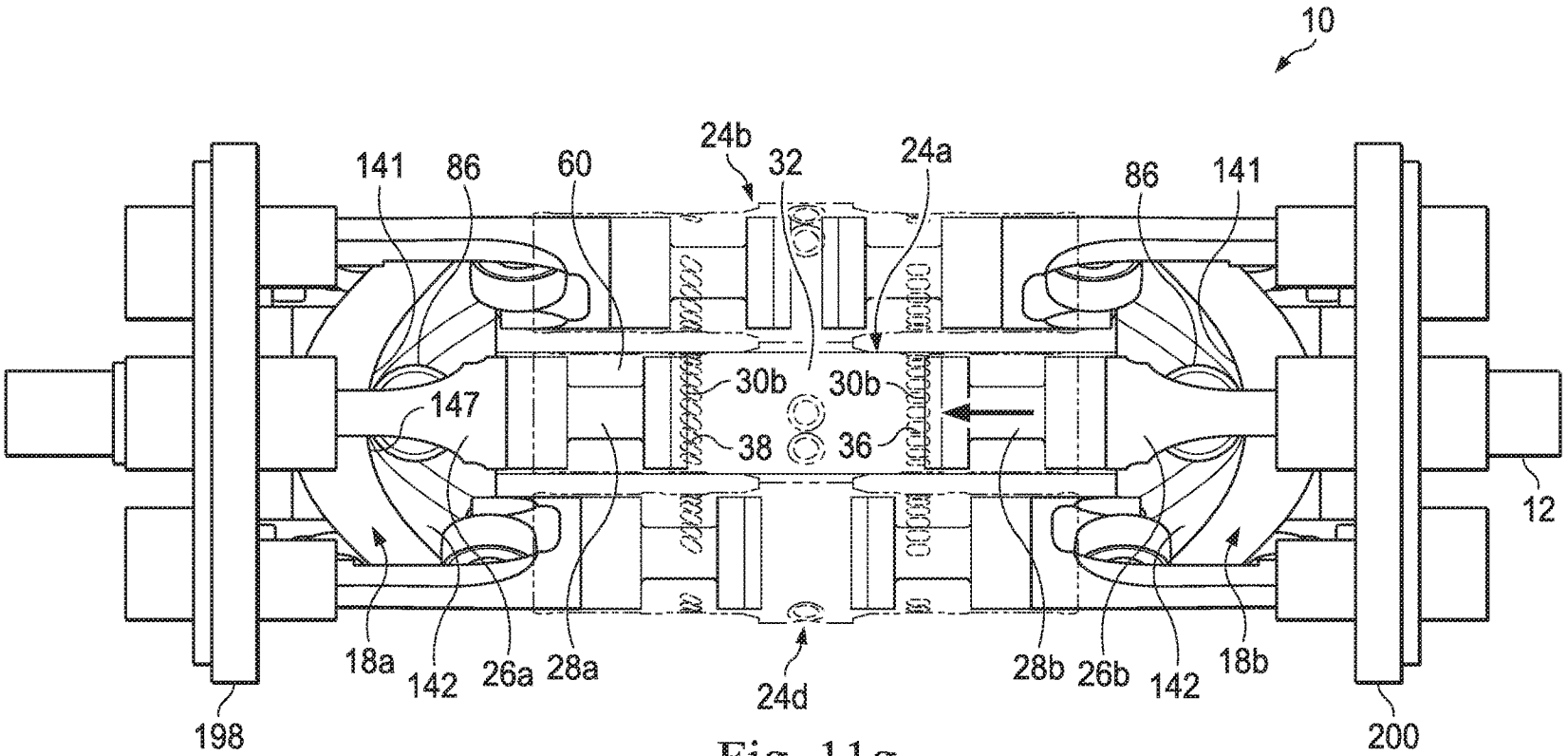

In FIG. 11*g*, piston 30*b* begins to move, while piston 30*a* remains stationary due to the flattened portion 147 of trough 141 of cam 18*a* (as compared to opposing trough 141 of cam 18*b* which is rounded). While piston 30*a* temporarily remains at ODC, the movement of piston 30*b* begins closing off exhaust port 36. The lag in timing between piston 30*a* and piston 30*b* permits additional combustion air to enter combustion chamber 32 since intake port 38 remains open when piston 30*a* is at ODC.

Figure 11H:
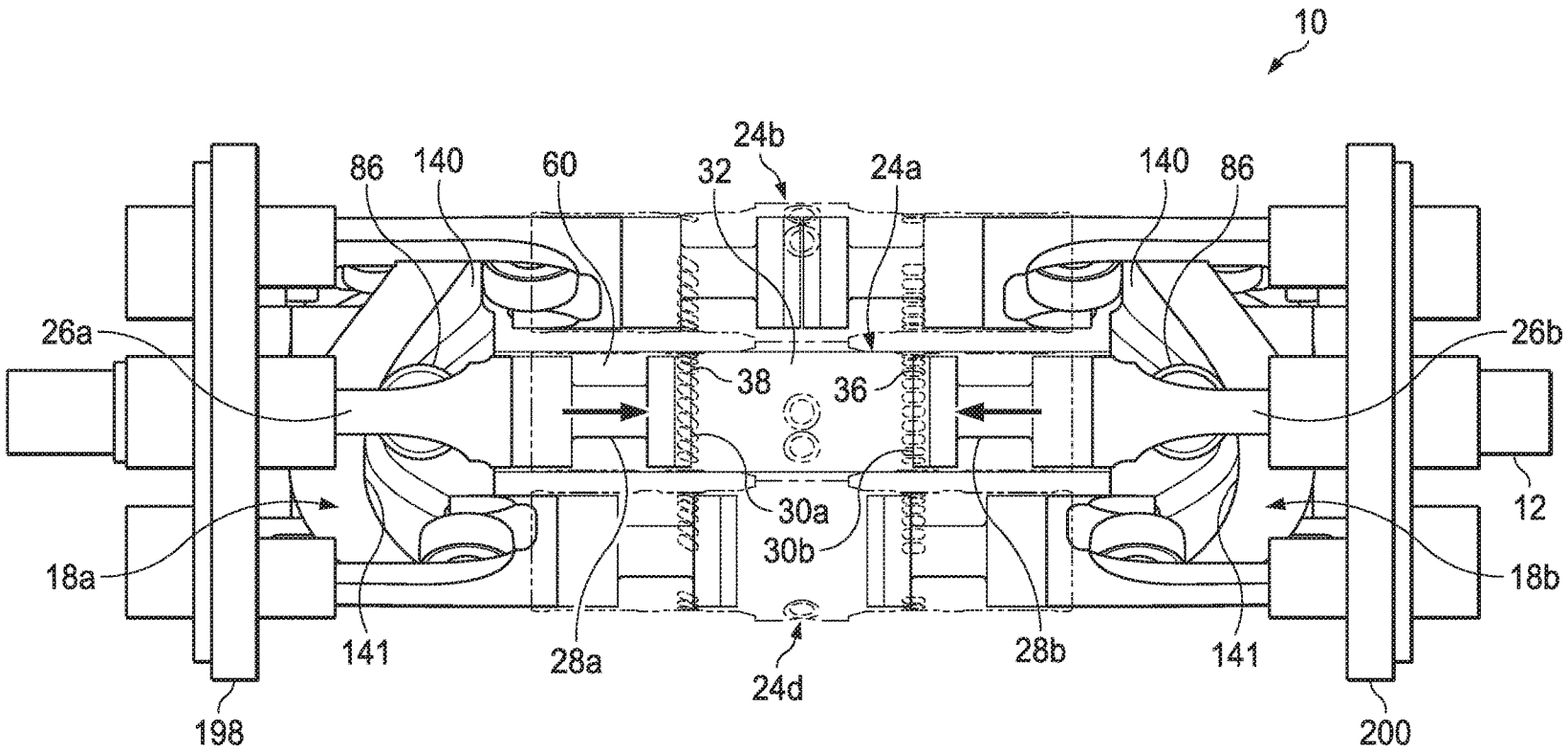

In FIG. 11*h*, both cam follower assemblies 26*a*, 26*b* are shown beginning to move along the ascending shoulder portion of their respective cam tracks 142 from trough 141 towards peak 140, thus beginning the compression stroke. As illustrated, each piston 30*a*, 30*b* is still spaced apart from their respective port 38, 36, such that the ports are still open at this point in the stroke.

Figure 11I:
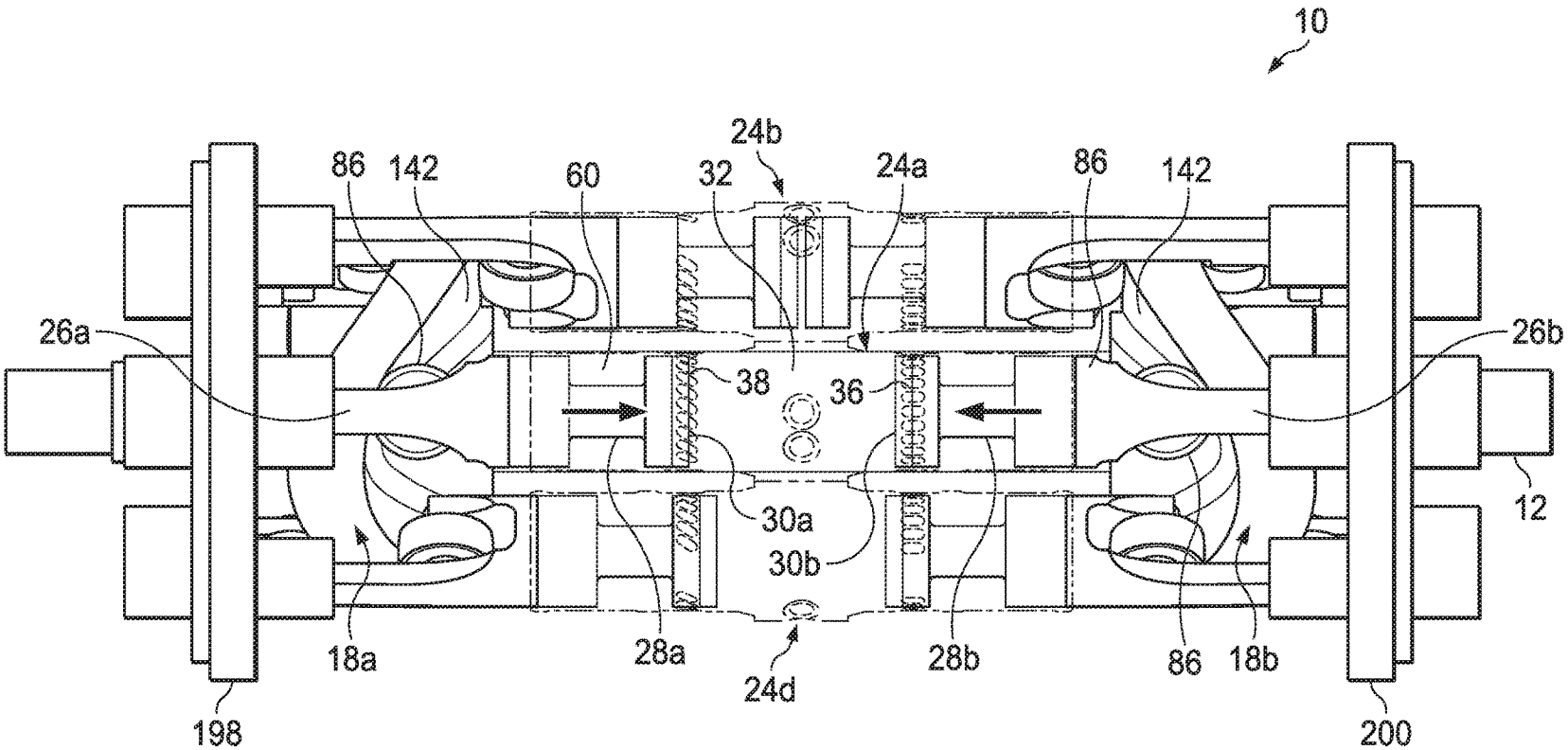

In FIG. 11*i*, cam follower assembly 26*b* has progressed farther along track 142 of cam 18*b* than cam follower assembly 26*a* has progressed along track 142 of cam 18*a*. As such, exhaust port 36 is closed by piston 30*b*, which is adjacent thereto. However, because piston 30*a* along its track 142 lags behind piston 30*b* on its respective track, intake port 38 remains open for a period of time after exhaust port 36 has closed, thus allowing additional combustion air to enter combustion chamber 32. As noted above, intake port 38 may comprise a plurality of angled slots to promote swirl of the combustion air passing through port 38.

Figure 11J:
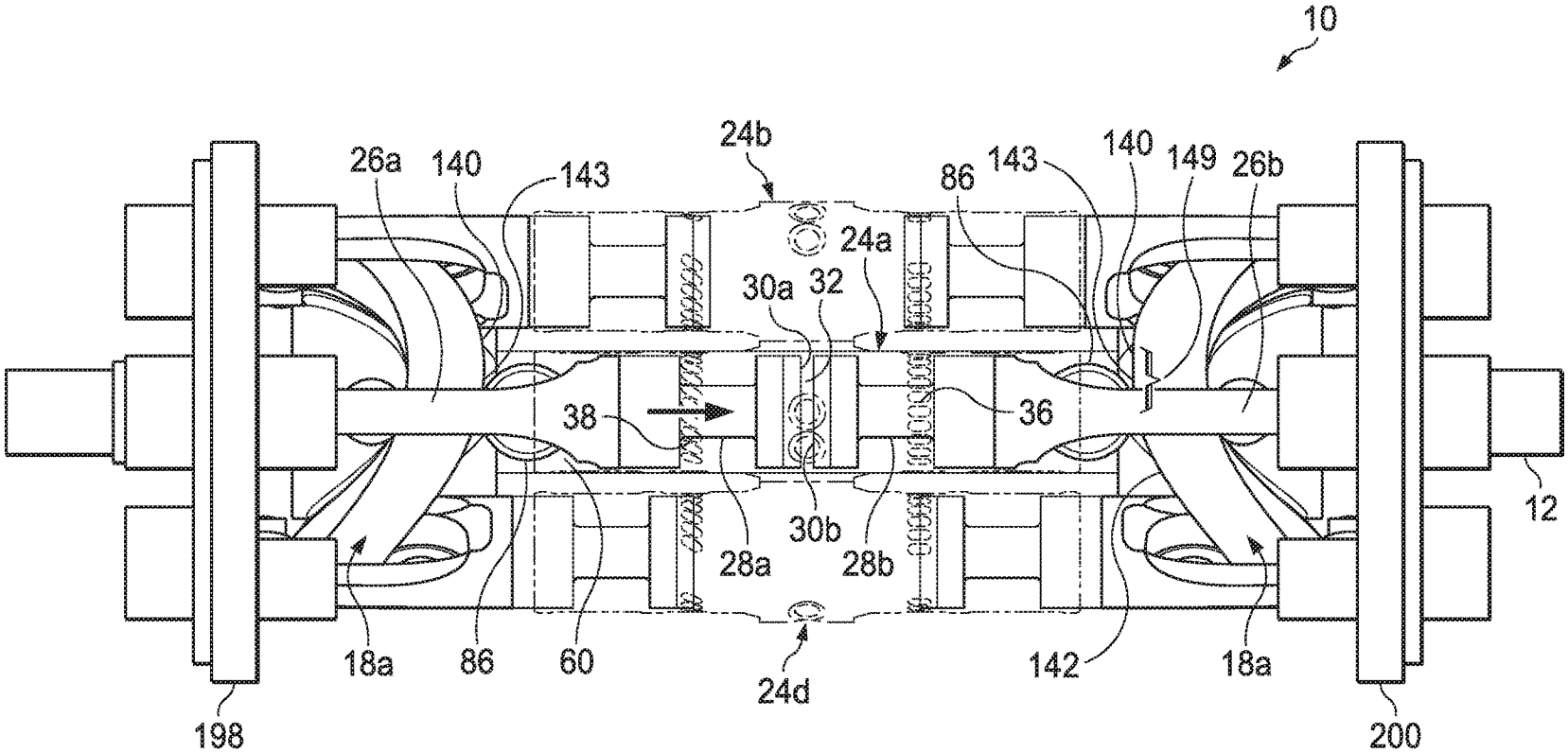

In FIG. 11*j*, both port 36, 38 are shown as being in a "closed" configuration by their respective pistons 30*a*, 30*b*, which prevent fluid communication between chamber 32 and ports 36, 38. In addition, cam follower assembly 26*b* has reached the apex 143 of peak 140 of track 142 of cam 18*b*, causing exhaust piston 30*b* to reach IDC. Because intake piston 30*a* still lags behind exhaust piston 30*b* at this point, intake piston 30*a* continues to move (as indicated by the arrow), compressing the combustion air and fuel injected in chamber 32. It will be observed that on the exhaust side of the engine assembly 10, a portion 149 of apex 143 of cam 18*b* is flattened (as compared to opposing apex 143 of cam 18*a*), such that piston 30*b* temporarily remains at IDC even while piston 30*a* continues to move towards IDC. This lag by piston 30*b* permits piston 30*a* to "catch up" to piston 30*b*, so that their movement along their respective tracks 142 at the beginning of the next stroke once again are synchronized and mirror one another (until piston 30*a* reaches the bottom of the next trough 141).

Figure 11K:
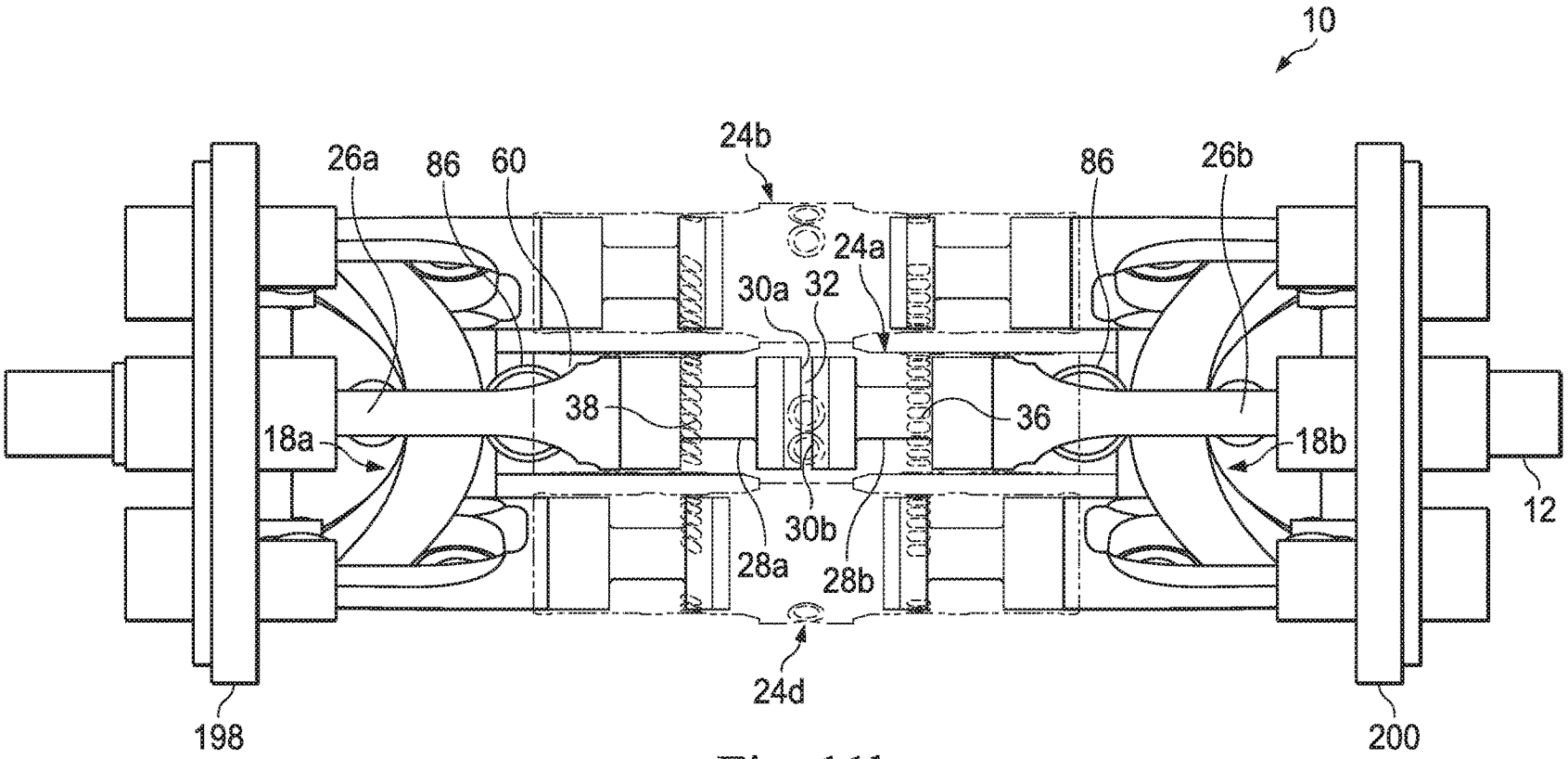

In FIG. 11*k*, both pistons 30*a*, 30*b* have reached IDC and are once again synchronized with one another along their respective cams 18*a*, 18*b*. Being at IDC, combustion air and fuel in combustion chamber 32 are fully compressed for ignition. At this point, having progressed from expansion stroke, through compression stroke and back to expansion stroke, driveshaft 12 has rotated 180° from its original reference point describe in FIG. 11*a*.

Figure 12:
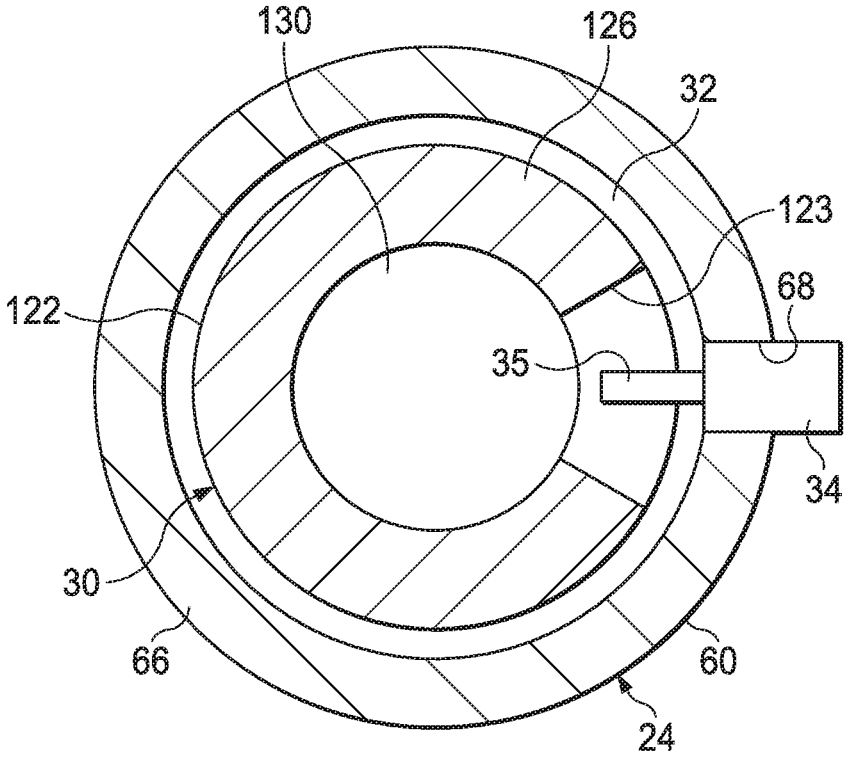
FIG. 12 is a cross-sectional view of a cylinder assembly with a fuel injection nozzle extending into a combustion chamber.

Turning to FIG. 12, a cross-sectional view of a cylinder assembly 24 with a piston 30 extended to IDC as described above is shown. In particular, cylinder assembly 24 includes a cylinder 60 having a fuel injection aperture 68 into which a fuel injector 34 is mounted. A nozzle 35 of fuel injector 34 extends from wall 66 of cylinder 60 into the combustion chamber 32. Piston 30 is shown in relation to nozzle 35. Piston 30 has a crown 126 in which an indention 130 is formed. Piston 30 is aligned within cylinder 60 so that fuel injector nozzle 35 is adjacent notch 123 formed at the periphery of crown 126. Notch 123 prevents piston 30 from contacting fuel injector nozzle 35 when piston 30 is at IDC. It has been found that in certain embodiments, it is desirable for fuel injector nozzle 35 to extend into combustion chamber 32 because heat within combustion chamber 32 can be utilized to pre-heat fuel in nozzle 35 before the fuel is injected into combustion chamber 32. By preheating fuel within fuel injector nozzle 35, combustion of the fuel within combustion chamber 32 is enhanced once the preheated fuel is injected into combustion chamber 32.

Figure 13:
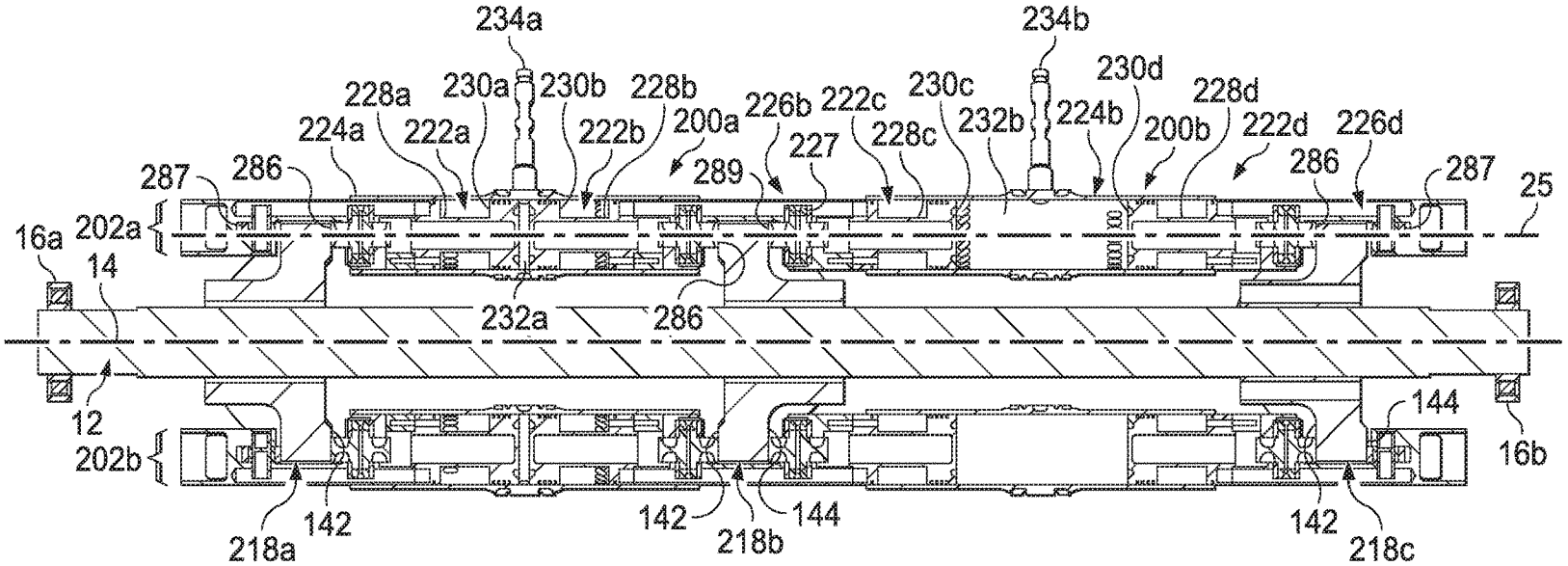
FIG. 13 is a cut-away side view of a barrel engine with piston pairs axially aligned in series.

Turning to FIG. 13, an alternative embodiment of engine assembly 10 is illustrated, wherein two or more piston pairs 200, such as piston pairs 200*a*, 200*b*, are axially aligned in series along cylinder axis 25, together forming a piston series 202, such as piston series 202*a*. Specifically, in FIG. 13, driveshaft 12 extends along a driveshaft axis 14 and passes axially through the center of the engine assembly 10. Driveshaft 12 is supported by a pair of bearings 16*a*, 16*b* in a fixed axial position. Positioned along driveshaft 12 in spaced apart relationship to one another are at least three harmonic barrel cams 218*a*, 218*b*, 218*c*, such as the barrel cams 18 described above. Each piston pairs 200 is comprised of a first piston assembly 222*a* and a second piston assembly 222*b* which piston assemblies 222*a*, 222*b* are axially aligned with one another within a combustion cylinder assembly 224*a* disposed along a cylinder axis 25. Cylinder axis 25 is spaced apart from but generally parallel with driveshaft axis 14 of driveshaft 12. Piston assembly 222*a* includes a cam follower assembly 226*a* attached to a piston arm 228*a* to which is mounted a piston 230*a*. Likewise, opposing piston assembly 222*b* includes a cam follower assembly 226*b* attached to a piston arm 228*b* to which is mounted a piston 230*b*. The opposed pistons 230*a*, 230*b* of piston pair 200*a* are adapted to reciprocate in opposite directions along cylinder axis 25. Each cam follower assembly 226*a*, 226*b* straddles its respective cam 218*a*, 218*b* and acts on its respective piston 230*a*, 230*b*. Opposed pistons 230*a*, 230*b* within cylinder assembly 224*a* generally define a combustion chamber 232*a* therebetween into which fuel may be injected by fuel injector 234*a*.

Piston pair 200*b* of piston series 202*a* likewise includes a first piston assembly 222*c* and a second piston assembly 222*d* which piston assemblies 222*c*, 222*d* are axially aligned with one another within a combustion cylinder assembly 224*b* disposed along a cylinder axis 25. Piston assembly 222*c* includes a piston arm 228*c* to which is mounted a piston 230*c*. Opposing piston assembly 222*d* includes a cam follower assembly 226*d* attached to a piston arm 228*d* to which is mounted a piston 230*d*. The opposed pistons 230*c*, 230*d* of piston pair 200*b* are adapted to reciprocate in opposite directions along cylinder axis 25. Opposed pistons 230*c*, 230*d* within cylinder assembly 224*b* generally define a combustion chamber 232*b* therebetween into which fuel may be injected by fuel injector 234*b*.

Thus, combustion cylinder assembly 224*a* is axially aligned with combustion cylinder assembly 224*b* so as to be in series along cylinder axis 25.

Piston assembly 222*c* further includes a cam follower bridge 227 interconnecting piston arm 228*c* to cam follower assembly 226*b* of piston assembly 222*b*. Each cam follower assembly 226*a*, 226*b*, 226*d* straddles its respective cam 218*a*, 218*b*, 218*c* and is movable with respect to its respective cam 218*a*, 218*b*, 218*c* so that axial movement of pistons 230*a*, 230*b* and 230*d* can be translated into radial rotation of the respective cams 218*a*, 218*b*, 218*d* so as to rotate driveshaft 12. Further, because cam follower bridge 227 interconnects piston assembly 222*b* and 222*c*, axial movement of piston 230*c* is likewise utilized drive radial rotation of cam 218*b*. In this regard, the second roller 289 of cam follower assembly 226*b* may be of a larger diameter than the second roller 287 of the other cam followers, since both rollers 286, 289 of cam follower assembly 226*b* are used to transfer load to cam 218*b*. Thus, rollers 286 may be larger in diameter than rollers 287 in order to transfer load. Additionally, cam 218*b* may have an inwardly facing track 142 and an outwardly facing track 144 that are shaped the same as the corresponding track inwardly facing track of cam 218*a* and 218*c*

Engine assembly 10 includes at least two piston series 202 symmetrically spaced about driveshaft axis 14, such as piston series 202*a* and 202*b*. In one or more embodiments, engine assembly 10 includes at least three symmetrically spaced piston series 202, while in other embodiments, engine assembly 10 includes at least four symmetrically spaced piston series 202.

Moreover, while two serially aligned combustion chamber assemblies 224 with three corresponding cams 18 have been described, the disclosure is not limited in this regard. Thus, in other embodiments three or more combustion chamber assemblies 224 may be axially aligned in series along cylinder axis 25, with a cam 18 disposed between each adjacent combustion chamber assemblies 224, as well as a cam 18 disposed at opposing ends of the series of combustion chamber assemblies 224.

Figure 14A:
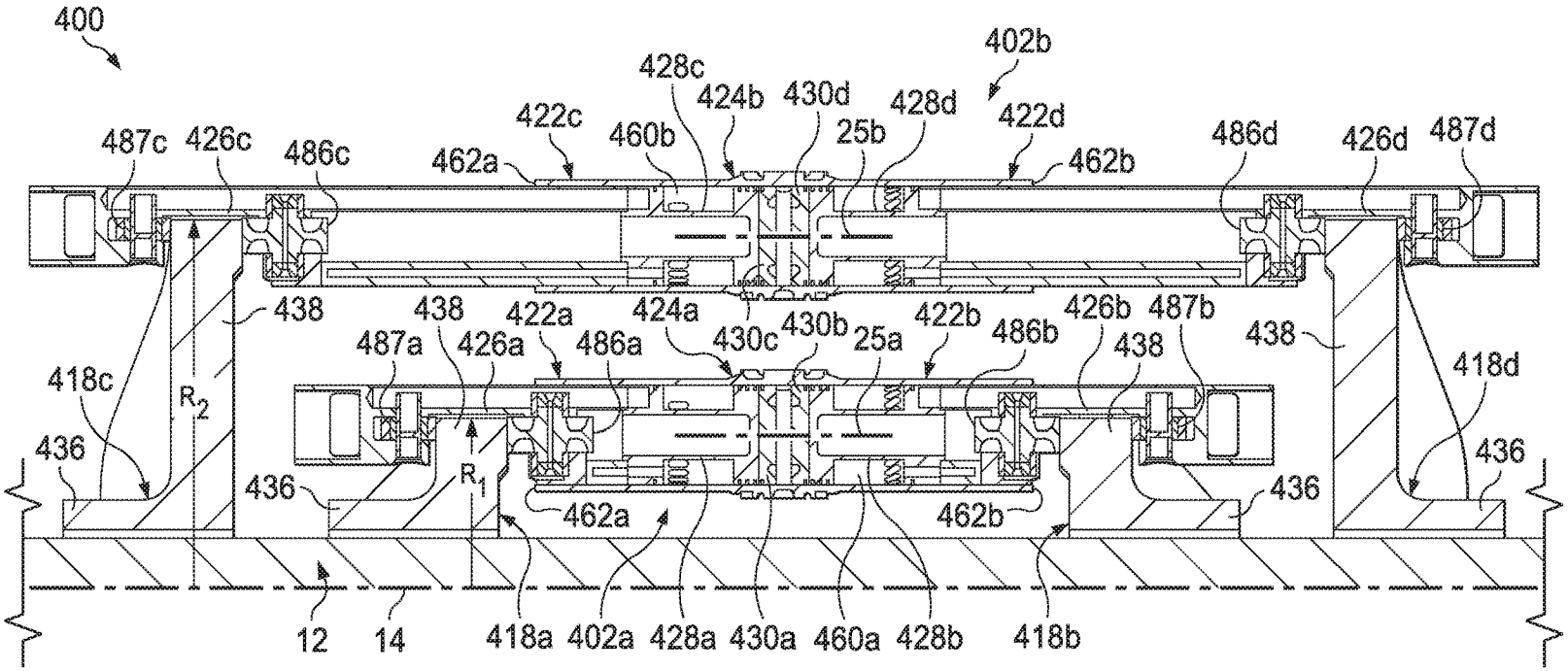
FIG. 14*a* is a cut-away side view of one embodiment of a barrel engine with piston pairs deployed in parallel.

Turning to FIG. 14*a*, an alternative embodiment of engine assembly 10 (of FIG. 1) is illustrated as engine 400, wherein two or more piston pairs 402, such as piston pairs 402*a*, 402*b*, are positioned to be parallel with driveshaft 12 but at different diameters about driveshaft 12, and as such, utilize two or more cam pairs of different diameters mounted on driveshaft 12. As shown, driveshaft 12 extends along a driveshaft axis 14. Mounted along driveshaft 12 between driveshaft ends 412 and 413, in spaced apart relationship to one another, are at least four harmonic barrel cams 418*a*, 418*b*, 418*c* and 418*d*, such as the barrel cams 18 described above, with barrel cams 418*a*, 418*b* forming a first set of cams and barrel cams 418*c*, 418*d* forming a second set of barrel cams. The cams 18 of each set oppose one another as generally described above. However, cams 18*a*, 18*b* of the first cam set have a first cam set diameter D1 (defined as R1*2) while cams 18*c*, 18*d* of the second cam set have a second cam set diameter D2 (defined as R2*2) that is greater than the first cam set diameter D1.

In some embodiments, piston pairs 402*a*, 402*b* may have the same angular position about driveshaft 12 so as to be generally adjacent one another, but radially spaced apart from one another in the same plane extending radially from driveshaft 12, while in other embodiments, piston pairs 402*a*, 402*b* may have different angular position about driveshaft 12.

More specifically, piston pair 402*a* is comprised of a first piston assembly 422*a* and a second piston assembly 422*b* which piston assemblies 422*a*, 422*b* are axially aligned with one another within a cylinder assembly 424*a* disposed along a cylinder axis 25*a*. Combustion cylinder assembly 424*a* is formed of a combustion cylinder 460*a* extending between a first end 462*a* and a second end 464*a*. Cylinder axis 25*a* is spaced apart from, but generally parallel with, driveshaft axis 14 of driveshaft 12. Piston assembly 422*a* includes a cam follower assembly 426*a* attached to a piston arm 428*a* to which is mounted a piston 430*a*. Likewise, opposing piston assembly 422*b* includes a cam follower assembly 426*b* attached to a piston arm 428*b* to which is mounted a piston 430*b*. The opposed pistons 430*a*, 430*b* of piston pair 402*a* are adapted to reciprocate in opposite directions along cylinder axis 25*a*. Each cam follower assembly 426*a*, 426*b* includes a first roller 486 and a second roller 487, straddles its respective cam 418*a*, 418*b* so as to be engaged by rollers 486, 487 and acts on its respective piston 430*a*, 430*b*. Opposed pistons 430*a*, 430*b* within cylinder assembly 424*a* generally define a combustion chamber 432*a* therebetween into which fuel may be injected.

Piston pair 402*b* likewise is comprised of a first piston assembly 422*c* and a second piston assembly 422*d* which piston assemblies 422*c*, 422*d* are axially aligned with one another within a cylinder assembly 424*b* disposed along a cylinder axis 25*b*. Combustion cylinder assembly 424*b* is formed of a combustion cylinder 460*b* extending between a first end 462*c* and a second end 464*d*. Cylinder axis 25*b* is spaced radially outward from, but generally parallel with cylinder axis 25*a* of piston pair 402*a*. Piston assembly 422*c* includes a cam follower assembly 426*c* attached to a piston arm 428*c* to which is mounted a piston 430*c*. Likewise, opposing piston assembly 422*d* includes a cam follower assembly 426*d* attached to a piston arm 428*d* to which is mounted a piston 430*d*. The opposed pistons 430*c*, 430*d* of piston pair 402*b* are adapted to reciprocate in opposite directions along cylinder axis 25*b*. Each cam follower assembly 426*c*, 426*d* straddles its respective cam 418*c*, 418*d* and acts on its respective piston 430*c*, 430*d*. Opposed pistons 430*c*, 430*d* within cylinder assembly 424*b* generally define a combustion chamber 432*b* therebetween into which fuel may be injected.

Each cam follower assembly 226*a*, 226*b*, 226*c* and 226*d* straddles its respective cam 218*a*, 218*b*, 218*c*, 218*d* and is movable with respect to its respective cam 218*a*, 218*b*, 218*c*, 218*d* so that axial movement of pistons 230*a*, 230*b*, 230*c* and 230*d* can be translated into radial rotation of the respective cams 218*a*, 218*b*, 218*c*, 218*d* so as to rotate driveshaft 12.

In one or more embodiments, each cam 18 further includes a circumferential shoulder 438 extending around the cylindrical periphery of a cam hub 436. Shoulder 438 is generally curvilinear in shape and can be characterized as having a certain frequency, where the frequency may generally refer to the number of occurrences of repeating peaks and troughs about the 360 degree circumference of the circumferential shoulder 438. In some embodiments, the curvilinear shape of shoulders 438 of the first cam 418*a* and second cam 418*b* are of a first frequency and the curvilinear shape of shoulders 438 of the third cam 418*c* and fourth cam 418*d* are of a second frequency, which in some embodiments may differ from the first frequency. In some embodiments, it may be desirable for piston pairs 402*a*, 402*b* to translate in unison. In such case, the second frequency is less than the first frequency. In other embodiments, it may be desirable for piston pair 402*b* to translate more rapidly than piston pair 402, in which case, the second frequency may be equal to or greater than the first frequency.

Similarly, in one or more embodiments, the amplitude of the curvilinear shoulders 438 of each cam 18*a*, 18*b*, 18*c*, 18*d* are the same, with the depth of the troughs and the height of the peaks being substantially equal, while in other embodiments, the depth of the troughs may differ from height of the peaks. In some embodiments, the amplitude of the third and fourth cams 18*c*, 18*d*, respectively is less than the amplitude of the first and second cams 18*a*, 18*b* in order to adjust timing of the respective piston pairs 402*a*, 402*b*. Because cams 18*a*, 18*b* of the first cam set have a different diameter D1 than the diameter D2 of cams 18*c*, 18*d*, shoulders 438 of the respective cams 18 are at different diameters. As such, piston pairs 402*a*, 402*b* may have the same angular position about driveshaft 12 so as to be generally adjacent one another, but radially spaced apart from one another in the same plane extending radially from driveshaft 12.

Figure 14B:
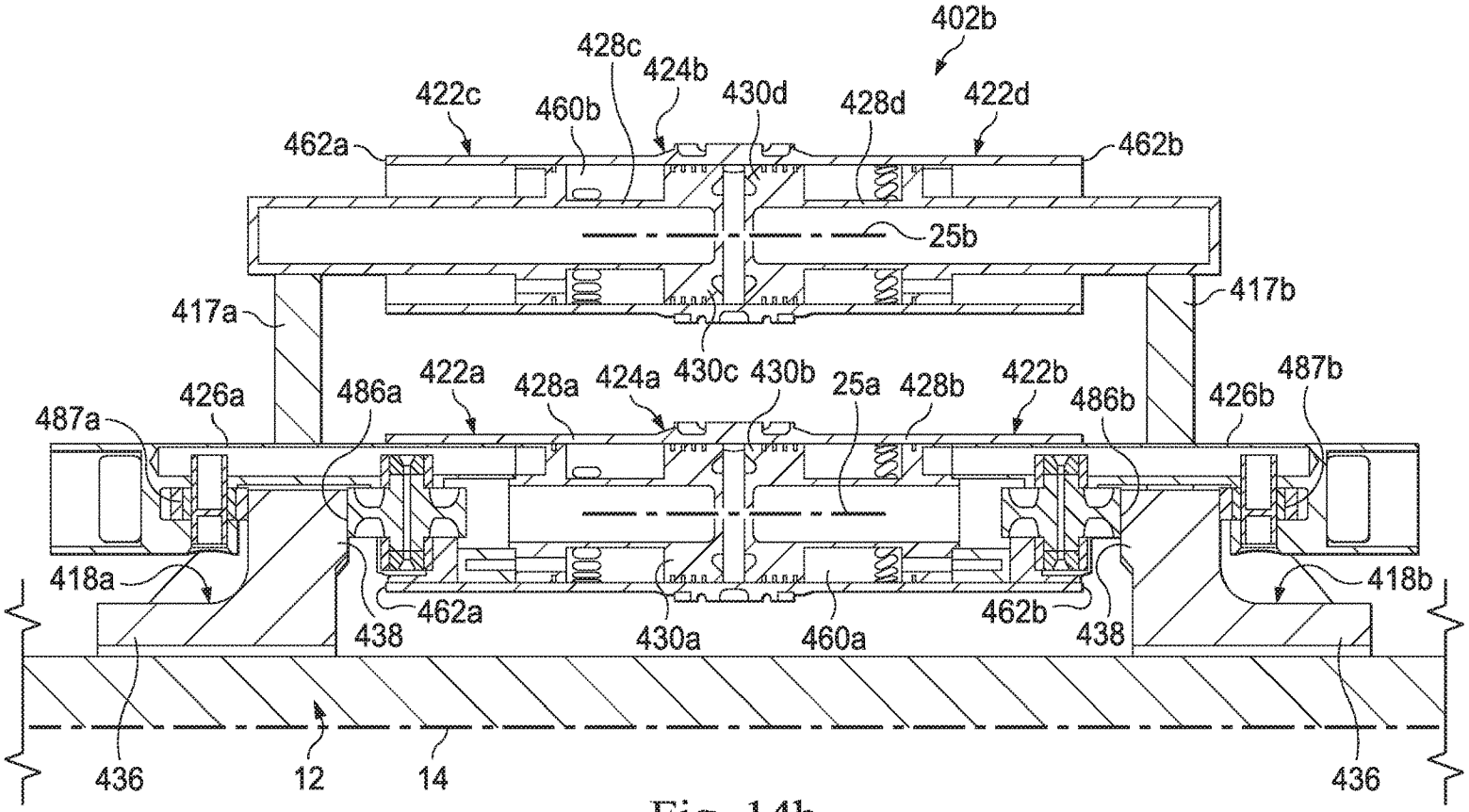
FIG. 14*b* is a cut-away side view of another embodiment of a barrel engine with piston pairs deployed in parallel.

While only two sets of cam pairs are illustrated, any number of sets of cam pairs may be utilized, each set with a different diameter, thereby allowing the density of piston pairs 402 about driveshaft 12 to be increased. It will be appreciated that the greater number of piston pairs about driveshaft 12, the more torque that can be generated by engine 10. Thus, the foregoing arrangement allows greater engine power than would a barrel engine with piston pairs disposed at only one diameter about driveshaft 12. Turning to FIG. 14*b*, is an alternative embodiment of engine assembly engine 400 with two or more piston pairs 402, such as piston pairs 402*a*, 402*b*, aligned in parallel about driveshaft 12. In the embodiment of FIG. 14*b*, rather than utilizing cam pairs of different diameters, a single cam pair 418*a*, 418*b* is utilized, but an interconnecting link 417 connects adjacent piston assemblies 422 so that the adjacent piston assemblies reciprocate in unison. Specifically, driveshaft 12 extends along a driveshaft axis 14. Mounted along driveshaft 12 between driveshaft ends 412 and 413, in spaced apart relationship to one another, are two harmonic barrel cams 418*a*, 418*b*, such as the barrel cams 18 described above. Cams 18*a*, 18*b* oppose one another as generally described above.

Piston pair 402*a* is comprised of a first piston assembly 422*a* and a second piston assembly 422*b* which piston assemblies 422*a*, 422*b* are axially aligned with one another within a cylinder assembly 424*a* disposed along a cylinder axis 25*a*. Combustion cylinder assembly 424*a* is formed of a combustion cylinder 460*a* extending between a first end 462*a* and a second end 464*a*. Cylinder axis 25*a* is spaced apart from, but generally parallel with, driveshaft axis 14 of driveshaft 12. Piston assembly 422*a* includes a cam follower assembly 426*a* attached to a piston arm 428*a* to which is mounted a piston 430*a*. Likewise, opposing piston assembly 422*b* includes a cam follower assembly 426*b* attached to a piston arm 428*b* to which is mounted a piston 430*b*. The opposed pistons 430*a*, 430*b* of piston pair 402*a* are adapted to reciprocate in opposite directions along cylinder axis 25*a*. Each cam follower assembly 426*a*, 426*b* straddles its respective cam 418*a*, 418*b* and acts on its respective piston 430*a*, 430*b*. Opposed pistons 430*a*, 430*b* within cylinder assembly 424*a* generally define a combustion chamber 432*a* therebetween into which fuel may be injected.

Piston pair 402*b* likewise is comprised of a first piston assembly 422*c* and a second piston assembly 422*d* which piston assemblies 422*c*, 422*d* are axially aligned with one another within a cylinder assembly 424*b* disposed along a cylinder axis 25*b*. Combustion cylinder assembly 424*b* is formed of a combustion cylinder 460*b* extending between a first end 462*c* and a second end 464*d*. Cylinder axis 25*b* is spaced radially outward from, but generally parallel with cylinder axis 25*a* of piston pair 402*a*. Piston assembly 422*c* includes a piston arm 428*c* to which is mounted a piston 430*c*. Likewise, opposing piston assembly 422*d* includes a piston arm 428*d* to which is mounted a piston 430*d*. The opposed pistons 430*c*, 430*d* of piston pair 402*b* are adapted to reciprocate in opposite directions along cylinder axis 25*b*. Opposed pistons 430*c*, 430*d* within cylinder assembly 424*b* generally define a combustion chamber 432*b* therebetween into which fuel may be injected.

A link 417*a* extends between adjacent piston assemblies 422*a*, 422*c*. Likewise, a link 417*b* extends between adjacent piston assemblies 422*b*, 422*d*. Link 417 interconnects the respective adjacent piston assemblies 422 so that the assemblies will reciprocate in unison. Moreover, link 417 transfers axial force applied generated by the outer piston assembly 422 to inner piston assembly, and thus to the respective cam 18. Link 417 may be any suitable structure for such interconnection, such as, for example, an arm, plate, rod, body or similar structure. Moreover, link 417 can extend between any reciprocating portion of the piston assemblies 422. In the illustrated embodiment, link 417 extends between a piston arm 428 and a cam follower assembly 226, but in other embodiments, link 417 may interconnect other reciprocating components of piston assembly 422. Thus, as shown, link 417*a* interconnects cam follower assembly 226*a* with piston arm 428*c*, and link 417*b* interconnects cam follower assembly 226*b* with piston arm 428*d*.

Each cam follower assembly 226*a*, 226*b* straddles its respective cam 218*a*, 218*b* and is movable with respect to its respective cam 218*a*, 218*b* so that axial movement of pistons 230*a*, 230*b*, 230*c* and 230*d* can be translated into radial rotation of the respective cams 218*a*, 218*b*, so as to rotate driveshaft 12.

In other embodiments, cam follower assembly 226 is connected to two piston arms 428 and functions as the link 417 interconnecting the two adjacent piston assemblies 422. In such embodiments, the cam 18 may have a radius that is between the two cylinder axii 25*a*, 25*b*, and cam follower assembly 226 may be positioned radially between adjacent piston arms 428.

While FIG. 13 describes piston pairs 402 and combustion cylinder assemblies 424 in series, and FIGS. 14*a* and 14*b* describe piston pairs 402 and combustion cylinder assemblies 424 in parallel, it will be appreciated that in other embodiments of an engine assembly, piston pairs 402 and combustion cylinder assemblies 424 can be mounted in the engine assembly of the disclosure to be in both parallel and in series. Thus, in some embodiments of an engine assembly, two or more combustion cylinder assemblies 424 may be aligned in series along a first axis, such as axis 25*a*, which first axis is parallel with and spaced apart from driveshaft axis 14, with each of the two serially aligned combustion cylinder assemblies 424 having piston pairs 402 that are also generally aligned along the first axis 25*a*. Likewise, two or more combustion cylinder assemblies 424 may be aligned in series along a second axis, such as axis 25*b*, which second axis is parallel with and spaced apart from both driveshaft axis 14 and first axis 25*a*, with each of the two serially aligned combustion cylinder assemblies 424 along second axis 25*b* having piston pairs 402 that are also generally aligned along the second axis 25*b*. For example, an embodiment of the foregoing engine may include first and second combustion cylinders serially or sequentially disposed along a first center cylindrical axis and third and fourth combustion cylinders serially or sequentially disposed along a second center cylindrical axis, where the first and second center cylindrical axii are parallel with one another, but the second center cylindrical axis is spaced radially outward from the first center cylindrical axis. In such an arrangement, it will be appreciated that the engine will have first, second, third, fourth, fifth, sixth, seventh and eighth piston assemblies mounted in the ends of the four combustion cylinders.

Figure 15:
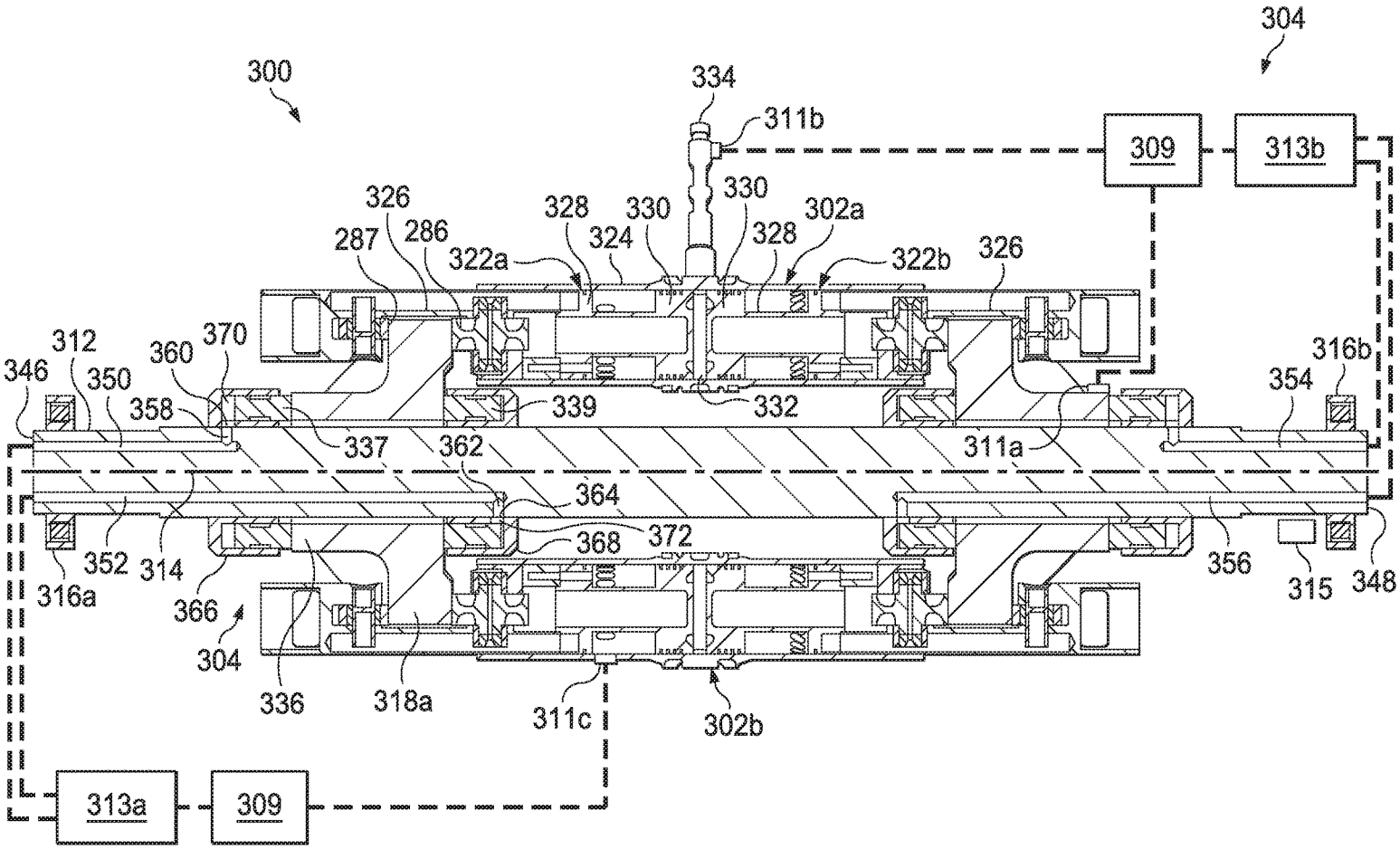
FIG. 15 is a cut-away side view of a barrel engine with a radial adjustment mechanism for altering the relative position of a cam on a driveshaft.

Turning to FIG. 15, engine assembly 300 is illustrated, where one or more cams 318, such as spaced apart cams 318*a* and 318*b*, are radially adjustable relative to driveshaft 312 utilizing a radial adjustment mechanism 304. Specifically, in FIG. 15, a simplified longitudinal section and cutaway view of an engine assembly 300 is shown, where driveshaft 312 extends along a primary axis 314 and passes axially through the center of the assembly 300. Driveshaft 312 is supported by a pair of bearings 316*a*, 316*b* in a fixed axial position. Positioned along driveshaft 312 in spaced apart relationship to one another are harmonic barrel cams 318*a*, 318*b*. A piston pair 302*a* comprises a first piston assembly 322*a* and a second piston assembly 322*b* which piston assemblies 322*a*, 322*b* are axially aligned with one another within a cylinder assembly 324 disposed along a cylinder axis 325. Cylinder axis 325 is spaced apart from but generally parallel with primary axis 314 of driveshaft 312. Each piston assembly 322 generally includes a cam follower assembly 326 attached to a piston arm 328 to which is mounted a piston 330. The opposed pistons 330 of a piston pair 302*a* are adapted to reciprocate in opposite directions along cylinder axis 325. Each cam follower assembly 326 straddles its respective cam 318 and acts on piston 330 through piston arm 328. Opposed pistons 330 within cylinder assembly 324 generally define a combustion chamber 332 therebetween into which fuel may be injected by a fuel injector 334. Upon combustion of fuel within combustion chamber 332, pistons 330 are driven away from one another along cylinder axis 325, all as generally described above with respect to other embodiments. In the illustrated embodiment, engine assembly 300 further includes a second piston pair 302*b* symmetrically positioned relative to piston pair 302*a*.

Driveshaft 312 is further characterized by a first end 346 and a second end 348. Axially formed in at least one end of driveshaft 312 is a first axially extending hydraulic passage 350 and a second axially extending hydraulic passage 352, such as shown at first end 346. In the illustrated embodiment, second end 348 likewise has a first axially extending hydraulic passage 354 and a second axially extending hydraulic passage 356. A first radial passage 358 in fluid communication with the first hydraulic passage 350 is formed in driveshaft 312 and terminates at an outlet 360. Likewise, a second radial passage 362 in fluid communication with the second hydraulic passage 352 is formed in driveshaft 312 and terminates at an outlet 364.

Formed along driveshaft 312 is first collar 366 and second collar 368, each extending radially outward from driveshaft 312. In one embodiment, collars 366, 368 are spaced apart from one another along driveshaft 312. Collars 366, 368 may be integrally formed as part of driveshaft 312 or separately formed.

Cam 318 is mounted on driveshaft 312 adjacent outlets 360, 364 and collars 366, 368. In particular, cam 318 includes a hub 336 having a first end 337 mounted relative to first collar 366 so as to form a first pressure chamber 370 therebetween, with outlet 360 in fluid communication with first pressure chamber 370. Likewise, hub 336 has a second end 339 mounted relative to second collar 368 so as to form a second pressure chamber 372 therebetween, with outlet 364 in fluid communication with second pressure chamber 372.

Radial adjustment mechanism 304 may include a hydraulic fluid source 313*a* in fluid communication with each of hydraulic passage 350 and hydraulic passage 352 to alternatively supply pressurized fluid (not shown) to one or the other of first pressure chamber 370 or second pressure chamber 372. In this regard, radial adjustment mechanism 304 may further include a controller 309 to control delivery of fluid from fluid source 313 to the pressure chambers 370, 372. In this regard, controller 309 may receive data from one or more sensors 311 about a condition of the engine 300, such as the rotational speed of cam 318 (sensor 311*a*) or type of fuel being injected by fuel injector 334 (sensor 311*b*) or the condition of the combustion gas existing cylinder assembly 324 (sensor 311*c*), and control delivery of fluid from fluid source 313 in order to optimize the position of cam 318 relative to driveshaft 312 for a particular purpose. For example, it has been found that cam 318 may be in a first radial orientation relative to driveshaft 312 when a first type of fuel, such as gasoline, is utilized in engine 300 and cam 318 may be in a second radial orientation (different than the first radial orientation) relative to driveshaft 312 when a second type of fuel, such as diesel, is utilized in engine 300. Persons of ordinary skill in the art will appreciate that application of a pressurized fluid to first pressure chamber 370 will result in radial rotation of cam 318 in a first direction relative to driveshaft 312 and application of a pressurized fluid (not shown) to second pressure chamber 372 will result in radial rotation of cam 318 in a second direction relative to driveshaft 312. Moreover, the relative pressures of the pressurized fluids in each of the chambers 370, 372 may be adjusted to adjust the radial orientation of cam 318 on driveshaft 12, as described above. It will also be appreciated that the foregoing is particularly desirable because changes to the relative position of cam 318 may be made dynamically in real time while engine 300 is in operation. These changes may be based on monitoring of various operational parameters and/or conditions of engine 300 with one or more sensors 315 in real time. Thus, in some embodiments, based on measurements from sensor 315, hydraulic fluid source 313 may be operated to rotate cam 318 in a first direction or a second direction relative to driveshaft 312 in order to achieve a desired output from a piston pair 302. Alternatively, the system may be static by maintaining the relative fluid pressure in each chamber at the same pressure.

Figure 16:
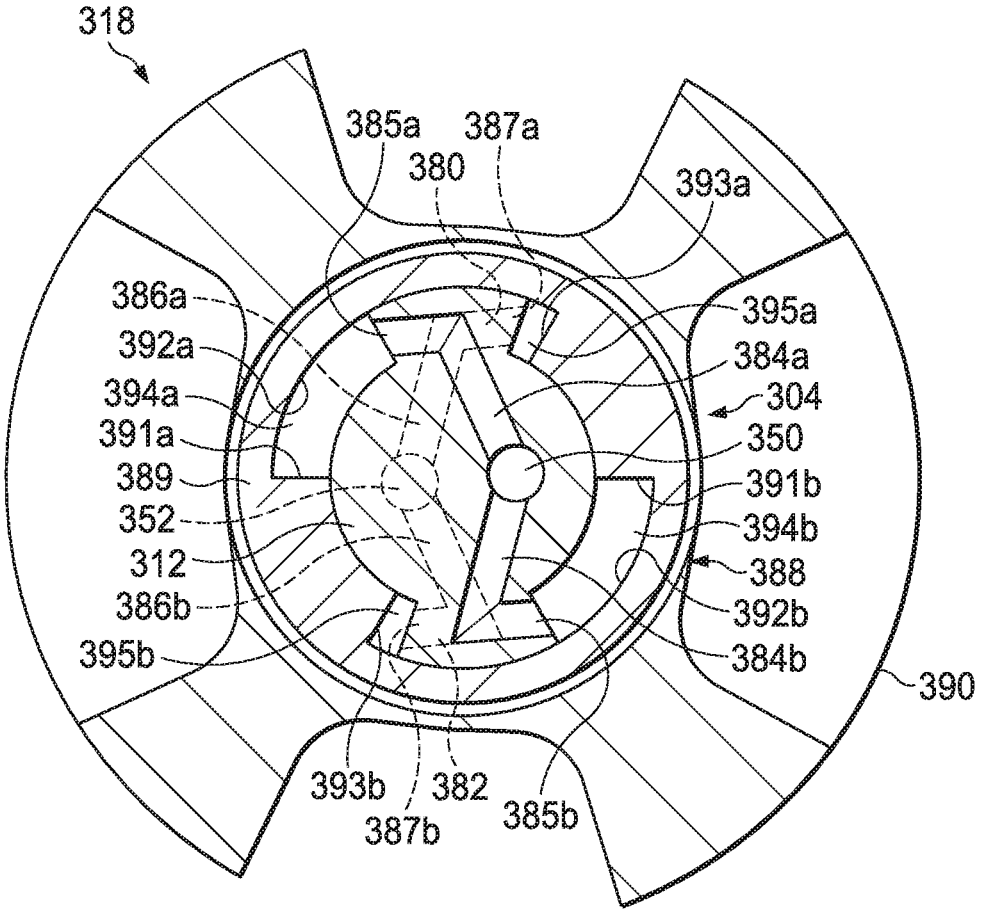
FIG. 16 is a cut-away axial view another embodiment of a radial adjustment mechanism for altering the relative position of a cam on a driveshaft.
Figure 17:
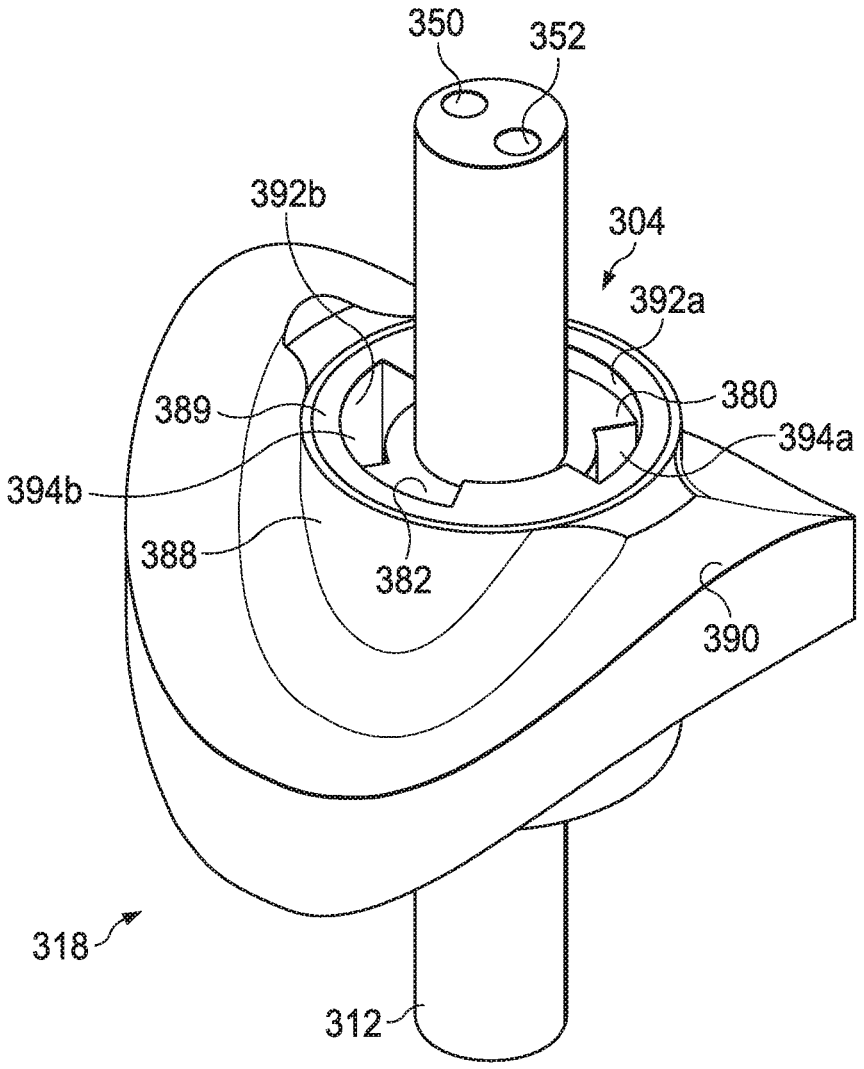
FIG. 17 is a perspective view of the radial adjustment mechanism of FIG. 16.

Turning to FIGS. 16 and 17, cam 318 is shown with another embodiment of radial adjustment mechanism 304. Specifically, in this embodiment, driveshaft 312 includes a first lug 380 and second lug 382, each extending radially outward from driveshaft 312. In one embodiment, lugs 380, 382 opposed one another about driveshaft 312. Lugs 380, 382 may be integrally formed as part of driveshaft 312, as shown, or separately formed.

Driveshaft 312 further includes a first axially extending hydraulic passage 350 and a second axially extending hydraulic passage 352, preferably of varied axial lengths.

A first set of radial passages 384*a*, 384*b* is in fluid communication with the first axially extending hydraulic passage 350, each of the radial passages 384*a*, 384*b* formed in a lug 380, 382, respectively, and terminates at a ported lug outlet 385*a*, 385*b*. Likewise, a second set of radial passages 386*a*, 386*b* (shown in dashed), preferably spaced apart axially from the first set of radial passages 384*a*, 384*b*, is in fluid communication with the second axially extending hydraulic passage 352. Each of the radial passages 386*a*, 386*b* is formed in a lug 380, 382, respectively, and terminates at a ported lug outlet 387*a*, 387*b*.

Cam 318 is mounted on driveshaft 312 adjacent outlets 385, 387 and lugs 380, 382. In particular, cam 318 includes a hub 388 having a hub wall 389 with a curvilinear shoulder 390 extending radially outward from the outer circumference of hub wall 389. In some embodiments, as illustrated, shoulder 390 may be shaped to have two peaks with a corresponding number of troughs, such that the cam profiles describe two complete cycles per revolution and are thus double harmonics, while in other embodiments, shoulder 390 may have other number of peaks and troughs, as desired.

Formed along the inner circumference of hub wall 389 are first and second spaced apart slots 392*a*, 392*b*, each slot 392*a*, 392*b* disposed to receive a lug 380, 382, respectively. In one or more embodiments, the slots 392*a*, 392*b* may oppose one another. First slot 392*a* is characterized by a first shoulder 391*a* and a second shoulder 393*a*, while second slot 392*b* is characterized by a third shoulder 391*b* and a fourth shoulder 393*b*. In particular, lug 380 extends into first slot 392*a* to form a first pressure chamber 394*a* between lug 380 and a first slot shoulder 391*a*, with outlet 385*a* in fluid communication with first pressure chamber 394*a*. Likewise, lug 382 extends into second slot 392*b* to form a third pressure chamber 394*b* between lug 382 and a third slot shoulder 391*b*, with outlet 385*b* in fluid communication with third pressure chamber 394*b*.

In one or more embodiments, such as the illustrated embodiments, a second pressure chamber 395*a* is formed between lug 380 and a second slot shoulder 393*a*, with outlet 387*a* in fluid communication with second pressure chamber 395*a*. Likewise, a fourth pressure chamber 395*b* is formed between lug 382 and a fourth slot shoulder 393*b*, with outlet 387*b* in fluid communication with fourth pressure chamber 395*b*.

It will be appreciated that in some embodiments, pressure chambers 394*b* and 395*b*, as well as passages 384*b* and 386*b* and ports 385*b* and 387*b* can be eliminated, with only a pressure chamber 394*a* utilized as a first pressure chamber to rotate cam 318 in a first direction relative to driveshaft 312, and only a pressure chamber 395*a* utilized as a second pressure chamber to rotate cam 318 in a second opposite direction relative to driveshaft 312.

Moreover, during operation of an engine, such as engine 300 employing the radial adjustment mechanism 304, pressurized fluid can be alternatingly supplied to chamber 394*a* or chamber 395*a* to dynamically adjust the radial position of cam 318 relative to driveshaft 312 as desired, rotating cam 318 either in a first clockwise direction or a second counterclockwise direction about driveshaft 312.

It will be appreciated that in each of the engine embodiments described herein, more work may be produced out of every increment of fuel with a shortened intake stroke combined with a full-length power stroke in longer displacements made by the counter opposed pistons arrangement in a central combustion chamber. Moreover, the engines experience very low vibration due to naturally balanced barrel architecture combined with balanced power pulse operating sequence described above. Variable compression ratio and phasing tune can be obtained through automatic or manual adjustment of the barrel cams relative to the driveshaft. Moreover, the closed circuit of forces during engine operations allows a much less robust and lighter casing for enveloping the engine. This also permits the use of a wide range of materials, such as plastics, cast and forged aluminum of the casing parts, block and other components. The closed circuit of forces comprises with the forces and stress induced by the power stroke expansion pressure applied on the piston head during the power stroke which flows from the piston head to the piston neck, to the piston rod, to the cam-rollers, to the cam and finally to the driveshaft so as to minimize applying moments and bending forces on the engine block, bearings and other parts as in a conventional engine fitted with a crankshaft and engine head.

The cylinders are fitted with intake and exhaust ports to operate the 2-stroke cycle, uniflow air intake and scavenging process. The phasing control is provided by the travelling time of the opposed-pistons, opening and closing the intake and exhaust ports, governed by cam design, that can accelerate or slowdown pistons travelling speeds, and its number of wave lengths.

Thus, an internal combustion engine has been described. The internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency;

a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; and at least one fuel injector disposed adjacent the center of the combustion cylinder and in communication with said combustion chamber. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; and a second combustion cylinder having a first end and a second end, the second combustion cylinder defined along the center cylinder axis so as to be axially aligned with the first combustion cylinder; a third piston assembly disposed in the first cylinder end of the second combustion cylinder; and an opposing fourth piston assembly disposed in the second cylinder end of the second combustion cylinder. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; and a second combustion cylinder defined along the center cylinder axis so as to be axially aligned with the first combustion cylinder, the second combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends with a piston assembly disposed in each second combustion cylinder end so that piston heads of the piston assemblies of the cylinder oppose one another within the cylinder. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; wherein the combustion cylinder further comprises a cylinder wall and the exhaust port comprises a plurality of exhaust slots formed in the cylinder wall between the fuel injector and the second end, each exhaust slot extending along a slot axis generally parallel with the central cylinder axis, the intake port comprising a plurality of intake slots formed in the cylinder wall between the fuel injector and the first end, each intake slot extending along a slot axis generally diagonal with the central cylinder axis. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; and at least one annular flow manifold extending at least partially around the driveshaft, the annular flow manifold fluidically connecting the ports of two or more combustion cylinders. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; and an annular intake manifold extending at least partially around the driveshaft and fluidically connecting the intake ports of two or more combustion cylinders; and an annular exhaust manifold extending at least partially around the driveshaft, spaced axially apart from the annular intake manifold, the annular exhaust manifold fluidically connecting the exhaust ports of two or more combustion cylinders. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; and an engine block in which the driveshaft and combustion cylinder are supported, the engine block extends between a first end and a second end and includes an annular body portion therebetween, which annular body portion is characterized by an exterior surface and in which is formed a first annular channel and a second annular channel spaced apart from one another, the first annular channel in fluid communication with the intake port of the combustion cylinder and the second annular channel in fluid communication with the exhaust port of the combustion cylinder. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; and at least one fuel injector disposed adjacent the center of the combustion cylinder and in communication with said combustion chamber; wherein the first cam comprises a hub mounted on driveshaft with the circumferential shoulder extending around a periphery of hub, the curvilinear shaped first cam shoulder has at least two peaks and at least two troughs formed by the shoulder, wherein each trough includes a substantially flat portion at its base and wherein each peak is rounded at its apex; the second cam comprises a hub mounted on driveshaft with the circumferential shoulder extending around a periphery of hub, the curvilinear shaped second cam shoulder has at least two crests and at least two troughs formed by the shoulder and corresponding in number to the crests and troughs of the first cam, wherein each trough of the second cam is rounded at its base and wherein each peak includes a substantially flat portion at its apex. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; and at least one fuel injector disposed adjacent the center of the combustion cylinder and in communication with said combustion chamber; wherein the first cam comprises a hub mounted on driveshaft with the circumferential shoulder extending around a periphery of hub, the curvilinear shaped first cam shoulder has at least two peaks having a first peak amplitude and at least two troughs having a first trough amplitude, wherein the first trough amplitude is less than the first peak amplitude; and the second cam comprises a hub mounted on driveshaft with the circumferential shoulder extending around a periphery of hub, the curvilinear shaped second cam shoulder has at least two peaks having a second peak amplitude and at least two troughs having a second trough amplitude, wherein the second trough amplitude is greater than the second peak amplitude. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; and at least one fuel injector disposed adjacent the center of the combustion cylinder and in communication with said combustion chamber; wherein the piston assembly comprises a piston arm having a first annular body of a piston arm diameter spaced apart from a second annular body having a similar piston arm diameter and interconnected by a smaller diameter neck, with a piston attached to the first annular body and a cam follower attached to the second annular body. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; wherein the piston assembly comprises a piston arm having a first end and a second end, with a piston attached to the first end of the piston arm and a cam follower attached to the second end of the piston arm, wherein the cam follower assembly includes an elongated body having a first end and a second end, wherein the elongated body is generally cylindrically shaped at each end, which ends are interconnected by an arm within which is formed a lubrication passage extending along a portion of the length of the arm between the two ends, the elongated body having an axially extending first slot in formed in the body adjacent the first end and an axially extending second slot formed in the body adjacent the second; a first roller mounted to the body in the first slot; and a second roller mounted to the body in the second slot, wherein the lubrication passage extends in the arm between the two rollers. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; and a first guidance cap positioned adjacent the first end of the driveshaft and a second guidance cap positioned adjacent the second end of the driveshaft, wherein each guidance cap is coaxially mounted around a driveshaft end, outwardly of the cam between the cam and the driveshaft end, wherein the guidance cap comprises a central bore through which the driveshaft extends and two or more symmetrically positioned follower bores radially spaced outward of central bore with each follower bore slidingly receiving the cylindrically shaped second end of a cam follower assembly. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; and at least one fuel injector disposed adjacent the center of the combustion cylinder and in communication with said combustion chamber; wherein the piston assembly comprises a piston arm having a first end and a second end, with a piston attached to the first end of the piston arm and a cam follower attached to the second end of the piston arm, wherein the piston is formed of an annular body having a first end attached to piston arm and a second end, with a crown formed at the second end of the annular body, the crown having an indention formed in an outwardly facing crown surface. In other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; a second combustion cylinder having a first end and a second end and defined along second center cylinder axis parallel with the first combustion cylinder central axis but radially spaced outward from the first combustion cylinder central axis; a third cam mounted on the driveshaft between the first cam and the first driveshaft end, the third cam having a circumferential shoulder of a third cam diameter and a third curvilinear shape with a third frequency, the third cam diameter being larger than the first cam diameter; and a fourth cam mounted on the driveshaft between the second cam and the second end of the driveshaft, the fourth cam having a circumferential shoulder of a fourth curvilinear shape which fourth curvilinear shape has the same frequency as the third curvilinear shape. In yet other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; a second combustion cylinder having a first end and a second end, the second combustion cylinder defined along the center cylinder axis so as to be axially aligned with the first combustion cylinder; a third piston assembly disposed in the first cylinder end of the second combustion cylinder; and an opposing fourth piston assembly disposed in the second cylinder end of the second combustion cylinder; a third combustion cylinder having a first end and a second end and defined along second center cylinder axis parallel with the first combustion cylinder central axis but radially spaced outward from the first combustion cylinder central axis; a fifth piston assembly disposed in the first cylinder end of the third combustion cylinder; and an opposing sixth piston assembly disposed in the second cylinder end of the third combustion cylinder; a fourth combustion cylinder having a first end and a second end, the fourth combustion cylinder defined along the second center cylinder axis so as to be axially aligned with the third combustion cylinder; a seventh piston assembly disposed in the first cylinder end of the fourth combustion cylinder; and an opposing eighth piston assembly disposed in the second cylinder end of the fourth combustion cylinder; and at least one fuel injector disposed adjacent the center of each combustion cylinder and in communication with said combustion chamber of its respective combustion cylinder. In yet other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the first combustion cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; a second combustion cylinder having a first end and a second end and defined along second center cylinder axis parallel with the first combustion cylinder central axis but radially spaced outward from the first combustion cylinder central axis, wherein a combustion chamber is defined within the second combustion cylinder between the two cylinder ends; a third piston assembly disposed in the first cylinder end of the second combustion cylinder and an opposing fourth piston assembly disposed in the second cylinder end of the second combustion cylinder; and at least one fuel injector disposed adjacent the center of each combustion cylinder and in communication with the respective combustion chamber. In yet other embodiments, the internal combustion engine may include a driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the first combustion cylinder between the two cylinder ends; a first piston assembly disposed in the first cylinder end of the first combustion cylinder and an opposing second piston assembly disposed in the second cylinder end of the first combustion cylinder, each piston assembly movable between an inner dead center position in which the piston assembly is fully extended in the combustion chamber away from its corresponding cam and an outer dead center position in which the piston assembly is fully retracted in the combustion chamber away from the inner dead center position; a second combustion cylinder having a first end and a second end and defined along second center cylinder axis parallel with the first combustion cylinder central axis but radially spaced outward from the first combustion cylinder central axis, wherein a combustion chamber is defined within the second combustion cylinder between the two cylinder ends; a third piston assembly disposed in the first cylinder end of the second combustion cylinder and an opposing fourth piston assembly disposed in the second cylinder end of the second combustion cylinder; and at least one fuel injector disposed adjacent the center of each combustion cylinder and in communication with the respective combustion chamber. In other embodiments, the internal combustion engine includes a driveshaft has a first end and a second end and disposed along a driveshaft axis, with a first hydraulic passage extending from a driveshaft end to a first outlet and a second hydraulic passage extending from a driveshaft end to a second outlet spaced apart from the first outlet; a first piston disposed to reciprocate along a piston axis, the first piston axis being parallel with but spaced apart from the driveshaft axis; a first collar formed along the driveshaft adjacent the first outlet and a second collar formed along the driveshaft adjacent the second outlet, each collar extending radially outward from driveshaft; and a first cam rotatably mounted on the driveshaft adjacent the first and second collars, the first cam having a first hub having a first end mounted adjacent the first collar so as to form a first pressure chamber between the hub first end and the first collar, with the first outlet in fluid communication with the first pressure chamber, the hub having a second end mounted adjacent the second collar so as to form a second pressure chamber between the hub second end and the second collar, with the second outlet in fluid communication with second pressure chamber, with a circumferential cam shoulder extending around a periphery of the hub, the cam shoulder having a first cam diameter and a first polynomial shaped track. In other embodiments, the internal combustion engine includes a driveshaft having a first end and a second end and disposed along a driveshaft axis, with a first hydraulic passage extending from a driveshaft end and a second hydraulic passage extending from a driveshaft end, a first set of radial passages in fluid communication with the first hydraulic passage and a second set of radial passages in fluid communication with the second hydraulic passage; a first piston disposed to reciprocate along a piston axis, the first piston axis being parallel with but spaced apart from the driveshaft axis; a first cam rotatably mounted on the driveshaft, the first cam having a first hub with a circumferential cam shoulder extending around a periphery of the first hub, the cam shoulder having a first cam diameter and a first polynomial shaped track; a first radially extending lug formed along the driveshaft adjacent the first cam hub and a second radially extending lug formed along the driveshaft adjacent the first cam hub, a radial passage of the first set of radial passages terminating in a first ported lug outlet formed in the first lug and a radial passage of the second set of radial passages terminating in a second ported lug outlet formed in the first lug, a radial passage of the first set of radial passages terminating in a third ported lug outlet formed in the second lug and a radial passage of the second set of radial passages terminating in a fourth ported lug outlet formed in the second lug; a first pressure chamber formed between the first lug and the first cam hub and a second pressure chamber, formed between the first lug and the first cam hub, the first ported lug outlet in the first lug in fluid communication with the first pressure chamber and the third ported lug outlet in the first lug in fluid communication with the second pressure chamber; a third pressure chamber formed between the second lug and the first cam hub; and a fourth pressure chamber formed between the second lug and the first cam hub, the second ported lug outlet in the second lug in fluid communication with the second pressure chamber and the fourth ported lug outlet in the second lug in fluid communication with the fourth pressure chamber. In other embodiments, the internal combustion engine includes a driveshaft having a first end and a second end and disposed along a driveshaft axis; a piston disposed to reciprocate along a piston axis, the piston axis being parallel with but spaced apart from the driveshaft axis, and a first cam mounted on the driveshaft, the first cam comprising a cam hub attached the driveshaft, and a circumferential cam shoulder extending around a periphery of the hub, the cam shoulder having a first cam diameter and a first segmented polynomial shape, the shoulder having at least two lobes formed by the polynomial shape, each lobe characterized by a peak positioned between a first trough and a second trough and a lobe wavelength between the two troughs, the peak having a maximum amplitude for the lobe, where the wavelength distance from the first trough to peak along an ascending shoulder portion of the lobe is greater than the wavelength distance from the peak to the second trough along a descending shoulder portion of the lobe; and a second cam mounted on the driveshaft and spaced apart from the first cam, the second cam comprising a cam hub attached the driveshaft, and a circumferential cam shoulder extending around a periphery of the hub, the cam shoulder having a second segmented polynomial shape of constantly changing slope which second segmented polynomial shape has the same frequency as the first segmented polynomial shape, the shoulder having at least two lobes formed by the second polynomial shape, each lobe characterized by a peak positioned between a first trough and a second trough and a lobe wavelength between the two troughs, the peak having a maximum amplitude for the lobe, where the wavelength distance from the first trough to peak along an ascending shoulder portion of the lobe is greater than the wavelength distance from the peak to the second trough along a descending shoulder portion of the lobe, wherein the number of lobes of the second cam corresponds with the number of lobes of the first cam; and wherein the cams oppose one another so that the peak of a lobe of the first cam is substantially aligned with the peak of a lobe of the second cam, but no portion of first segmented polynomial shaped shoulder is parallel with a portion of second segmented polynomial shaped shoulder. In other embodiments, the internal combustion engine includes a driveshaft having a first end and a second end and disposed along a driveshaft axis; a piston disposed to reciprocate along a piston axis, the piston axis being parallel with but spaced apart from the driveshaft axis, and a first cam mounted on the driveshaft, the first cam comprising a cam hub attached the driveshaft, and a circumferential cam shoulder extending around a periphery of the hub, the cam shoulder having a first cam diameter and a first segmented polynomial shape, the shoulder having at least two lobes formed by the polynomial shape, each lobe characterized by a peak positioned between a first trough and a second trough, the lobe having an ascending shoulder portion between the first trough and the peak and a descending shoulder portion between the peak and the second trough, wherein the average slope of the ascending shoulder portion is greater than the average slope of the descending shoulder portion; and a second cam mounted on the driveshaft and spaced apart from the first cam, the second cam comprising a cam hub attached the driveshaft, and a circumferential cam shoulder extending around a periphery of the hub, the cam shoulder having a second segmented polynomial shape which second segmented polynomial shape has the substantially the same frequency as the first segmented polynomial shape, the shoulder having at least two lobes formed by the second polynomial shape, each lobe characterized by a peak positioned between a first trough and a second trough, the lobe having an ascending shoulder portion between the first trough and the peak and a descending shoulder portion between the peak and the second trough, wherein the average slope of the ascending shoulder portion is greater than the average slope of the descending shoulder portion, wherein the number of lobes of the second cam corresponds with the number of lobes of the first cam; and wherein the first segmented polynomial shaped shoulder and the second segmented polynomial shaped shoulder oppose one another so as to be constantly diverging or converging from one another. In other embodiments, the internal combustion engine includes a driveshaft having a first end and a second end and disposed along a driveshaft axis; a piston disposed to reciprocate along a piston axis, the piston axis being parallel with but spaced apart from the driveshaft axis, and a first cam mounted on the driveshaft, the first cam comprising a cam hub attached the driveshaft, and a circumferential cam shoulder extending around a periphery of the hub, the cam shoulder having a first cam diameter and a first segmented polynomial shape, the shoulder having at least one lobe formed by the polynomial shape, each lobe characterized by a peak positioned between a first trough and a second trough and a lobe wavelength between the two troughs, the peak having a maximum amplitude for the lobe, where the wavelength distance from the first trough to peak along an ascending shoulder portion of the lobe is greater than the wavelength distance from the peak to the second trough along a descending shoulder portion of the lobe; and a second cam mounted on the driveshaft and spaced apart from the first cam, the second cam comprising a cam hub attached the driveshaft, and a circumferential cam shoulder extending around a periphery of the hub, the cam shoulder having a second segmented polynomial shape which second segmented polynomial shape has the same frequency as the first segmented polynomial shape, the shoulder having at least one lobe formed by the second polynomial shape, each lobe characterized by a peak positioned between a first trough and a second trough and a lobe wavelength between the two troughs, the peak having a maximum amplitude for the lobe, where the wavelength distance from the first trough to peak along an ascending shoulder portion of the lobe is greater than the wavelength distance from the peak to the second trough along a descending shoulder portion of the lobe, wherein the number of lobes of the second cam corresponds with the number of lobes of the first cam; and wherein the cams oppose one another so that the peak of a lobe of the first cam is substantially aligned with the peak of a lobe of the second cam, but no portion of first segmented polynomial shaped shoulder is parallel with a portion of second segmented polynomial shaped shoulder. In other embodiments, the internal combustion engine includes a driveshaft having a first end and a second end and disposed along a driveshaft axis; a piston disposed to reciprocate along a piston axis, the piston axis being parallel with but spaced apart from the driveshaft axis, and a first cam mounted on the driveshaft, the first cam comprising a cam hub attached the driveshaft, and a circumferential cam shoulder extending around a periphery of the hub, the cam shoulder having a first cam diameter and a first segmented polynomial shape, the shoulder having at least one lobe formed by the polynomial shape, each lobe characterized by a peak positioned between a first trough and a second trough, the lobe having an ascending shoulder portion between the first trough and the peak and a descending shoulder portion between the peak and the second trough, wherein the average slope of the ascending shoulder portion is greater than the average slope of the descending shoulder portion; and a second cam mounted on the driveshaft and spaced apart from the first cam, the second cam comprising a cam hub attached the driveshaft, and a circumferential cam shoulder extending around a periphery of the hub, the cam shoulder having a second segmented polynomial shape which second segmented polynomial shape has the same frequency as the first segmented polynomial shape, the shoulder having at least one lobe formed by the second polynomial shape, each lobe characterized by a peak positioned between a first trough and a second trough, the lobe having an ascending shoulder portion between the first trough and the peak and a descending shoulder portion between the peak and the second trough, wherein the average slope of the ascending shoulder portion is greater than the average slope of the descending shoulder portion, wherein the number of lobes of the second cam corresponds with the number of lobes of the first cam; and wherein the first segmented polynomial shaped shoulder and the second segmented polynomial shaped shoulder oppose one another so as to be constantly diverging or converging from one another.

The following elements may be combined alone or in combination with any other elements for any of the foregoing engine embodiments:

At least 4 cylinders symmetrically spaced around the driveshaft.

A second combustion cylinder having a first end and a second end, the second combustion cylinder defined along the center cylinder axis so as to be axially aligned with the first combustion cylinder; a third piston assembly disposed in the first cylinder end of the second combustion cylinder; and an opposing fourth piston assembly disposed in the second cylinder end of the second combustion cylinder.

The third piston assembly engages the curvilinear shaped shoulder of the second cam.

A third cam mounted on the driveshaft and spaced apart from the second cam, the third cam having a circumferential shoulder of a third curvilinear shape, wherein the fourth piston assembly engages the curvilinear shaped shoulder of the third cam.

Two or more combustion cylinders axially aligned along the central cylinder axis, each combustion cylinder having a first end and a second end with a piston assembly disposed in each cylinder end so that piston heads of the piston assemblies of a cylinder oppose one another within the cylinder.

Three or more cams coaxially mounted on the driveshaft and spaced apart from one another, each cam having a cylindrical shoulder of curvilinear shape, wherein each cam positioned between two successive combustion cylinders is engaged by a piston assembly extending from each of the successive combustion cylinders.

First, second and third piston assemblies, each comprising a piston arm having a first end and a second end, with a piston attached to the first end of the piston arm and a cam follower attached to the second end of the piston arm, wherein the cam follower assembly includes an elongated body having a first end and a second end, wherein the elongated body is generally cylindrically shaped at each end, the elongated body having an axially extending first slot formed in the body adjacent the first end and an axially extending second slot formed in the body adjacent the second; a first roller mounted to the body in first slot; and a second roller mounted to the body in second slot.

The first roller of the first piston assembly has a larger diameter than the second roller of the first piston assembly; the first roller of the second piston assembly has a larger diameter than the second roller of the second piston assembly; and the first roller of the third piston assembly is the same diameter as the second roller of the third piston assembly.

The first roller has a diameter that is larger than the diameter of the second roller.

The combustion cylinder further comprises a cylinder wall and the exhaust port comprises a plurality of exhaust slots formed in the cylinder wall between the fuel injector and the second end, each exhaust slot extending along a slot axis generally parallel with the central cylinder axis, the intake port comprising a plurality of intake slots formed in the cylinder wall between the fuel injector and the first end, each intake slot extending along a slot axis generally diagonal with the central cylinder axis.

The exhaust slots only extend around a portion of a periphery of the cylinder.

The exhaust slots extend around no more than 180 degrees of the periphery of the cylinder.

The exhaust slots extend around no more than 90 degrees of the periphery of the cylinder.

The intake slots only extend around a portion of a periphery of the cylinder.

The intake slots extend around no more than 180 degrees of the periphery of the cylinder.

The intake slots extend around no more than 90 degrees of the periphery of the cylinder.

At least one annular flow manifold extending at least partially around the driveshaft, the annular flow manifold fluidically connecting the ports of two or more combustion cylinders.

The annular flow manifold is an annular intake manifold fluidically connecting the intake ports of two or more combustion cylinders.

The annular flow manifold is an annular exhaust manifold fluidically connecting the exhaust ports of two or more combustion cylinders.

Wherein the annular flow manifold extends fully around the driveshaft and forms an annular flowpath around the driveshaft fluidically connecting the intake or exhaust ports of all combustion cylinders.

An annular intake manifold extending at least partially around the driveshaft and fluidically connecting the intake ports of two or more combustion cylinders; and an annular exhaust manifold extending at least partially around the driveshaft, spaced axially apart from the annular intake manifold, the annular exhaust manifold fluidically connecting the exhaust ports of two or more combustion cylinders.

The annular intake manifold extends fully around the driveshaft and forms an annular combustion air flowpath around the driveshaft fluidically connecting the intake ports of all combustion cylinders and wherein the annular exhaust manifold extends fully around the driveshaft and forms an annular exhaust flowpath around the driveshaft fluidically connecting the exhaust ports of all combustion cylinders.

An engine block in which the driveshaft and combustion cylinder are supported, the engine block extends between a first end and a second end and includes an annular body portion therebetween, which annular body portion is characterized by an exterior surface and in which is formed a first annular channel and a second annular channel spaced apart from one another, the first annular channel in fluid communication with the intake port of the combustion cylinder and the second annular channel in fluid communication with the exhaust port of the combustion cylinder.

The annular channels extend from the exterior surface inwardly towards the driveshaft.

At least one annular channel extends around the entire circumference of the annular body portion.

At least one annular channel extends around only a portion of the circumference of the annular body portion.

The first and second annular channels are spaced apart from one another about the center of the annular body portion.

The engine block comprises a cylinder bore extending axially through the engine block and intersecting both of the annular channels, the combustion cylinder mounted in the cylinder bore so that the intake port aligns with the first annular channel and the exhaust port aligns with the second annular channel.

At least three cylinder bores extending axially through the engine block and intersecting both of the annular channels, the cylinder bores symmetrically spaced about the driveshaft, each cylinder bore having a combustion cylinder mounted therein, each combustion cylinder having an intake port in fluid communication with the first annular channel and an exhaust port in fluid communication with the second annular channel, each combustion cylinder further having a first end and a second end with a piston assembly disposed in each cylinder end so that piston heads of the piston assemblies of a cylinder oppose one another within the cylinder.

A fuel injector port formed in the exterior surface of the annular body portion adjacent the center of the annular body portion and extending towards the combustion cylinder, wherein the fuel injector is mounted in the fuel injector port.

A sparkplug port formed in the exterior surface of the annular body portion adjacent the fuel injector port, the spark plug port extending towards the combustion cylinder.

The first cam comprises a hub mounted on driveshaft with the circumferential shoulder extending around a periphery of hub, the curvilinear shaped first cam shoulder has at least two peaks and at least two troughs formed by the shoulder, wherein each trough includes a substantially flat portion at its base and wherein each peak is rounded at its apex; the second cam comprises a hub mounted on driveshaft with the circumferential shoulder extending around a periphery of hub, the curvilinear shaped second cam shoulder has at least two crests and at least two troughs formed by the shoulder and corresponding in number to the crests and troughs of the first cam, wherein each trough of the second cam is rounded at its base and wherein each peak includes a substantially flat portion at its apex.

The first cam comprises a hub mounted on driveshaft with the circumferential shoulder extending around a periphery of hub, the curvilinear shaped first cam shoulder has at least two peaks having a first peak amplitude and at least two troughs having a first trough amplitude, wherein the first trough amplitude is less than the first peak amplitude; the second cam comprises a hub mounted on driveshaft with the circumferential shoulder extending around a periphery of hub, the curvilinear shaped second cam shoulder has at least two peaks having a second peak amplitude and at least two troughs having a second trough amplitude, wherein the second trough amplitude is greater than the second peak amplitude.

The second cam has a second cam diameter which second cam diameter is the same as the first cam diameter.

The first peak amplitude is substantially equivalent to the second trough amplitude, and the first trough amplitude is substantially equivalent to the second peak amplitude.

The first and second cams have the same number of peaks and troughs.

The curvilinear shape of the first cam has a curvilinear frequency that is the same as the curvilinear frequency of the curvilinear shape of the second cam.

The amplitude of the curvilinear shaped shoulders of each cam is the same.

The shoulder of each cam has at least four crests and at least four troughs.

Each curvilinear shaped cam shoulder comprises an inwardly facing track and an outwardly facing track.

Each cam includes a cam index and each cam is mounted on the driveshaft and radially indexed with a driveshaft index, wherein the first cam and the second cam have the same curvilinear shape, and wherein one cam is angularly displaced on the driveshaft an angle of between zero and fifteen degrees relative to the other cam.

The angular displacement between the first and second cams is between 0.5 to 11 degrees.

The piston assembly comprises a piston arm having a first annular body of a piston arm diameter spaced apart from a second annular body having a similar piston arm diameter and interconnected by a smaller diameter neck, with a piston attached to the first annular body and a cam follower attached to the second annular body.

The neck is of solid cross-sectional area.

An annulus is formed around the neck between the first and second annular bodies.

Each annular body includes an annular groove formed around annular body with a sealing element disposed in the annular groove.

The piston assemblies each comprises a piston arm having a first end and a second end, with a piston attached to the first end of the piston arm.

A first cam follower linked to first and third piston assemblies and a second cam follower linked to the second and fourth piston assemblies, each cam follower assembly includes an elongated body having a first end and a second end, wherein the elongated body is generally cylindrically shaped at each end, which ends are interconnected by an arm, the elongated body having an axially extending first slot formed in the body adjacent the first end and an axially extending second slot formed in the body adjacent the second; a first roller mounted to the body in the first slot; and a second roller mounted to the body in the second slot; and wherein the third and fourth piston assemblies each comprise a piston arm having a first end and a second end, wherein the first cam follower engages the curvilinear shaped shoulder of the first cam and the second cam follower engages the curvilinear shaped shoulder of the second cam.

The piston assembly comprises a piston arm having a first end and a second end, with a piston attached to the first end of the piston arm and a cam follower attached to the second end of the piston arm, wherein the cam follower assembly includes an elongated body having a first end and a second end, wherein the elongated body is generally cylindrically shaped at each end, which ends are interconnected by an arm within which is formed a lubrication passage extending along a portion of the length of the arm between the two ends, the elongated body having an axially extending first slot in formed in the body adjacent the first end and an axially extending second slot formed in the body adjacent the second; a first roller mounted to the body in the first slot; and a second roller mounted to the body in the second slot, wherein the lubrication passage extends in the arm between the two rollers.

The first cylindrically shaped end of the cam follower assembly is of a first diameter and the second cylindrically shaped end of the cam follower assembly is of a second diameter smaller than the first diameter.

The piston assembly comprises a piston arm having a first end and a second end, with a piston attached to the first end of the piston arm and a cam follower attached to the second end of the piston arm, wherein the cam follower assembly includes an elongated body having a first end and a second end, wherein the elongated body is generally cylindrically shaped at each end, which ends are interconnected by an arm, the elongated body having an axially extending first slot in formed in the body adjacent the first end and an axially extending second slot formed in the body adjacent the second; a first roller mounted to the body in the first slot; and a second roller mounted to the body in the second slot.

A port formed in the arm adjacent the first roller and in fluid communication with the lubrication passage, a port formed in the arm adjacent the second roller and in fluid communication with the lubrication passage, and an additional port formed in the elongated cam follower body in fluid communication with the lubrication passage.

A first roller bearing and a second roller bearing, wherein the first port is in fluid communication with the first roller bearing and the second port is in fluid communication with the second roller bearing.

The elongated body has an outer surface and the additional port is formed in the outer surface of the elongated body.

The cylindrically shaped second end of the cam follower body has a bore formed therein.

The cylindrically shaped second end of the cam follower body has a bore formed therein with a radially extending window formed in the second end and intersecting the bore.

The cam follower assembly further comprises a radially adjustable spacer pad mounted on the arm between the first and second rollers and extending inwardly of the arm between the first and second slots.

The first roller has a larger diameter than the second roller.

The first and second slots are formed along a plane and each roller has a rotational axis that is generally parallel with the rotational axis of the other roller and which axii are generally perpendicular to the plane along which the slots are formed.

The cam follower of the piston assembly engages the curvilinear shaped shoulder of a cam.

Each curvilinear shaped cam shoulder comprises an inwardly facing track facing the combustion cylinder and an outwardly facing track facing away from the combustion chamber, wherein the first roller bears against the inwardly facing track and the second roller bears against the outwardly facing track.

The adjustable spacer pad bears against the outer edge of the curvilinear shoulder.

The larger diameter first roller bears against the inwardly facing track and the smaller diameter second roller bears against the outwardly facing track.

A guidance cap coaxially mounted around a driveshaft end, outwardly of the cam between the cam and the driveshaft end, wherein the guidance cap comprises a central bore through which the driveshaft extends and two or more symmetrically positioned follower bores radially spaced outward of central bore with each follower bore slidingly receiving the cylindrically shaped second end of a cam follower assembly.

An engine block in which the driveshaft is supported, the engine block extending between a first end and a second end and includes an annular body portion therebetween, which annular body is generally coaxial with the driveshaft, and which annular body portion is characterized by an exterior surface, wherein at least one cylinder bore radially spaced apart from the driveshaft but parallel therewith is formed in the engine block and coaxial with a follower bore of the guidance cap.

The guidance cap comprises at least six symmetrically spaced follower bores, each slidingly receiving the cylindrically shaped second end of a cam follower assembly.

The follower bores are of a diameter less than the bores of the engine block.

The guidance cap comprises a port formed within the bore disposed to align with the port along the outer surface of the elongated body of the cam follower assembly.

A first guidance cap positioned adjacent the first end of the driveshaft and a second guidance cap positioned adjacent the second end of the driveshaft.

The piston assembly comprises a piston arm having a first end and a second end, with a piston attached to the first end of the piston arm and a cam follower attached to the second end of the piston arm, wherein the piston is formed of an annular body having a first end attached to piston arm and a second end, with a crown formed at the second end of the annular body, the crown having an indention formed in an outwardly facing crown surface.

The indention has an indention depth.

The intention is conically shaped about the primary axis of the piston.

A notch formed at the periphery of annular body and extending inward to intersect with the indention.

The notch has a notch depth no deeper than indention depth.

The notch extends no more than approximately 90 degrees around the periphery of annular body.

The notch extends no more than approximately 60 degrees around the periphery of annular body.

The notch extends between 5 and 30 degrees around the periphery of annular body.

A portion of the fuel injector extends into the notch when the piston assembly is extended to the inner dead center position.

A portion of the notch extends around a portion of the fuel injector when the piston assembly is extended to the inner dead center position.

A first link interconnecting the first and third piston assemblies and a second link interconnecting the second and fourth piston assemblies.

The first and second piston assemblies each comprises a piston arm having a first end and a second end, with a piston attached to the first end of the piston arm and a cam follower attached to the second end of the piston arm, wherein the cam follower assembly includes an elongated body having a first end and a second end, wherein the elongated body is generally cylindrically shaped at each end, which ends are interconnected by an arm, the elongated body having an axially extending first slot formed in the body adjacent the first end and an axially extending second slot formed in the body adjacent the second; a first roller mounted to the body in the first slot; and a second roller mounted to the body in the second slot; and wherein the third and fourth piston assemblies each comprise a piston arm having a first end and a second end, with a piston attached to the first end of the piston arm.

A first link interconnecting the first and third piston assemblies and a second link interconnecting the second and fourth piston assemblies.

The first link interconnects the cam follower assembly of the first piston assembly with the piston arm of the third piston assembly, and the second link interconnects the cam follower assembly of the second piston assembly with the piston arm of the fourth piston assembly.

The first link interconnects the piston arm of the first piston assembly with the piston arm of the third piston assembly, and the second link interconnects the piston arm of the second piston assembly with the piston arm of the fourth piston assembly.

The cam follower assembly of the first piston assembly engages the first cam and the cam follower assembly of the second piston assembly engages the second cam.

A second combustion cylinder having a first end and a second end and defined along second center cylinder axis parallel with the first combustion cylinder central axis but radially spaced outward from the first combustion cylinder central axis; a third cam mounted on the driveshaft between the first cam and the first driveshaft end, the third cam having a circumferential shoulder of a third cam diameter and a third curvilinear shape with a third frequency, the third cam diameter being larger than the first cam diameter; a fourth cam mounted on the driveshaft between the second cam and the second end of the driveshaft, the fourth cam having a circumferential shoulder of a fourth curvilinear shape which fourth curvilinear shape has the same frequency as the third curvilinear shape.

A third piston assembly disposed in the first cylinder end of the second combustion cylinder and an opposing fourth piston assembly disposed in the second cylinder end of the second combustion cylinder, the third piston assembly engaging the curvilinear shaped shoulder of the third cam and the fourth piston assembly engaging the curvilinear shaped shoulder of the fourth cam, each piston assembly movable between an inner dead center position in which the piston assembly is fully extended in the combustion chamber away from its corresponding cam and an outer dead center position in which the piston assembly is fully retracted in the combustion chamber away from the inner dead center position.

The fourth cam has a fourth cam diameter which fourth cam diameter is the same as the third cam diameter.

The frequency of the third cam is less than the frequency of the first cam.

The curvilinear shaped first cam shoulder of the first cam has at least two peaks having a first peak amplitude and at least two troughs having a first trough amplitude; and the curvilinear shaped third cam shoulder has at least two peaks having a second peak amplitude and at least two troughs having a second trough amplitude, wherein the amplitudes of the third cam shoulder are less than the amplitudes of the first cam shoulder.

Comprising a piston arm having a first end and a second end, with a piston attached to the first end of the piston arm and a cam follower attached to the second end of the piston arm, wherein the cam follower assembly includes an elongated body having a first end and a second end, the elongated body having an axially extending first slot formed in the body adjacent the first end and an axially extending second slot formed in the body adjacent the second; a first roller mounted to the body in first slot; and a second roller mounted to the body in second slot.

The second cam has a second cam diameter which second cam diameter is the same as the first cam diameter.

The curvilinear shape is sinusoidal shape.

The curvilinear shape is a segmented polynomial shape.

The cams are substantially in phase so that the peak of a lobe of the first cam is aligned with and substantially mirrors the peak of a lobe of the second cam.

The cams are substantially in phase so that the peak of each lobe of the first cam is aligned with and substantially mirrors a peak of each lobe of the second cam.

The average slope of the descending shoulder portion is greater than 45 degrees.

Each lobe is asymmetrical about its peak.

A segment of the shoulder shape extending from a peak towards the second trough is linear.

The linear segment of shoulder shape extending from a lobe peak has a slope greater than zero and less than 20 degrees.

Each adjacent lobe has a linear segment of shoulder shape extending from the lobe peak, and the linear segments have a changing slope that is the same.

The slope of the descending shoulder portion of a lobe of the first cam is the same as the slope of the descending shoulder portion of an adjacent lobe of the second cam.

The segmented polynomial shaped shoulder of the first cam has the same shape as the segmented polynomial shaped shoulder of the second cam.

The descending portions of the segmented polynomial shaped shoulder of the first cam have the same shape as the descending portions of the segmented polynomial shaped track of the second cam.

The ascending portions of the segmented polynomial shaped shoulder of the first cam have the same shape as the ascending portions of the segmented polynomial shaped shoulder of the second cam.

The ascending portions of the segmented polynomial shaped shoulder of the first cam have a different shape than the ascending portions of the segmented polynomial shaped shoulder of the second cam.

A combustion cylinder defined along the piston axis, the combustion cylinder having a first end and a second end with an intake port formed in the cylinder between the first and second ends and having an outer port edge closest to the first end and an inner port edge closest to the second end, an exhaust port formed in the cylinder between the intake port and the second end and having an outer port edge closest to the second end and an inner port edge closest to the first end, with inner dead center of the combustion cylinder defined approximately equidistance between the outer edge of the intake port and the outer edge of the exhaust port.

The inner port edge of the exhaust port is closer to inner dead center than the inner port edge of the intake port.

A first piston is reciprocatingly disposed in the first cylinder end of the combustion cylinder and engages the first cam along the first segmented polynomial shaped shoulder, and an opposing second piston is reciprocatingly disposed in the second cylinder end of the combustion cylinder and engages the second cam along the second segmented polynomial shaped shoulder.

The first piston and second piston are adjacent inner dead center of the combustion cylinder when the first piston engages the first cam at the peak of a first cam lobe, the first piston blocking flow through the intake port and the second piston blocking flow though the exhaust port.

The first piston is adjacent the outer edge of the intake port and second piston is adjacent the outer edge of the exhaust port when the first piston engages the first cam at a trough along the first segmented polynomial shaped shoulder.

The first piston blocks flow through the intake port when the first piston engages the first cam along a descending shoulder portion of a lobe of the first cam and the second piston is spaced apart from the inner port edge of the exhaust port when the first piston engages the first cam along the descending shoulder portion of the lobe.

The second piston blocks flow through the exhaust port when the second piston engages the second cam along an ascending shoulder portion of a lobe of the second cam and the first piston is spaced apart from the inner port edge of the intake port when the second piston engages the second cam along the ascending shoulder portion of the lobe.

A combustion chamber is defined within the cylinder between the two cylinder ends, the combustion cylinder further comprising a cylinder wall and the exhaust port comprises a plurality of exhaust slots formed in the cylinder wall between the fuel injector and the second end, each exhaust slot extending along a slot axis generally parallel with the central cylinder axis, the intake port comprising a plurality of intake slots formed in the cylinder wall between the fuel injector and the first end, each intake slot extending along a slot axis generally diagonal with the central cylinder axis.

A fuel injection port formed in the cylinder wall at inner dead center of the combustion cylinder.

A spark plug port formed in the cylinder wall between the plurality of exhaust slots and the plurality of intake slots.

The first and second segmented polynomial shaped shoulders are symmetric in shape extending from a respective lobe peak to a point along the descending shoulder portion and asymmetric in shape along the shoulders extending from the respective second trough to the lobe peak.

Each cam has a single lobe and the first trough and second trough are the same.

An engine block in which the driveshaft is supported, the engine block extending between a first end and a second end and includes an annular body portion therebetween, which annular body is generally coaxial with the driveshaft, and which annular body portion is characterized by an exterior surface, wherein at least one cylinder bore radially spaced apart from the driveshaft but parallel therewith is formed in the engine block.

The engine block comprises a first annular channel and a second annular channel spaced apart from one another, the first annular channel in fluid communication with the intake port of the combustion cylinder and the second annular channel in fluid communication with the exhaust port of the combustion cylinder.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; further comprising: a second combustion cylinder having a first end and a second end, the second combustion cylinder defined along the center cylinder axis so as to be axially aligned with the first combustion cylinder; a third piston assembly disposed in the first cylinder end of the second combustion cylinder; and an opposing fourth piston assembly disposed in the second cylinder end of the second combustion cylinder.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; further comprising two or more combustion cylinders axially aligned along the central cylinder axis, each combustion cylinder having a first end and a second end with a piston assembly disposed in each cylinder end so that piston heads of the piston assemblies of a cylinder oppose one another within the cylinder.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; wherein the combustion cylinder further comprises a cylinder wall and the exhaust port comprises a plurality of exhaust slots formed in the cylinder wall between the fuel injector and the second end, each exhaust slot extending along a slot axis generally parallel with the central cylinder axis, the intake port comprising a plurality of intake slots formed in the cylinder wall between the fuel injector and the first end, each intake slot extending along a slot axis generally diagonal with the central cylinder axis.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; further comprising at least one annular flow manifold extending at least partially around the driveshaft, the annular flow manifold fluidically connecting the ports of two or more combustion cylinders.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; further comprising an annular intake manifold extending at least partially around the driveshaft and fluidically connecting the intake ports of two or more combustion cylinders; and an annular exhaust manifold extending at least partially around the driveshaft, spaced axially apart from the annular intake manifold, the annular exhaust manifold fluidically connecting the exhaust ports of two or more combustion cylinders.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; further comprising an engine block in which the driveshaft and combustion cylinder are supported, the engine block extends between a first end and a second end and includes an annular body portion therebetween, which annular body portion is characterized by an exterior surface and in which is formed a first annular channel and a second annular channel spaced apart from one another, the first annular channel in fluid communication with the intake port of the combustion cylinder and the second annular channel in fluid communication with the exhaust port of the combustion cylinder.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; wherein the first cam comprises a hub mounted on driveshaft with the circumferential shoulder extending around a periphery of hub, the curvilinear shaped first cam shoulder has at least two peaks and at least two troughs formed by the shoulder, wherein each trough includes a substantially flat portion at its base and wherein each peak is rounded at its apex; the second cam comprises a hub mounted on driveshaft with the circumferential shoulder extending around a periphery of hub, the curvilinear shaped second cam shoulder has at least two crests and at least two troughs formed by the shoulder and corresponding in number to the crests and troughs of the first cam, wherein each trough of the second cam is rounded at its base and wherein each peak includes a substantially flat portion at its apex.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; wherein the first cam comprises a hub mounted on driveshaft with the circumferential shoulder extending around a periphery of hub, the curvilinear shaped first cam shoulder has at least two peaks having a first peak amplitude and at least two troughs having a first trough amplitude, wherein the first trough amplitude is less than the first peak amplitude; and the second cam comprises a hub mounted on driveshaft with the circumferential shoulder extending around a periphery of hub, the curvilinear shaped second cam shoulder has at least two peaks having a second peak amplitude and at least two troughs having a second trough amplitude, wherein the second trough amplitude is greater than the second peak amplitude.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; wherein the piston assembly comprises a piston arm having a first annular body of a piston arm diameter spaced apart from a second annular body having a similar piston arm diameter and interconnected by a smaller diameter neck, with a piston attached to the first annular body and a cam follower attached to the second annular body.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; wherein the piston assembly comprises a piston arm having a first end and a second end, with a piston attached to the first end of the piston arm and a cam follower attached to the second end of the piston arm, wherein the cam follower assembly includes an elongated body having a first end and a second end, wherein the elongated body is generally cylindrically shaped at each end, which ends are interconnected by an arm within which is formed a lubrication passage extending along a portion of the length of the arm between the two ends, the elongated body having an axially extending first slot in formed in the body adjacent the first end and an axially extending second slot formed in the body adjacent the second; a first roller mounted to the body in the first slot; and a second roller mounted to the body in the second slot, wherein the lubrication passage extends in the arm between the two rollers.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; comprising a first guidance cap positioned adjacent the first end of the driveshaft and a second guidance cap positioned adjacent the second end of the driveshaft.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; wherein the piston assembly comprises a piston arm having a first end and a second end, with a piston attached to the first end of the piston arm and a cam follower attached to the second end of the piston arm, wherein the piston is formed of an annular body having a first end attached to piston arm and a second end, with a crown formed at the second end of the annular body, the crown having an indention formed in an outwardly facing crown surface.

A driveshaft having a first end and a second end and disposed along a driveshaft axis; a first cam mounted on the driveshaft, the first cam having a circumferential shoulder of a first cam diameter and a first curvilinear shape with a first frequency; a second cam mounted on the driveshaft spaced apart from the first cam, the second cam having a circumferential shoulder of a second curvilinear shape which second curvilinear shape has the same frequency as the first curvilinear shape; a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends; a first piston assembly disposed in the first cylinder end of the first combustion cylinder and an opposing second piston assembly disposed in the second cylinder end of the first combustion cylinder, the first piston assembly engaging the curvilinear shaped shoulder of the first cam and the second piston assembly engaging the curvilinear shaped shoulder of the second cam, each piston assembly movable between an inner dead center position in which the piston assembly is fully extended in the combustion chamber away from its corresponding cam and an outer dead center position in which the piston assembly is fully retracted in the combustion chamber away from the inner dead center position; at least one fuel injector disposed adjacent the center of the combustion cylinder and in communication with said combustion chamber; further comprising: a second combustion cylinder having a first end and a second end and defined along second center cylinder axis parallel with the first combustion cylinder central axis but radially spaced outward from the first combustion cylinder central axis; a third cam mounted on the driveshaft between the first cam and the first driveshaft end, the third cam having a circumferential shoulder of a third cam diameter and a third curvilinear shape with a third frequency, the third cam diameter being larger than the first cam diameter; a fourth cam mounted on the driveshaft between the second cam and the second end of the driveshaft, the fourth cam having a circumferential shoulder of a fourth curvilinear shape which fourth curvilinear shape has the same frequency as the third curvilinear shape.

A third hydraulic passage extending along the driveshaft to a third outlet and a fourth hydraulic passage extending along the driveshaft to a fourth outlet spaced apart from the third outlet; a combustion chamber coaxial with the piston axis and in which the first piston reciprocates; a second piston disposed to reciprocate within the piston chamber opposite the first piston; a third collar formed along the driveshaft adjacent the third outlet and a fourth collar formed along the driveshaft adjacent the fourth outlet, each collar extending radially outward from driveshaft; and a second cam rotatably mounted on the driveshaft adjacent the second and third collars, the second cam having a second hub having a first end mounted adjacent the third collar so as to form a third pressure chamber between the second hub first end and the third collar, with the third outlet in fluid communication with the third pressure chamber, the second hub having a second end mounted adjacent the fourth collar so as to form a fourth pressure chamber between the second hub second end and the fourth collar, with the fourth outlet in fluid communication with fourth pressure chamber, with a circumferential cam shoulder extending around a periphery of the second hub, the cam shoulder having a second cam diameter and a second polynomial shaped track.

Aa third hydraulic passage extending along the driveshaft and a fourth hydraulic passage extending along the driveshaft, a third set of radial passages in fluid communication with the third hydraulic passage and a fourth set of radial passages in fluid communication with the fourth hydraulic passage; a combustion chamber coaxial with the piston axis and in which the first piston reciprocates; a second piston disposed to reciprocate within the piston chamber opposite the first piston; a second cam rotatably mounted on the driveshaft spaced apart from the first cam, the first cam having a second hub with a circumferential cam shoulder extending around a periphery of the second hub, the second cam shoulder having a second cam diameter and a second polynomial shaped track; a third radially extending lug formed along the driveshaft adjacent the second cam hub and a fourth radially extending lug formed along the driveshaft adjacent the second cam hub, a radial passage a radial passage of radial passages terminating in a first ported lug outlet formed in the third lug and a radial passage of of radial passages terminating in a second ported lug outlet formed in the third lug, a radial passage of the third set of radial passages terminating in a third ported lug outlet formed in the fourth lug and a radial passage of the fourth set of radial passages terminating in a fourth ported lug outlet formed in the fourth lug; a first pressure chamber formed between the third lug and the second cam hub and a second pressure chamber formed between the fourth lug and the second cam hub, the first ported lug outlet in the third lug in fluid communication with the first pressure chamber and the third ported lug outlet in the third lug in fluid communication with the second pressure chamber; a third pressure chamber formed between the third lug and the second cam hub; and a fourth pressure chamber formed between the fourth lug and the second cam hub, the second ported lug outlet of the fourth lug in fluid communication with the third pressure chamber and the fourth ported lug outlet in the fourth lug in fluid communication with the fourth pressure chamber.

The first hub comprises a hub wall having spaced apart first and second slots formed along an inner circumference of the hub wall, wherein the first lug extends into the first slot and the second lug extends into the second slot.

The first slot has a first shoulder and a second shoulder, the first pressure chamber being formed between the first shoulder and the first lug and the second pressure chamber being formed between the second shoulder and the first lug, wherein the second slot has a third shoulder and a fourth shoulder, the third pressure chamber being formed between the third shoulder and the second lug and the fourth pressure chamber being formed between the fourth shoulder and the second lug.

The first cam is rotatable relative to the driveshaft between a first radial position and a second radial position, wherein the first pressure chamber has a volume that is greater than a volume of the second pressure chamber when the first cam is in the first radial position and the second pressure chamber has a volume that is greater than the volume of the first pressure chamber when the first cam is in the second radial position.

A hydraulic fluid source in fluid communication with each of hydraulic passages to alternatively supply pressurized fluid to one pressure chamber or another pressure chamber.

A control mechanism and a sensor, the sensor disposed to measure a condition of the engine and coupled to the control mechanism disposed to adjust the fluid source based on the measured condition in order to radially rotate the first cam relative to the driveshaft.

Each lug is integrally formed as part of driveshaft.

Thus, a method for operating an internal combustion engine has been described. In some embodiments, the method includes injecting a first fuel into a combustion chamber of the engine and utilizing the first fuel to urge axially aligned pistons apart from one another so as to drive spaced apart cams mounted on a driveshaft; rotating, relative to the driveshaft, at least one of the cams on the driveshaft from a first radial position to a second radial position; and injecting a second fuel into the combustion chamber of the engine and utilizing the second fuel to urge axially aligned pistons apart from one another so as to drive the spaced apart cams mounted on a driveshaft. In another embodiment, the method includes combusting a fuel within a combustion chamber of the engine to urge axially aligned pistons apart from one another so as to drive spaced apart cams mounted on a driveshaft parallel with the axially aligned piston; measuring a condition of the engine while the engine is operating; and rotating at least one of the cams on the driveshaft from a first radial position to a second radial position while the engine is operating, the second radial position selected based on the measured condition of the engine. In some embodiments, the method includes moving a first cam follower along a first cam from a first position on the first cam in which a first piston is at inner dead center within a combustion cylinder to a second position on the first cam in which the first piston blocks flow through an intake port in the cylinder, and simultaneously moving a second cam follower along a second cam from a first position on the second cam in which a second piston is at inner dead center within the combustion cylinder to a second position on the second cam, so as to cause the second piston to open an exhaust port in the cylinder, wherein the respective piston move axially away from one another as the respective cam followers move from the first position to the second position; continuing to move the first cam follower along the first cam from the second position to a third position on the first cam so as to cause the first piston to continue to move away from inner dead center and to open the intake port, and simultaneously moving the second cam follower along the second cam from the second position to a third position so as to cause the second piston to move away from the first piston while the exhaust port remains open to outer dead center for the second piston; continuing to move the first cam follower along the first cam from the third position to a fourth position in which the intake port remains open, and simultaneously moving the second cam follower along the second cam from the third position to a fourth position so as to cause the second piston to close the exhaust port in the cylinder, wherein the respective piston move axially towards one another as the respective cam followers move from the third position to the fourth position; continuing to move the first cam follower along the first cam from the fourth position to a fifth position so as to cause the first piston to move axially towards second piston and inner dead center, whereby movement of the first piston closes the intake port in the cylinder, and simultaneously moving the second cam follower along the second cam from the fourth position to a fifth position so as to cause the second piston to move axially towards the first piston and inner dead center; and continuing to move the first cam follower along the first cam from the fifth position to the first position on the cam so as to cause the first piston to move axially towards second piston and inner dead center, and simultaneously moving the second cam follower along the second cam from the fifth position to the first position on the cam so as to cause the second piston to move axially towards the first piston and inner dead center.

The following steps may be combined alone or in combination with any other steps for any of the foregoing embodiments:

Altering the radial position relative to the driveshaft of at least one cam on the driveshaft based on the type of fuel injected into the combustion chamber.

Rotating comprises injecting a fluid into a fluid chamber adjacent the cam while the engine is operating in order to alter the relative radial position of the cam on the driveshaft.

The fluid is injected through a channel formed in the driveshaft.

Injecting a hydraulic fluid into a first fluid chamber while the engine is operating to alter the radial position of a cam relative to the driveshaft in a first direction; measuring an additional condition of the engine while the engine is operating and based on the measured additional condition, injecting a hydraulic fluid into a second fluid chamber while the engine is operating to alter the radial position of the cam relative to the driveshaft in a second direction opposite the first direction.

Movement of the cam followers along their respective cams from the fourth position to the fifth position causes an inertial supercharging effect within the combustion chamber.

Movement of the cam followers along their respective cams from the second position to the third position initiates scavenging.

Movement of the cam followers along their respective cams from the third position to the fourth position causes uniflow scavenging.

Movement of the cam followers along their respective cams from the second position to the third position causes the Kadenacy effect within the combustion cylinder on combustion gases.

The first and second pistons are in phase as the cam followers move along their respective cams from the first position to the second position, and the first and second pistons are out of phase as the cam followers move along their respective cams from the second position through the third, fourth and fifth positions back to the first position.

The second piston leads the first piston when the pistons are out of phase.

The pistons are continually moving within the combustion cylinder during operation of the internal combustion engine.

The pistons have a divergence rate as the cam followers move from the first position to the third position and a convergence rate as the cam followers move from the fourth position back to the first position, wherein the divergence rate of the pistons at the beginning of movement of the cam followers from the first position to the second position on their respective cams is uniform and occurs at a first divergence rate, and thereafter continued divergence of the pistons as movement of the cam followers continues from the first position to the second position on their respective cams is uniform and occurs at a second divergence rate higher than the first divergence rate.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

The invention claimed is:

1. An internal combustion engine comprising:

a driveshaft having a first end and a second end and disposed along a driveshaft axis;

a first cam mounted on the driveshaft, the first cam having a cam hub attached the driveshaft, and a circumferential cam shoulder extending around a periphery of the hub, the cam shoulder having a first cam diameter and a first segmented polynomial shape, the shoulder having at least two lobes formed by the polynomial shape, each lobe characterized by a peak positioned between a first trough and a second trough and a lobe wavelength between the two troughs, the peak having a maximum amplitude for the lobe, where the wavelength distance from the first trough to peak of an ascending shoulder portion of the lobe is greater than the wavelength distance from the peak to the second trough of a descending shoulder portion of the lobe;

a second cam mounted on the driveshaft spaced apart from the first cam, the second cam having a cam hub attached the driveshaft, and a circumferential cam shoulder extending around a periphery of the hub, the cam shoulder having a second segmented polynomial shape of constantly changing slope which second segmented polynomial shape has the same frequency as the first segmented polynomial shape, the shoulder having at least two lobes formed by the second polynomial shape, each lobe characterized by a peak positioned between a first trough and a second trough and a lobe wavelength between the two troughs, the peak having a maximum amplitude for the lobe, where the wavelength distance from the first trough to peak of an ascending shoulder portion of the lobe is greater than the wavelength distance from the peak to the second trough of a descending shoulder portion of the lobe, wherein the number of lobes of the second cam corresponds with the number of lobes of the first cam;

a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends;

a first piston assembly disposed in the first cylinder end of the first combustion cylinder and an opposing second piston assembly disposed in the second cylinder end of the first combustion cylinder, the first piston assembly engaging the segmented polynomial shaped shoulder of the first cam and the second piston assembly engaging the segmented polynomial shaped shoulder of the second cam, each piston assembly movable between an inner dead center (IDC) position in which the piston assembly is fully extended in the combustion chamber away from its corresponding cam and an outer dead center position in which the piston assembly is fully retracted in the combustion chamber away from the inner dead center position; and at least one fuel injector disposed adjacent a center of the combustion cylinder and in communication with said combustion chamber, and wherein the cams oppose one another so that the peak of a lobe of the first cam is substantially aligned with the peak of a lobe of the second cam, but no portion of first segmented polynomial shaped shoulder is parallel with a portion of second segmented polynomial shaped shoulder.

2. The internal combustion engine of claim 1, further comprising: a second combustion cylinder having a first end and a second end, the second combustion cylinder defined along the center cylinder axis so as to be axially aligned with the first combustion cylinder; a third piston assembly disposed in the first cylinder end of the second combustion cylinder; and an opposing fourth piston assembly disposed in the second cylinder end of the second combustion cylinder, and a first combustion cylinder defined along a center cylinder axis, the combustion cylinder having a first end and a second end with an intake port formed in the cylinder between the first and second ends and an exhaust port formed in the cylinder between the intake port and the second end, the center cylinder axis being parallel with but spaced apart from the driveshaft axis, wherein a combustion chamber is defined within the cylinder between the two cylinder ends.

3. The internal combustion engine of claim 1, wherein the combustion cylinder further comprises a cylinder wall with a combustion port formed in the cylinder wall between the intake and exhaust ports, wherein the exhaust port comprises a plurality of exhaust slots formed in the cylinder wall between the fuel injector and the second end, and the intake port comprising a plurality of intake slots formed in the cylinder wall between the fuel injector and the first end, wherein the intake port has an outer port edge and an inner port edge and the exhaust port has an outer port edge and an inner port edge, wherein the outer port edges are equidistance from the combustion port and the inner port edge of the exhaust port is closer to the combustion port than the inner port edge of the intake port.

4. The internal combustion engine of claim 1, further comprising a second combustion cylinder defined along a second combustion cylinder center cylinder axis, the second combustion cylinder having a first end and a second end with an intake port formed in the cylinder between the first and second ends and an exhaust port formed in the cylinder between the intake port and the second end, the second center cylinder axis being parallel with but spaced apart from the driveshaft axis, wherein a combustion chamber is defined within the cylinder between the two cylinder ends; and at least one annular flow manifold extending at least partially around the driveshaft, the annular flow manifold fluidically connecting the ports of two or more combustion cylinders.

5. The internal combustion engine of claim 1, further comprising an engine block in which the driveshaft and combustion cylinder are supported, the engine block extends between a first end and a second end and includes an annular body portion therebetween, which annular body portion is characterized by an exterior surface in which is formed a first annular channel and a second annular channel spaced apart from one another, the first annular channel in fluid communication with the intake port of the combustion cylinder and the second annular channel in fluid communication with the exhaust port of the combustion cylinder.

6. The internal combustion engine of claim 1, wherein the piston assembly comprises a piston arm having a first annular body of a first piston arm diameter spaced apart from a second annular body having a second piston arm diameter substantially the same as the first piston diameter and interconnected by a neck having a diameter smaller than the first piston arm diameter, with a piston attached to the first annular body and a cam follower attached to the second annular body.

7. The internal combustion engine of claim 1, wherein the piston assembly comprises a piston arm having a first end and a second end, with a piston attached to the first end of the piston arm and a cam follower attached to the second end of the piston arm, wherein the cam follower assembly includes an elongated body having a first end and a second end, wherein the elongated body is generally cylindrically shaped at each end, which ends are interconnected by an arm, the elongated body having an axially extending first slot in formed in the body adjacent the first end and an axially extending second slot formed in the body adjacent the second; a first roller mounted to the body in the first slot; and a second roller mounted to the body in the second slot.

8. The internal combustion engine of claim 1, wherein the piston assembly comprises a piston arm having a first end and a second end, with a piston attached to the first end of the piston arm and a cam follower attached to the second end of the piston arm, wherein the piston is formed of an annular body having a first end attached to piston arm and a second end, with a crown formed at the second end of the annular body, the crown having an indention formed in an outwardly facing crown surface and a radially extending notch intersecting the indention.

9. The internal combustion engine of claim 1, further comprising: a second combustion cylinder having a first end and a second end and defined along second center cylinder axis parallel with the first combustion cylinder central axis but radially spaced outward from the first combustion cylinder central axis;

a third cam mounted on the driveshaft between the first cam and the first driveshaft end, the third cam having a circumferential shoulder of a third cam diameter and a third segmented polynomial shape with a third frequency, the third cam diameter being larger than the first cam diameter;

a fourth cam mounted on the driveshaft between the second cam and the second end of the driveshaft, the fourth cam having a circumferential shoulder of a fourth segmented polynomial shape which fourth segmented polynomial shape has the same frequency as the third segmented polynomial shape.

10. The internal combustion engine of claim 1, further comprising a first radially extending lug formed along the driveshaft adjacent the first cam hub and a second radially extending lug formed along the driveshaft adjacent the first cam hub, a radial passage of the first set of radial passages terminating in a first ported lug outlet formed in the first lug and a radial passage of the second set of radial passages terminating in a second ported lug outlet formed in the first lug, a radial passage of the first set of radial passages terminating in a third ported lug outlet formed in the second lug and a radial passage of the second set of radial passages terminating in a fourth ported lug outlet formed in the second lug, a first pressure chamber formed between the first lug and the first cam hub and a second pressure chamber, formed between the first lug and the first cam hub, the first ported lug outlet in the first lug in fluid communication with the first pressure chamber and the third ported lug outlet in the first lug in fluid communication with the second pressure chamber;

a third pressure chamber formed between the second lug and the first cam hub and a fourth pressure chamber formed between the second lug and the first cam hub, the second ported lug outlet in the second lug in fluid communication with the second pressure chamber and the fourth ported lug outlet in the second lug in fluid communication with the fourth pressure chamber.

11. An internal combustion engine comprising:

a driveshaft having a first end and a second end and disposed along a driveshaft axis;

a piston disposed to reciprocate along a piston axis, the piston axis being parallel with but spaced apart from the driveshaft axis, and a first cam mounted on the driveshaft, the first cam comprising:

a first cam hub attached the driveshaft, and a circumferential cam shoulder extending around a periphery of the first cam hub, the cam shoulder having a first cam diameter and a first segmented polynomial shape, the shoulder having at least one lobe formed by the polynomial shape, each lobe characterized by a peak positioned between a first trough and a second trough and a lobe wavelength between the two troughs, the peak having a maximum amplitude for the lobe, where the wavelength distance from the first trough to peak of an ascending shoulder portion of the lobe is greater than the wavelength distance from the peak to the second trough of a descending shoulder portion of the lobe; and a second cam mounted on the driveshaft and spaced apart from the first cam, the second cam comprising:

a second cam hub attached the driveshaft, and a circumferential cam shoulder extending around a periphery of the second cam hub, the cam shoulder having a second segmented polynomial shape which second segmented polynomial shape has the same frequency as the first segmented polynomial shape, the second cam hub shoulder having at least one lobe formed by the second polynomial shape, each lobe characterized by a peak positioned between a first trough and a second trough and a lobe wavelength between the two troughs, the peak having a maximum amplitude for the lobe, where the wavelength distance from the first trough to peak of an ascending shoulder portion of the lobe is greater than the wavelength distance from the peak to the second trough of a descending shoulder portion of the lobe, wherein the number of lobes of the second cam corresponds with the number of lobes of the first cam; and wherein the cams oppose one another so that the peak of a lobe of the first cam is substantially aligned with the peak of a lobe of the second cam, but no portion of first segmented polynomial shaped shoulder is parallel with a portion of second segmented polynomial shaped shoulder.

12. The internal combustion engine of claim 11, wherein the cams are substantially in phase so that the peak of each lobe of the first cam is aligned with and substantially mirrors a peak of each lobe of the second cam.

13. The internal combustion engine of claim 11, wherein each lobe is asymmetrical about its peak.

14. The internal combustion engine of claim 11, wherein a segment of the shoulder shape extending from a peak towards the second trough is linear, wherein the linear segment of the shoulder shape extending from a lobe peak has a slope greater than zero and less than 20 degrees.

15. The internal combustion engine of claim 13, wherein opposing lobes of the first and second cams each have a linear segment of the shoulder shape extending from the respective lobe peak, wherein the linear segments of the opposing lobes have a changing slope that is the same.

16. The internal combustion engine of claim 11, wherein a slope of the descending shoulder portion of a lobe of the first cam is the same as a slope of the descending shoulder portion of an opposing lobe of the second cam.

17. The internal combustion engine of claim 11, wherein the descending portions of the segmented polynomial shaped shoulder of the first cam have the same shape as the opposing descending portions of the segmented polynomial shaped track of the second cam.

18. The internal combustion engine of claim 17, wherein the ascending portions of the segmented polynomial shaped shoulder of the first cam have the same shape as the opposing ascending portions of the segmented polynomial shaped shoulder of the second cam.

19. The internal combustion engine of claim 17, wherein the ascending portions of the segmented polynomial shaped shoulder of the first cam have a different shape than the ascending portions of the segmented polynomial shaped shoulder of the second cam.

20. An internal combustion engine comprising:

a driveshaft having a first end and a second end and disposed along a driveshaft axis;

a piston disposed to reciprocate along a piston axis, the piston axis being parallel with but spaced apart from the driveshaft axis, and a first cam mounted on the driveshaft, the first cam comprising a cam hub attached the driveshaft, and a circumferential cam shoulder extending around a periphery of the hub, the cam shoulder having a first cam diameter and a first segmented polynomial shape, the shoulder having at least one lobe formed by the polynomial shape, each lobe characterized by a peak positioned between a first trough and a second trough, the lobe having an ascending shoulder portion between the first trough and the peak and a descending shoulder portion between the peak and the second trough, wherein the average slope of the ascending shoulder portion is greater than the average slope of the descending shoulder portion; and a second cam mounted on the driveshaft and spaced apart from the first cam, the second cam comprising a cam hub attached the driveshaft, and a circumferential cam shoulder extending around a periphery of the hub, the cam shoulder having a second segmented polynomial shape which second segmented polynomial shape has the same frequency as the first segmented polynomial shape, the shoulder having at least one lobe formed by the second polynomial shape, each lobe characterized by a peak positioned between a first trough and a second trough, the lobe having an ascending shoulder portion between the first trough and the peak and a descending shoulder portion between the peak and the second trough, wherein the average slope of the ascending shoulder portion is greater than the average slope of the descending shoulder portion, wherein the number of lobes of the second cam corresponds with the number of lobes of the first cam; and wherein the first segmented polynomial shaped shoulder and the second segmented polynomial shaped shoulder oppose one another so as to be constantly diverging or converging from one another.

21. The internal combustion engine of claim 20, wherein a segment of the shoulder shape extending from a peak towards the second trough is linear, wherein the linear segment of shoulder shape extending from a lobe peak has a slope greater than zero and less than 20 degrees.

22. The internal combustion engine of claim 20, wherein the first and second segmented polynomial shaped shoulders are symmetric in shape extending from a respective lobe peak to a point along the descending shoulder portion and asymmetric in shape along the shoulders extending from the respective second trough to the lobe peak.

23. A method for operating an internal combustion engine comprising:

moving a first cam follower along a first cam from a first position on the first cam in which a first piston is at inner dead center within a combustion cylinder to a second position on the first cam in which the first piston blocks flow through an intake port in the cylinder, and simultaneously moving a second cam follower along a second cam from a first position on the second cam in which a second piston is at inner dead center within the combustion cylinder to a second position on the second cam, so as to cause the second piston to open an exhaust port in the cylinder, wherein the respective piston move axially away from one another as the respective cam followers move from the first position to the second position;

continuing to move the first cam follower along the first cam from the second position to a third position on the first cam so as to cause the first piston to continue to move away from inner dead center and to open the intake port, and simultaneously moving the second cam follower along the second cam from the second position to a third position so as to cause the second piston to move away from the first piston while the exhaust port remains open to outer dead center for the second piston;

continuing to move the first cam follower along the first cam from the third position to a fourth position in which the intake port remains open, and simultaneously moving the second cam follower along the second cam from the third position to a fourth position so as to cause the second piston to close the exhaust port in the cylinder, wherein the respective piston move axially towards one another as the respective cam followers move from the third position to the fourth position;

continuing to move the first cam follower along the first cam from the fourth position to a fifth position so as to cause the first piston to move axially towards second piston and inner dead center, whereby movement of the first piston closes the intake port in the cylinder, and simultaneously moving the second cam follower along the second cam from the fourth position to a fifth position so as to cause the second piston to move axially towards the first piston and inner dead center; and continuing to move the first cam follower along the first cam from the fifth position to the first position on the cam so as to cause the first piston to move axially towards second piston and inner dead center, and simultaneously moving the second cam follower along the second cam from the fifth position to the first position on the cam so as to cause the second piston to move axially towards the first piston and inner dead center.

24. The method of claim 23, wherein movement of the cam followers along their respective cams from the fourth position to the fifth position causes an inertial supercharging effect within the combustion chamber.

25. The method of claim 23, wherein movement of the cam followers along their respective cams from the second position to the third position initiates scavenging.

26. The method of claim 23, wherein movement of the cam followers along their respective cams from the third position to the fourth position causes uniflow scavenging.

27. The method of claim 23, wherein movement of the cam followers along their respective cams from the second position to the third position causes the Kadenacy effect within the combustion cylinder on combustion gases.

28. The method of claim 23, wherein the first and second pistons are in phase as the cam followers move along their respective cams from the first position to the second position, and the first and second pistons are out of phase as the cam followers move along their respective cams from the second position through the third, fourth and fifth positions back to the first position.

29. The method of claim 23, wherein the pistons are continually moving within the combustion cylinder during operation of the internal combustion engine.

30. The method of claim 23, wherein the pistons have a divergence rate as the cam followers move from the first position to the third position and a convergence rate as the cam followers move from the fourth position back to the first position, wherein the divergence rate of the pistons at the beginning of movement of the cam followers from the first position to the second position on their respective cams is uniform and occurs at a first divergence rate, and thereafter continued divergence of the pistons as movement of the cam followers continues from the first position to the second position on their respective cams is uniform and occurs at a second divergence rate higher than the first divergence rate.

* * * * *